US008369722B2

(12) United States Patent
Takasaka et al.

(10) Patent No.: US 8,369,722 B2
(45) Date of Patent: Feb. 5, 2013

(54) IMAGE FORMING APPARATUS

(75) Inventors: Atsushi Takasaka, Mishima (JP); Shigeo Miyabe, Numazu (JP); Daisuke Aoki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 293 days.

(21) Appl. No.: 12/914,768

(22) Filed: Oct. 28, 2010

(65) Prior Publication Data

US 2011/0103812 A1 May 5, 2011

(30) Foreign Application Priority Data

Oct. 30, 2009 (JP) ..... 2009-250819

(51) Int. Cl.
*G03G 15/00* (2006.01)
*G03G 15/01* (2006.01)

(52) U.S. Cl. ..... 399/44; 399/227

(58) Field of Classification Search ..... 399/227, 399/44, 94

See application file for complete search history.

(56) References Cited

U.S. PATENT DOCUMENTS

| | | | | |
|---|---|---|---|---|
| 5,724,634 | A * | 3/1998 | Maruta | 399/227 |
| 2007/0098461 | A1* | 5/2007 | Miyabe et al. | |

FOREIGN PATENT DOCUMENTS

| | | | |
|---|---|---|---|
| AU | 2008230339 | A1 | 10/2008 |
| CA | 2671325 | A1 | 10/2008 |
| EP | 2137577 | A1 | 12/2009 |
| JP | 2006-208939 | A | 8/2006 |
| JP | 2008-268927 | A | 11/2008 |

* cited by examiner

*Primary Examiner* — Susan Lee
(74) *Attorney, Agent, or Firm* — Canon USA Inc. IP Division

(57) ABSTRACT

An image forming apparatus includes a development device including a development roller and a driving force receiving member, a movable member configured to move the development device between a development position and a retracting position, a first driving force transmission member configured to transmit a driving force to the movable member, a second driving force transmission member configured to engage with the driving force receiving member and transmit the driving force to the driving force receiving member, and a controller configured to perform drive control for the first driving force transmission member based on a temperature detected by a sensor. If $\alpha 1$ represents acceleration of the development device in a case where the temperature is T1 and the driving force receiving member disengages from the second driving force transmission member and $\alpha 2$ represents acceleration of the development device in a case where the temperature is T2 and the driving force receiving member disengages from the second driving force transmission member, the controller performs the drive control for the first driving force transmission member so as to satisfy a relationship $\alpha 1 \leqq \alpha 2$ when $T1 \leqq T2$.

3 Claims, 41 Drawing Sheets

FIG.10A1
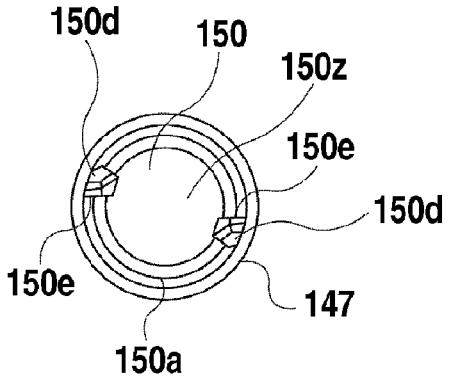
FIG.10A4
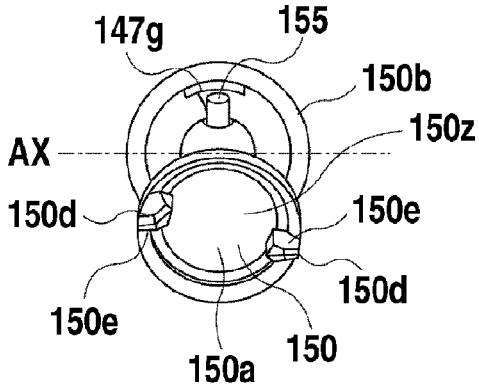
FIG.10A2
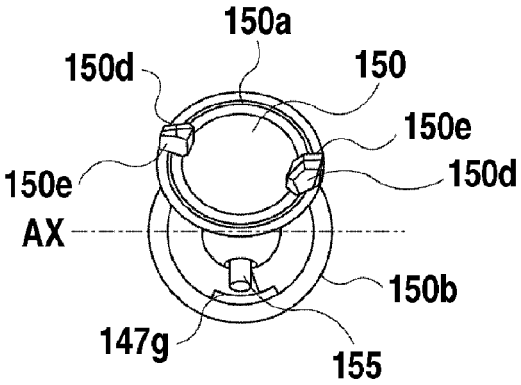
FIG.10A5
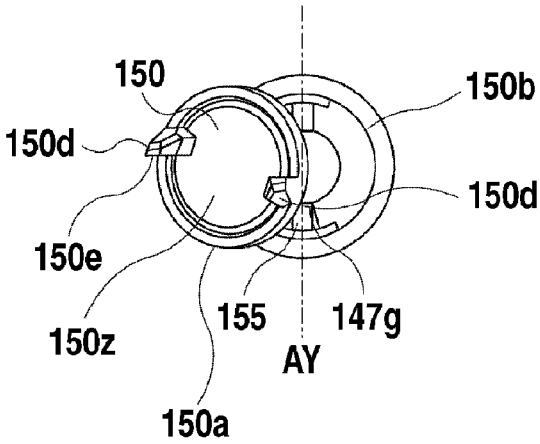
FIG.10A3
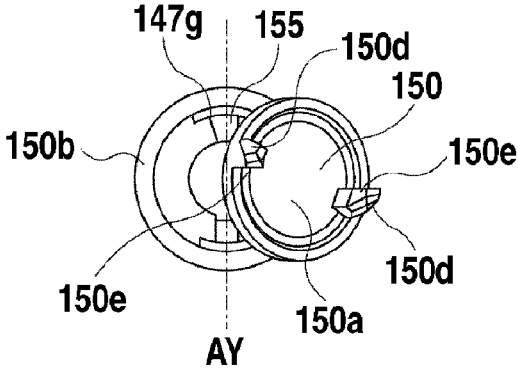

FIG.10B1
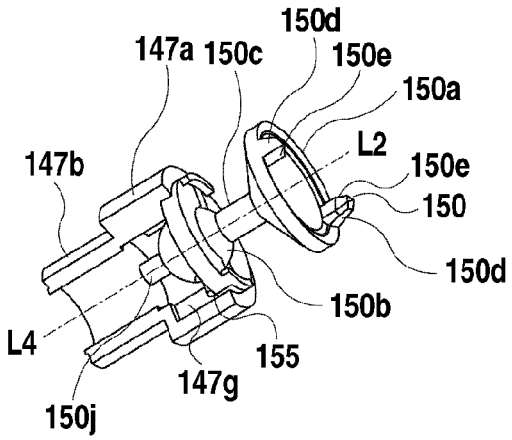
FIG.10B4
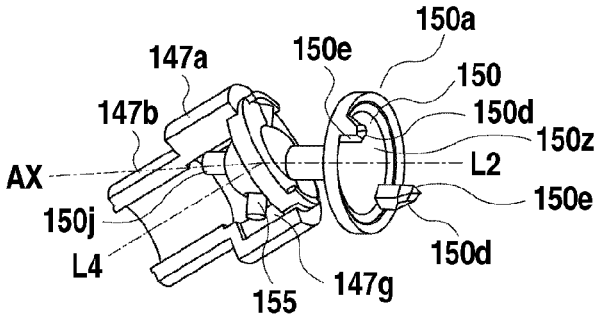
FIG.10B2
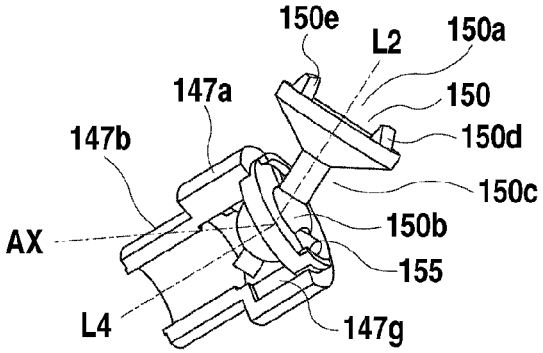
FIG.10B5
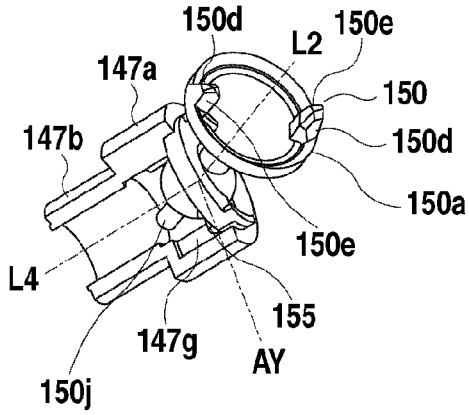
FIG.10B3
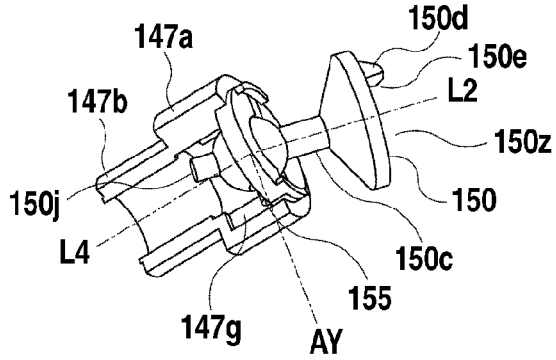

IMAGE FORMING APPARATUS

BACKGROUND OF THE INVENTION

1. Field of the Invention

The present invention relates to an image forming apparatus that uses a development device.

In general, an image forming apparatus forms an image on a recording medium through electrophotographic image forming processes. The image forming apparatus is, for example, an electrophotographic copying machine or an electrophotographic printer (e.g., a laser beam printer, a light emitting diode (LED) printer, etc).

A development device is attachable to or detachable from the body of an electrophotographic image forming apparatus. The development device can develop a developer image when it is attached to the apparatus body. A user can replace the development device, if sufficiently used, with a brand-new one to perform maintenance for the electrophotographic image forming apparatus.

2. Description of the Related Art

In an electrophotographic image forming apparatus (e.g., a copying machine, a printer, or a facsimile machine), a development device is used to develop an electrostatic latent image formed on a drum-shaped electrophotographic photosensitive member (hereinafter, referred to as a "photosensitive drum") as a visible developer image.

There is a conventional electrophotographic image forming apparatus that performs development with a plurality of development devices. A movable member, to which the plurality of development devices are attached, is provided in the electrophotographic image forming apparatus body to cause each development device to approach a development position and develop an electrostatic latent image formed on a photosensitive drum.

For example, a development device discussed in Japanese Patent Application Laid-Open No. 2008-268927 includes a rotational force transmitting member that is tiltably attached to a driving force transmitting position. The above-described development device includes a development roller, to which the rotational force transmitting member can transmit rotational force.

Further, if the development device reaches the development position according to the movement of the movable member, a drive shaft provided on the electrophotographic image forming apparatus body engages with the rotational force transmitting member attached to the development device. In this case, the rotational force transmitting member, which is initially held in an inclined state relative to the driving force transmitting position, approaches the driving force transmitting position when it is engaged with the drive shaft.

Then, a motor provided in the electrophotographic image forming apparatus body transmits a rotational force to the development roller of the development device via the drive shaft of the electrophotographic image forming apparatus body and the rotational force transmitting member of the development device. Thus, the development roller can be rotated to supply a developer that develops an electrostatic latent image formed on a photosensitive drum.

However, according to the conventional development device discussed in Japanese Patent Application Laid-Open No. 2008-268927, it is necessary to move the movable member to bring a development device of the next color to the development position after the development operation by the development device of one color is completed. The rotational force transmitting member of the development device inclines relative to the driving force transmitting position according to the movement of the movable member. As a result, the rotational force transmitting member of the development device can disengage from the drive shaft of the electrophotographic image forming apparatus body.

In this case, it is assumed that the rotational force transmitting member 150 has a pair of rotational force receiving surfaces 150*e* that are inclined relative to a flat portion 150*x* at a constant angle $\alpha 5$ ($90° > \alpha 5 > 0°$) as illustrated in FIG. 7C, and the driving force is transmitted from a pin 182 of an apparatus body side engaging portion as illustrated in FIG. 7G. In this case, the rotational force transmitting member 150 receives a pulling force F3 acting in the direction of the drive shaft 180.

Therefore, to disengage the rotational force transmitting member 150 from the apparatus body side engaging portion, the movement of the movable member is required to press the rotational force transmitting member 150 by a force identical to the force F3 in magnitude but opposite in direction. Thus, the moving load of the movable member temporarily increases when the rotational force transmitting member disengages from the drive shaft.

A movable member driving motor is subjected to the load torque that increases according to the increase in the moving load of the movable member. Further, when the movable member moves in a low-temperature environment, the movable member is subjected to a larger resistance force due to shrinkage of a body side support portion engaging with a sliding portion of the movable member and reduction in viscosity of the grease to be used to lower the contact resistance between the sliding portion and the support portion. Thus, the drive load of the movable member increases significantly.

In general, it is desired that the apparatus body is a low-cost compact type. Therefore, using a low-cost compact motor (i.e., a motor whose upper allowance limit in load torque is relatively low) as the movable member driving motor is useful.

SUMMARY OF THE INVENTION

Exemplary embodiments of the present invention are directed to a technique capable of preventing a movable member of an image forming apparatus body from being excessively subjected to a moving load.

According to an aspect of the present invention, an image forming apparatus includes a development device including a development roller carrying a developer to develop an electrostatic image and a driving force receiving member configured to receive a driving force to rotate the development roller;

a movable member configured to hold the development device and move the development device between a development position where the development device performs development and a retracting position where the development device separates from the development position;

a first driving force transmission member configured to transmit a driving force to the movable member to move the development device;

a second driving force transmission member configured to engage with the driving force receiving member and transmit the driving force to the driving force receiving member in a state where the development device is located at the development position;

a sensor configured to detect an internal body temperature of the image forming apparatus; and a controller configured to perform drive control for the first driving force transmission member based on the temperature detected by the sensor;

wherein if $\alpha 1$ represents acceleration of the development device in a case where the temperature detected by the sensor is T1 and the driving force receiving member disengages from the second driving force transmission member according to a movement of the development device from the development position to the retracting position, and $\alpha 2$ represents acceleration of the development device in a case where the temperature detected by the sensor is T2 and the driving force receiving member disengages from the second driving force transmission member according to a movement of the development device from the development position to the retracting position, the controller performs the drive control for the first driving force transmission member so as to satisfy a relationship $\alpha 1 \leqq \alpha 2$ when $T1 \leqq T2$.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 10A1 to 10A5 and FIGS. 10B1 to 10B5 are perspective views illustrating the rotational force transmitting member according to an exemplary embodiment of the present invention.

DESCRIPTION OF THE EMBODIMENTS

Various exemplary embodiments, features, and aspects of the invention will be described in detail below with reference to the drawings.

Figure 1:
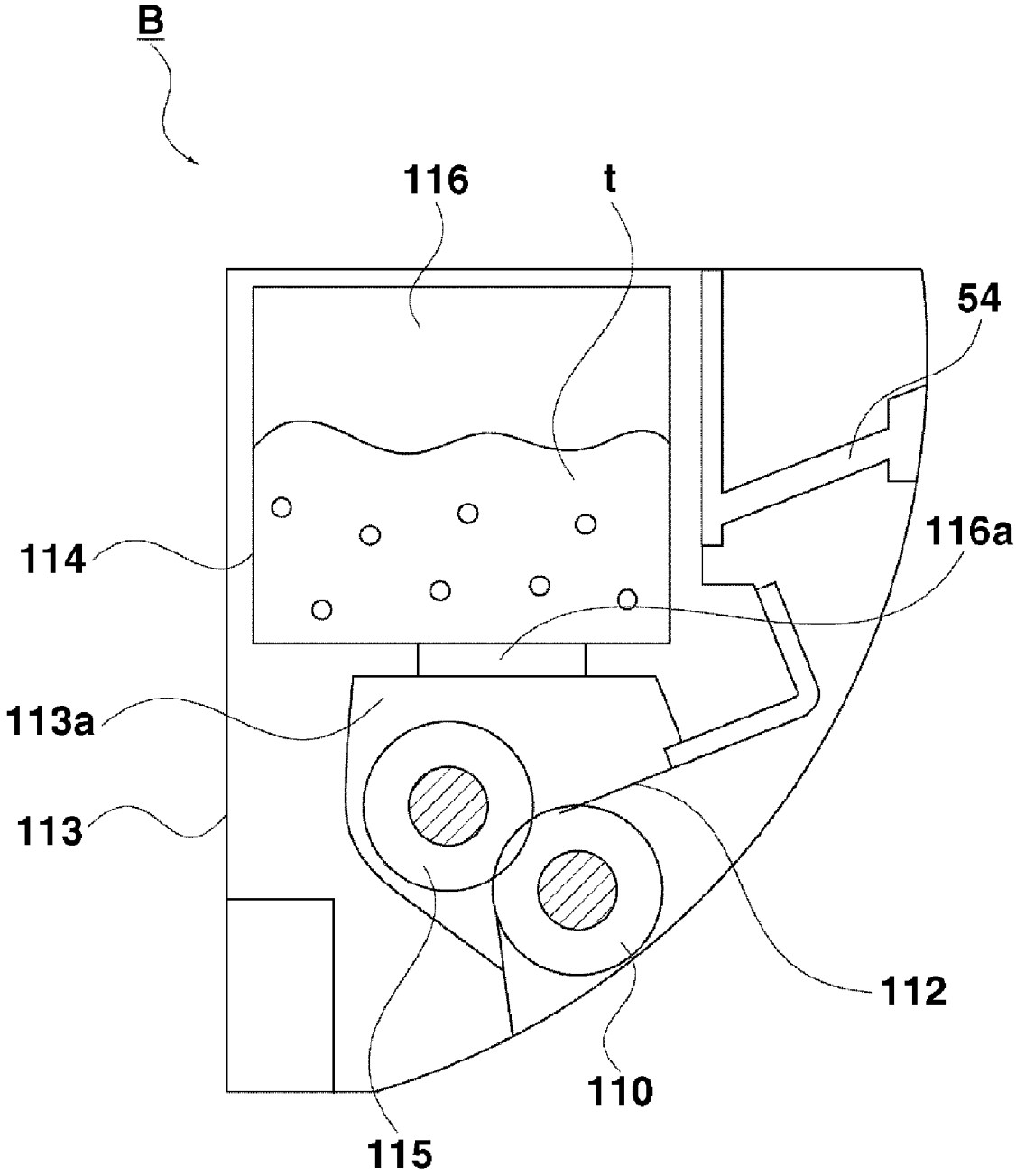
FIG. 1 is a cross-sectional side view illustrating of a development device according to an exemplary embodiment of the present invention.
Figure 2:
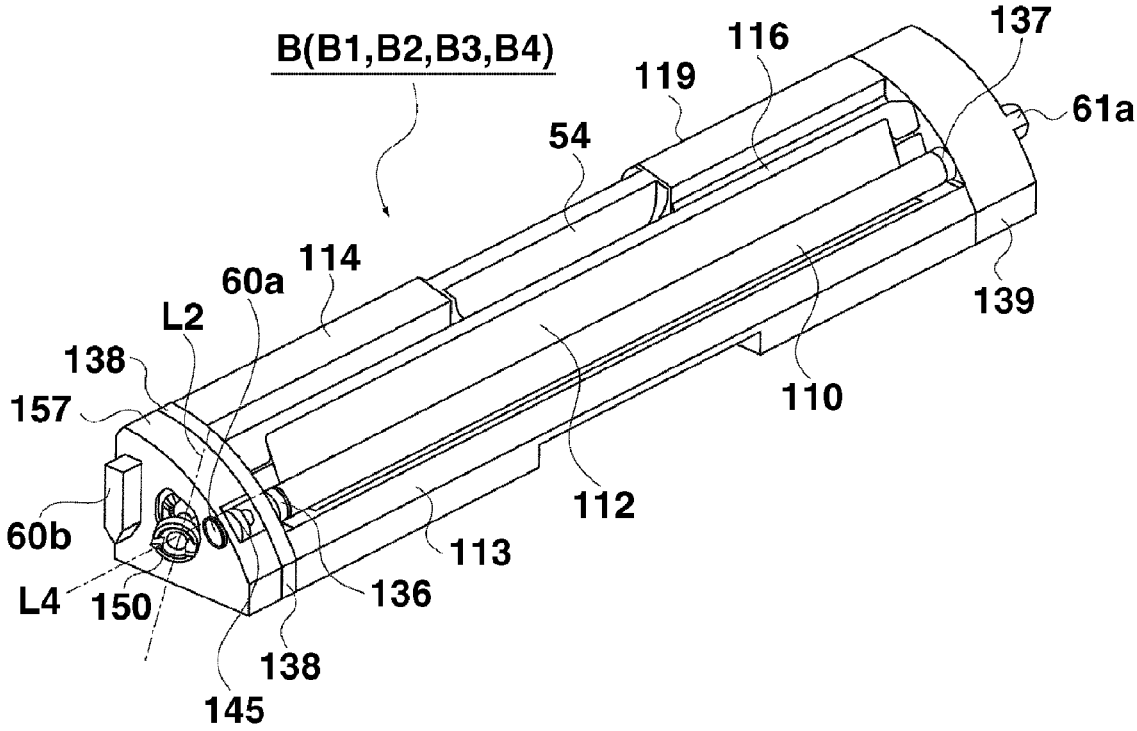
FIG. 2 is a perspective view illustrating the development device according to an exemplary embodiment of the present invention.
Figure 3:
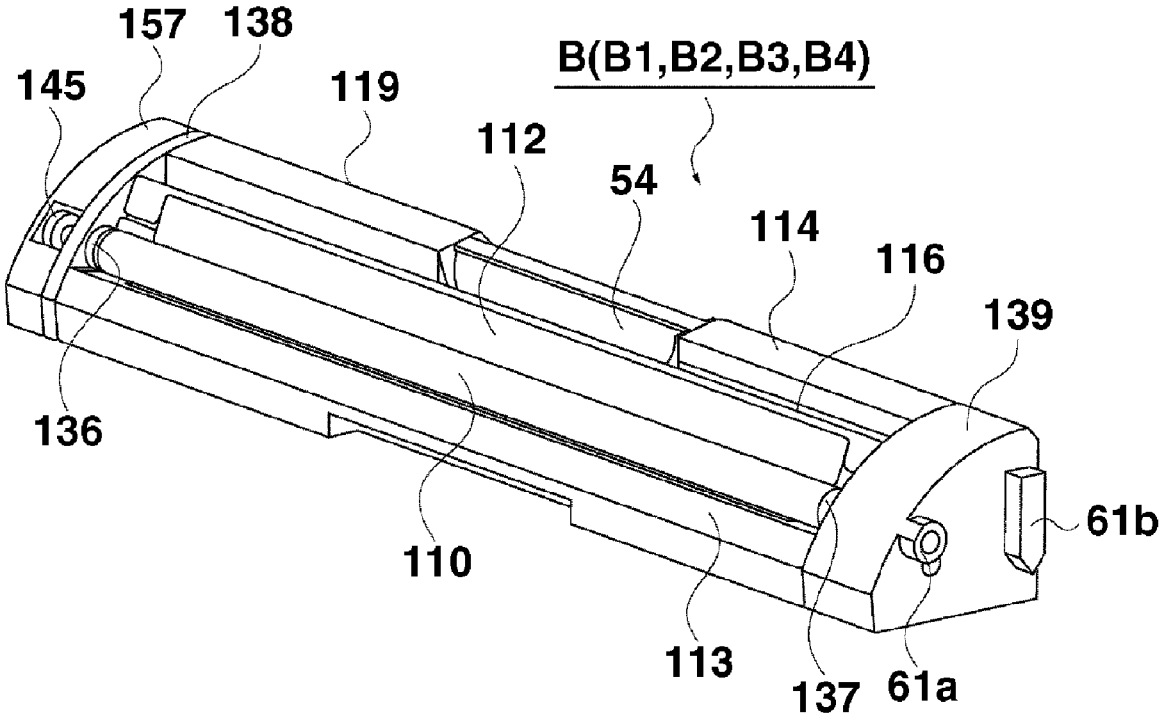
FIG. 3 is a perspective view illustrating the development device according to an exemplary embodiment of the present invention.
Figure 4:
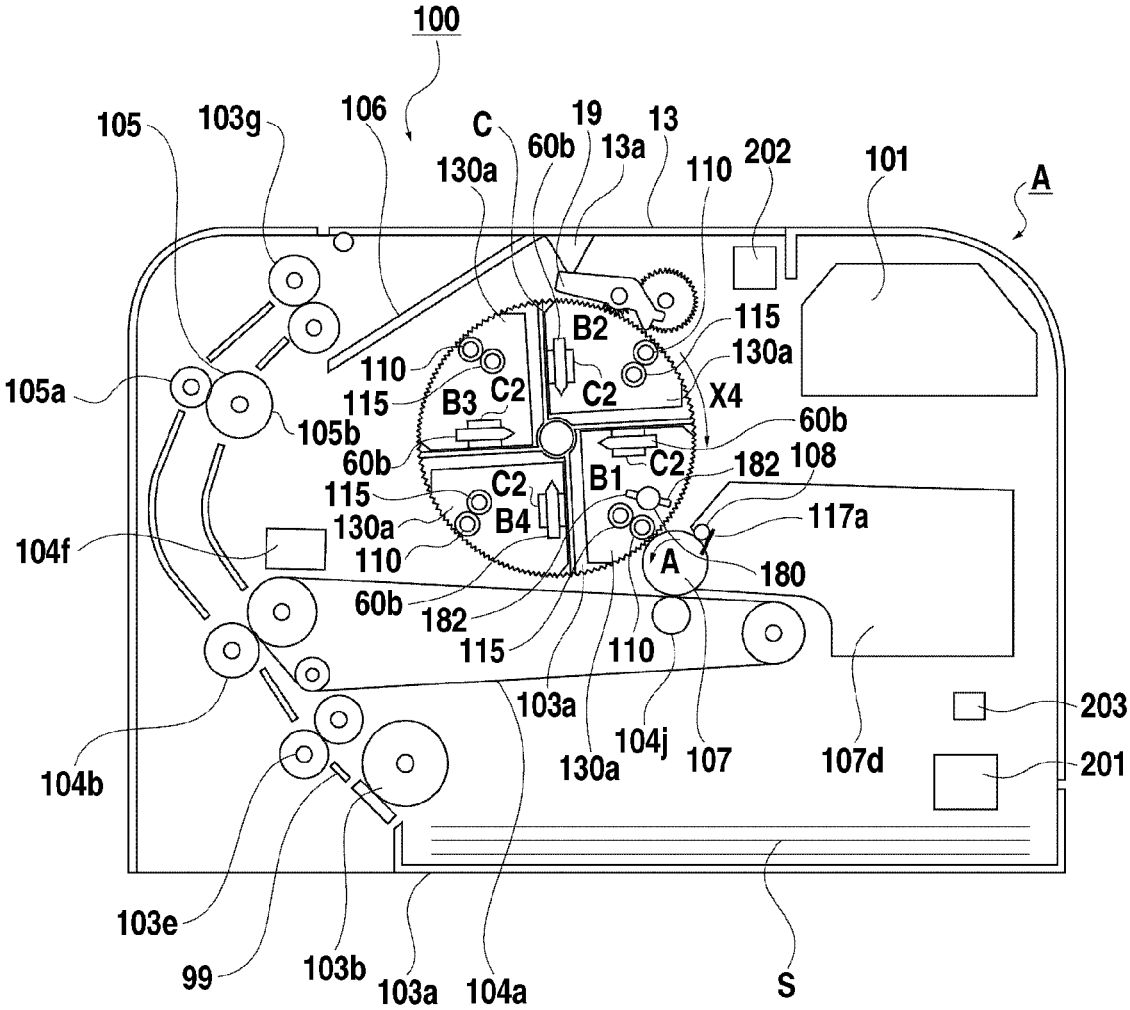
FIG. 4 is a cross-sectional side view illustrating an electrophotographic image forming apparatus body according to an exemplary embodiment of the present invention.

First, a development cartridge (hereinafter, referred to as a "cartridge") B serving as a development device according to a first exemplary embodiment of the present invention is described below with reference to FIG. 1 through FIG. 4. FIG. 1 is a cross-sectional view illustrating the cartridge B. FIG. 2 and FIG. 3 are perspective views illustrating the cartridge B. Further, FIG. 4 is a cross-sectional view illustrating a main body (hereinafter, referred to as an "apparatus body") A of a color electrophotographic image forming apparatus 100.

A rotary C is an example of a movable member according to the present exemplary embodiment.

Users can attach the cartridge B to the rotary C provided in the apparatus body A and can detach cartridge B from the rotary C.

Further, the apparatus body A and the cartridge B cooperatively constitute the electrophotographic image forming apparatus 100.

As illustrated in FIGS. 1 to 3, the cartridge B includes a development roller 110 that serves as a carrying member of a developer "t." The development roller 110 rotates during a development operation when it receives a rotational force (described below) via a coupling mechanism from the apparatus body A.

A developer containing frame body 114 contains the developer "t" of a predetermined color. More specifically, the frame body 114 includes a developer container 116 that contains the developer "t." In a development chamber 113*a*, the developer "t" can be supplied to a surface of the development roller 110 while a sponge-like developer supply roller 115 rotates.

When electric charges are given to the developer "t" due to frictional engagement between a thin-plate development blade 112 and the development roller 110, the developer "t" forms a thin layer. The thin layered developer "t" on the development roller 110 (i.e., the developer "t" adhering to the cylindrical surface of the development roller 110) can be conveyed to a development position according to the rotation of the development roller 110.

Then, a predetermined development bias is applied to the development roller 110. Thus, the development roller 110 can develop an electrostatic latent image (i.e., an electrostatic image) formed an electrophotographic photosensitive drum (hereinafter, referred to as a "photosensitive drum") 107. More specifically, the development roller 110 develops the electrostatic latent image with the developer "t."

The developer "t" contained in the container 116 can be supplied to the development chamber 113*a* via a supply aperture 116*a*. In an initial condition, the aperture 116*a* is sealed with a seal member (not illustrated). A user can remove the seal member off the aperture 116*a* to open the aperture 116*a* before the cartridge B is initially used. Thus, the developer "t" stored in the container 116 can be supplied into the development chamber 113*a*.

Further, if there is any developer remaining on the surface of the development roller 110 after the development of the electrostatic latent image is completed, the developer supply roller 115 scrapes the unused developer off the surface of the development roller 110. Meanwhile, the developer supply roller 115 supplies new developer "t" onto the surface of the development roller 110. Thus, the development operation can be continuously performed.

The cartridge B includes a development unit 119. Further, the development unit 119 includes a development frame body 113 and the developer containing frame body 114. Further, the development unit 119 includes the development roller 110, a development blade 112, the developer supply roller 115, the development chamber 113*a*, and the developer containing frame body 114.

The development roller 110 includes an axial portion 110*b* and a rubber portion (elastic member) 110*a*. The axial portion 110*b* includes axial end portions 110*b*1 and 110*b*2 provided at both ends thereof. The axial end portions 110*b*1 and 110*b*2 are supported by the development frame body 113 via bearings (not illustrated) and rotatable around a rotational axis line L1 (see FIGS. 5A and 5B). Further, nip width regulation members 136 and 137 cooperatively regulate the nip width between the photosensitive drum 107 and the rubber portion 110*a* to be a constant value in a state where the development roller 110 contacts the photosensitive drum 107.

Users can attach the cartridge B to a cartridge accommodation portion 130*a* of the rotary C provided in the apparatus body A (see FIG. 4). More specifically, the rotary C holds the cartridge B. In this case, as described below, the rotary C positions the cartridge B in an opposed confronting relationship with a predetermined position (photosensitive drum opposing portion). In the positioning operation, an apparatus body side engaging portion (a drive shaft 180 and/or a rotational force giving portion 182), which serves as a second driving force transmission member provided on the apparatus body A, is engaged with a rotational force transmitting member 150, which serves as a driving force receiving member of the cartridge B.

The development roller 110, which receives a rotational force from the apparatus body A, can rotate around the rotational axis line L1. Subsequently, if the rotary C further rotates, the rotational force transmitting member 150 disengages from the apparatus body side engaging portion. In this case, the cartridge B (the development roller 110) moves in a direction substantially perpendicular to a rotational axis line L3 of the drive shaft 180 (see FIGS. 11A to 11D) according to a one-directional movement of the rotary C in a state where the cartridge B is attached to the accommodation portion 130*a*.

The development frame body 113 and the developer containing frame body 114 cooperatively constitute a frame body of the cartridge B.

Hereinafter, example operations of the color electrophotographic image forming apparatus 100 using the cartridge B are described below with reference to FIG. 4. In the following description, an example of the color electrophotographic image forming apparatus 100 is a color laser beam printer.

As illustrated in FIG. 4, a plurality of cartridges B (B1, B2, B3, and B4) that are different in color of the developer "t" (toner) contained therein is attached to the rotary C. Users can attach and detach the cartridge B to and from the rotary C. When a motor (not illustrated) generates a rotational force to rotate the rotary C, the cartridge B containing a predetermined color developer is brought into an opposed confronting relationship with the photosensitive drum 107. In this case, the image forming apparatus 100 controls the rotational speed of the rotary C according to a rotary drive sequence. The rotary drive sequence indicates a temporal change in the rotational speed of the rotary C, as described below.

Then, the development roller 110 provided in the cartridge B develops an electrostatic latent image formed on the photosensitive drum 107. The image forming apparatus 100 transfers the developed toner image to a transfer belt 104*a*. The image forming apparatus 100 repetitively performs the above-described development and transfer operation for each of respective colors to obtain a composite color image, as described below in more detail. In the present exemplary embodiment, a recording medium S is a sheet of paper, an OHP sheet, or any other sheet on which an image can be formed.

As illustrated in FIG. 4, an exposure unit 101 irradiates the photosensitive drum 107 with light based on image information. With the light emission, an electrostatic latent image can be formed on the photosensitive drum 107. Then, the development roller 110 develops the latent image with a developer. More specifically, a developer image is formed on the photosensitive drum 107. The developer image formed on the photosensitive drum 107 is transferred to the intermediate transfer belt 104*a* (i.e., an intermediate transfer member).

Next, the developer image transferred on the intermediate transfer belt 104*a* (i.e., the intermediate transfer member) is further transferred to the recording medium S by a secondary transfer roller 104*b* that serves as a second transfer unit. Then, the image forming apparatus 100 conveys the recording medium S on which the developer image is transferred to a fixing unit 105 that includes a pressing roller 105*a* and a heating roller 105*b*. Then, the developer image transferred on the recording medium S is fixed to the recording medium S. Subsequently, the image forming apparatus 100 discharges the recording medium S to a tray 106.

An example image forming process is described below.

The image forming apparatus 100 causes the photosensitive drum 107 to rotate in the counterclockwise direction (i.e., the direction indicated by an arrow A in FIG. 4) in synchronization with rotation of the transfer belt (i.e., the intermediate transfer member) 104*a*. Then, a charging roller 108 uniformly charges a surface of the photosensitive drum 107. Subsequently, the exposure unit 101 irradiates the photosensitive drum 107 with light based on image information, for example, for a yellow image. Thus, an electrostatic latent image of a yellow color is formed on the photosensitive drum 107.

The exposure unit 101 has the following configuration. The exposure unit 101 irradiates the photosensitive drum 107 with light based on image information (i.e., an image signal including color information) read from an external apparatus (not illustrated).

In this case, a laser diode emits light according to the image information to irradiate a polygon mirror with image light. The polygon mirror, when driven by a scanner motor, rotates at a high speed. The surface of the photosensitive drum 107 is selectively exposed to the image light reflected by the polygon mirror and passing through an image-forming lens and a reflection mirror. Thus, an electrostatic latent image according to the image information is formed on the photosensitive drum 107.

The image forming apparatus 100 rotates the rotary C upon formation of the latent image. Accordingly, the yellow cartridge B1 is moved to the development position. Then, the image forming apparatus 100 applies a predetermined bias voltage to the development roller 110 of the yellow cartridge B1 to develop the latent image with a yellow developer.

Subsequently, the image forming apparatus 100 applies a bias voltage having a polarity opposed to that of the developer to a pressing roller (i.e., a primary transfer roller) 104*j* of the transfer belt 104*a* so that a yellow developer image formed on the photosensitive drum 107 can be primarily transferred to the intermediate transfer belt 104*a*.

As described above, the yellow cartridge B1 contains the developer of a yellow color and forms a yellow developer image. A magenta cartridge B2 contains a developer of a magenta color and forms a magenta developer image. A cyan cartridge B3 contains a developer of a cyan color and forms a cyan developer image. A black cartridge B4 contains a developer of a black color and forms a black developer image. All of the cartridges B1, B2, B3, and B4 are similar in configuration, although they are different in the color of the contained developer.

If the above-described primary transfer of the yellow developer image is completed, the image forming apparatus 100 further rotates the rotary C in the direction indicated by an arrow X4 illustrated in FIG. 4. Thus, the next magenta cartridge B2 is moved and brought into an opposed confronting relationship with the photosensitive drum 107. The image forming apparatus 100 repeats the following processes for each of magenta, cyan, and black colors to overlap developer images of four colors on the transfer belt 104*a*.

In this case, the secondary transfer roller 104*b* is separated from the transfer belt 104*a*. Further, a cleaning charge roller 104*f* is separated from the transfer belt 104*a*.

Then, after the developer images of four colors are formed on the transfer belt 104*a*, the secondary transfer roller 104*b* is pressed against the transfer belt 104*a* (see FIG. 4). Further, in synchronization with the pressing of the transfer roller 104*b*, the recording medium S positioned in the vicinity of a registration roller pair 103*e* is sent out toward the nip portion between the transfer belt 104*a* and the transfer roller 104*b*. At the same time, a feeding roller 103*b* operable as a conveyance unit 103 conveys the next recording medium S from a cassette 103*a*.

A sensor (not illustrated) is disposed on the upstream side of the registration roller pair 103*e*. The sensor detects a front end of the recording medium S to stop the rotation of the registration roller pair 103*e* when the recording medium S reaches a predetermined position.

Further, the image forming apparatus 100 applies a bias voltage having a polarity opposed to that of the developer to the transfer roller 104*b*. Therefore, all of the developer image on the transfer belt 104*a* can be secondarily transferred to the recording medium S having been conveyed.

The image forming apparatus 100 conveys the recording medium S, on which the developer image has been transferred, to the fixing unit 105. The fixing unit 105 fixes the developer image on the recording medium S. Then, a discharge roller pair 103*g* discharges the recording medium S with the fixed image to the discharge tray 106 on the apparatus body. Thus, the image forming apparatus 100 completes the image formation on the recording medium S.

Meanwhile, after the secondary transfer operation is completed, the image forming apparatus 100 presses the cleaning charge roller 104*f* against the transfer belt 104*a*. Thus, a predetermined bias voltage is applied to the developer remaining on the surface of the belt 104*a*. Then, remaining charges are removed.

The remaining developer is again transferred electrostatically to the photosensitive drum 107 from the belt 104*a* via a primary transfer nip portion. Thus, the surface of the belt 104*a* is cleaned. A cleaning blade 117*a*, which constantly contacts the photosensitive drum 107, removes the secondarily transferred developer (i.e., the residual developer transferred again) from the photosensitive drum 107. The removed developer is collected into a removed developer box 107*d* via a conveyance path (not illustrated).

Figure 6:
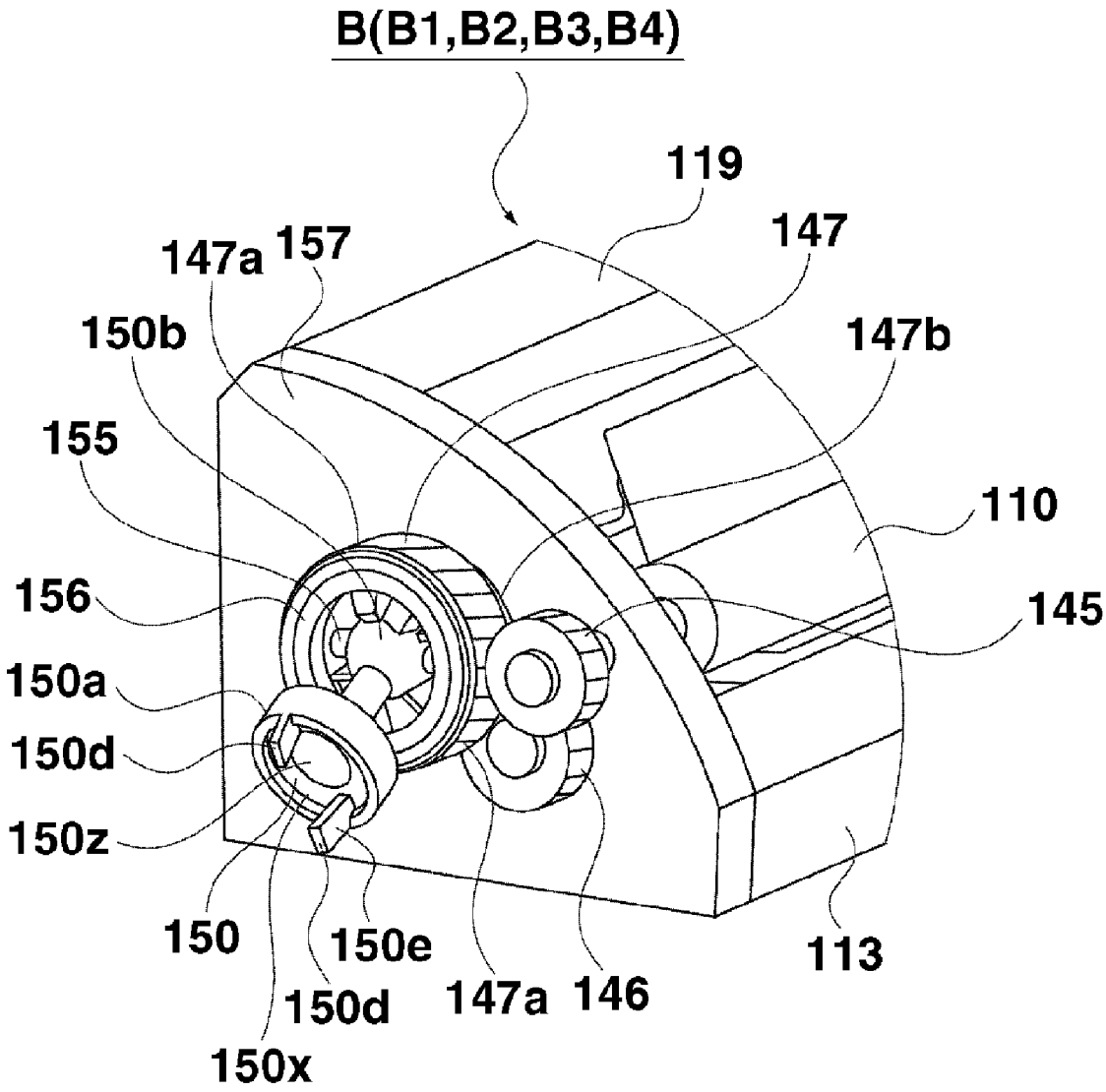
FIG. 6 is a perspective view illustrating a rotational force transmitting member according to an exemplary embodiment of the present invention.

In FIG. 6, a development gear 145 is coaxially fixed to an upper end of the development roller 110 and a developer supply gear 146 is coaxially fixed to an upper end of the supply roller 115 (see FIG. 1). Both the development gear 145 and the developer supply gear 146 mesh with a driving force transmission member (hereinafter, referred to as "drive input gear") 147.

Thus, when the rotational force transmitting member (hereinafter, referred to as a "coupling") 150, which is operable as the driving force receiving member, receives a rotational force from the apparatus body A, the rotational force is transmitted to the development roller 110 via the development gear 145 and to the developer supply roller 115 via the developer supply gear 146.

The rotational force from the apparatus body A, which is received by the coupling 150 serving as the coupling member, may be transmitted to any rotational member other than the development roller 110 and the developer supply roller 115.

Next, the drive input gear 147 associated with the coupling 150 is described below in more detail.

As illustrated in FIG. 6, the drive input gear 147 is rotatable and attached to the development unit 119 at a position where the drive input gear 147 can mesh with the development gear 145 and the developer supply gear 146. The drive input gear 147 includes a development gear portion (first gear portion) 147*a* and a developer supply gear portion (second gear portion) 147*b*. The first gear portion 147*a* meshes with the development gear 145. The second gear portion 147*b* meshes with the developer supply gear 146.

The coupling 150 transmits the rotational force received from the apparatus body A to the development roller 110 and the developer supply roller 115. The drive input gear 147 further includes a coupling attaching portion (coupling containing portion) 147*j* provided therein (see FIGS. 8A to 8F). The attaching portion 147*j* accommodates a drive portion 150*b* of the coupling 150. Stopper portions 147*k* (147*k*1, 147*k*2, 147*k*3, and 147*k*4) provided in the drive input gear 147 prevent the coupling 150 from moving relative to the drive input gear 147 in a direction indicated by an arrow X34 illustrated in FIG. 8F.

Figure 8A:
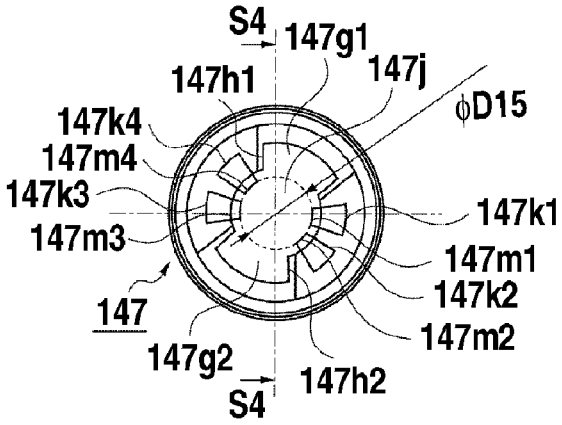
FIGS. 8A to 8F are front views and side cross-sectional views illustrating a driving force transmission member according to an exemplary embodiment of the present invention.
Figure 8B:
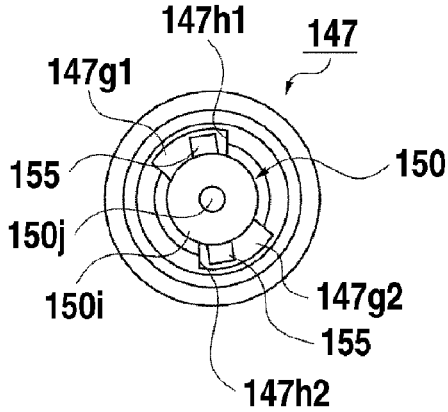
Figure 8C:
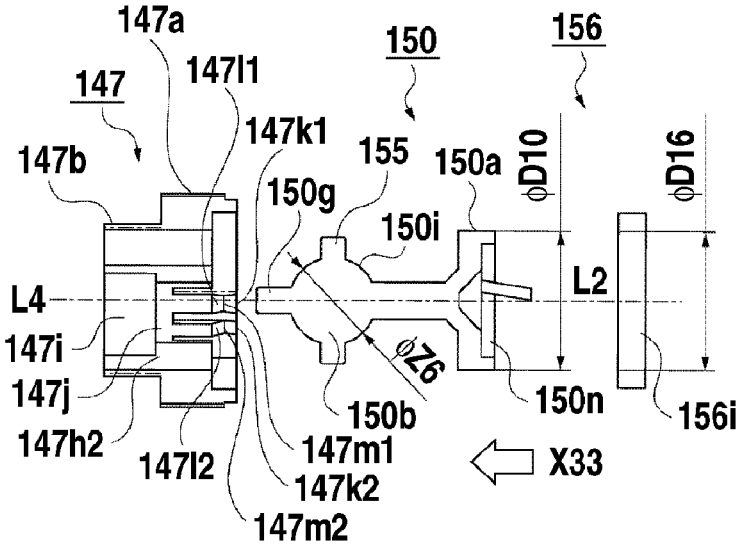
Figure 8D:
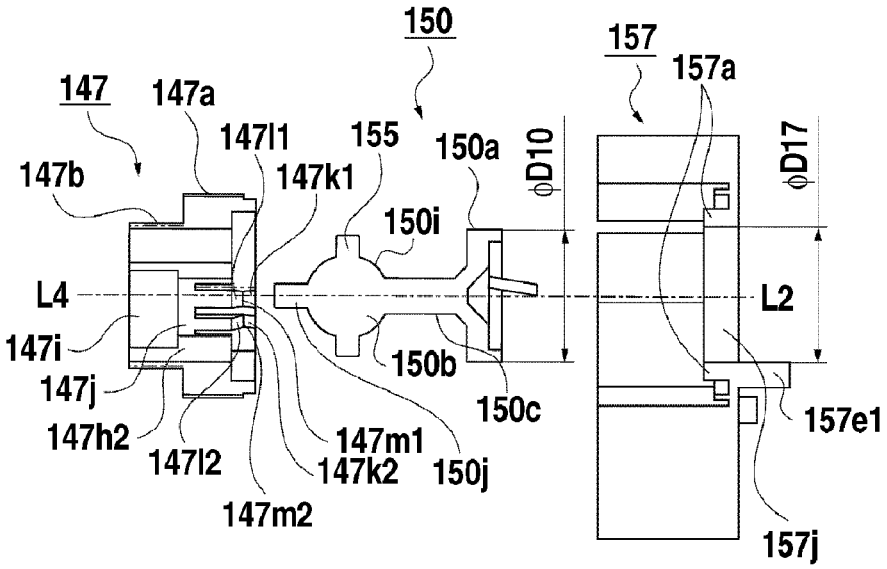

Further, the coupling 150 is attached to the attaching portion 147*j* so as to be tiltable around a rotational axis line L4 of the drive input gear 147 (see FIGS. 8C and 8D). More specifically, the coupling 150 is attached to the attaching portion 147*j* and tiltable around the axial line L4 in a state where the movement of the drive portion 150*b* in a direction of a driven portion 150*a* is restricted by the stopper portion 147*k*.

Figure 5A:
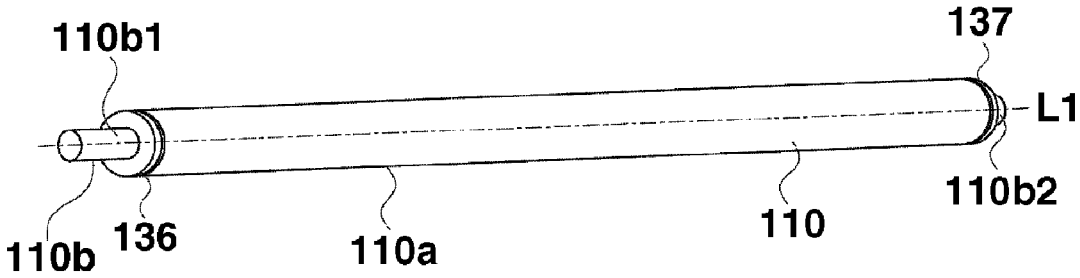
FIGS. 5A and 5B are perspective views illustrating a development roller according to an exemplary embodiment of the present invention.
Figure 5B:
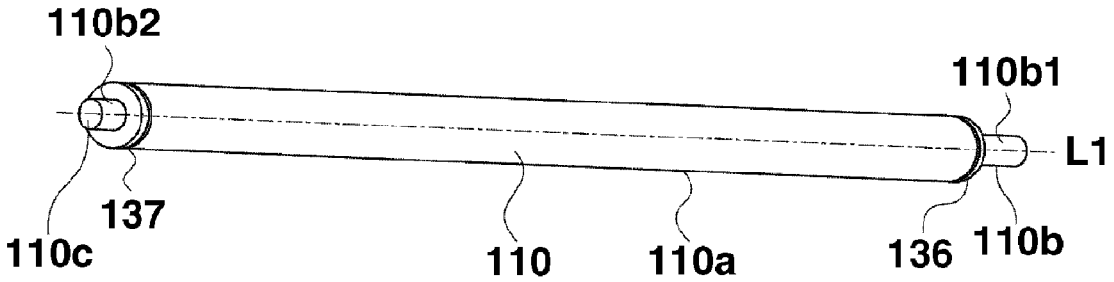

The axial line L4 is parallel to the rotational axis line L1 of the development roller 110 (see FIGS. 5A and 5B).

Further, the cartridge B includes the development frame body 113 and a support member 157. The support member 157 is attached to the development frame body 113 (see FIG. 2).

Figure 8E:
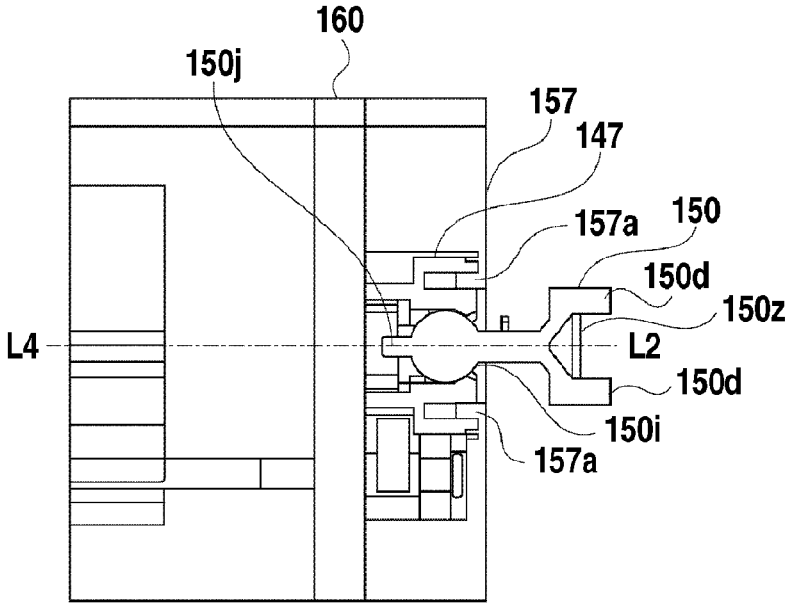

The support member 157 includes a bore 157*j*, in which a coupling stopper portion 157*a* protruding in a direction indicated by the axial line L4 is engaged with the drive input gear 147 (see FIGS. 8D and 8E).

Next, an example of coupling (coupling member) serving as the rotational force transmitting member according to an exemplary embodiment of the present invention is described below with reference to FIGS. 7A to 7G.

Figure 7A:
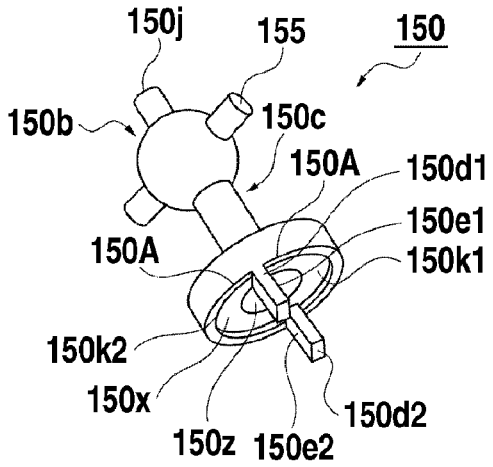
FIGS. 7A to 7G are perspective views illustrating a rotational force transmitting member according to an exemplary embodiment of the present invention.
Figure 7B:
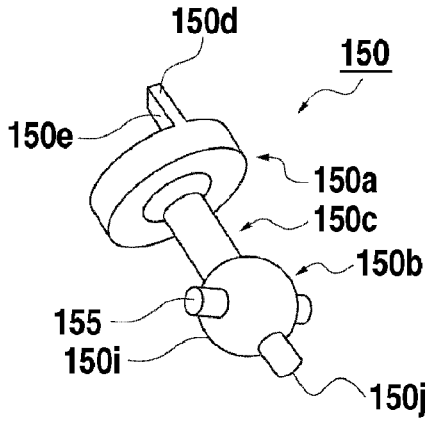
Figure 7C:
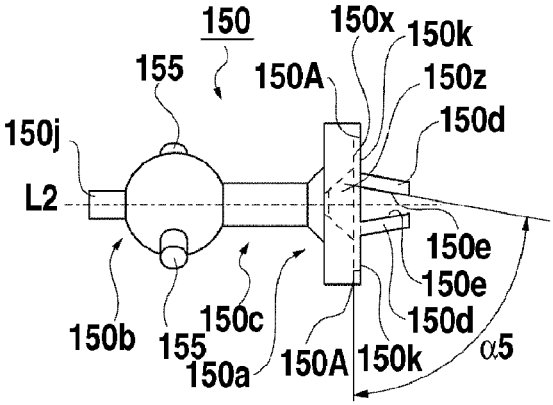
Figure 7D:
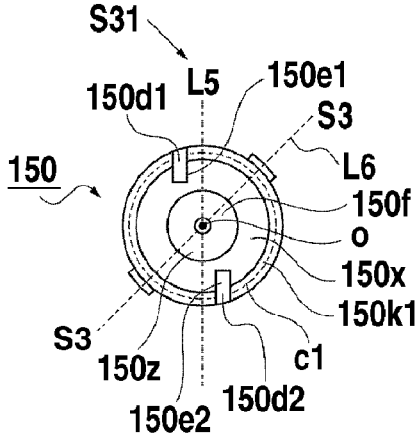
Figure 7E:
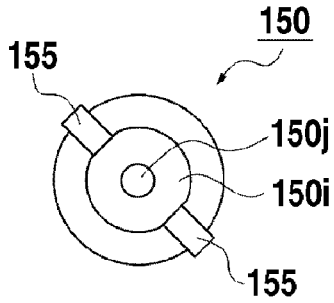
Figure 7F:
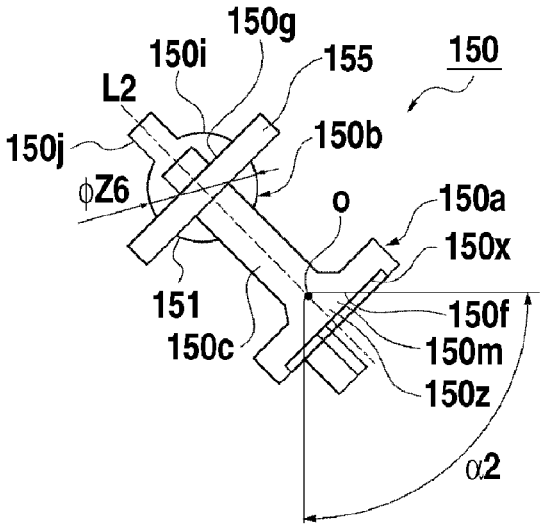
Figure 7G:
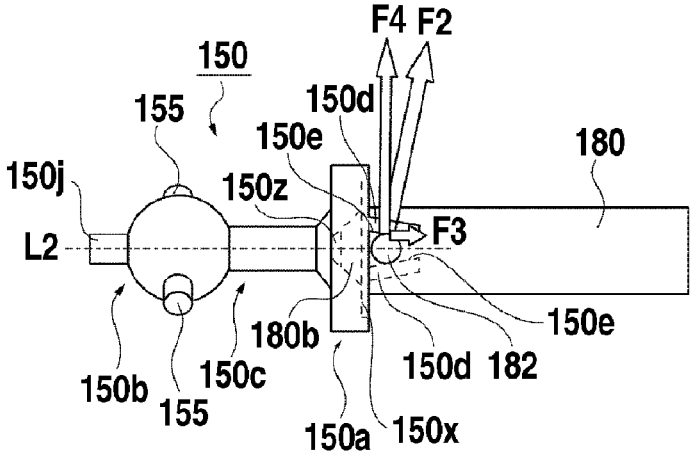

FIG. 7A is a perspective view illustrating the coupling 150, which is seen from the apparatus body side. FIG. 7B is a perspective view illustrating the coupling 150 seen from the development roller side. Further, FIG. 7C illustrates the coupling 150 seen from a direction perpendicular to the direction of a rotational axis line L2. Further, FIG. 7D is a side view illustrating the coupling 150 seen from the apparatus body side. FIG. 7E is a side view seen from a direction opposed to the direction of FIG. 7D. Further, FIG. 7F is a cross-sectional view of the coupling 150 taken along a line S3 and seen from the direction of an arrow S31 illustrated in FIG. 7D. FIG. 7G illustrates the coupling 150 engaged with the drive shaft, which is seen from a direction similar to that of FIG. 7C.

The cartridge B moves in a direction substantially perpendicular to the direction of the rotational axis line L3 of the drive shaft 180 according to the rotation of the rotary C, in a state where the cartridge B is attached to the accommodation portion 130*a*. Then, according to a one-directional rotation of the rotary C, the coupling 150 engages with the apparatus body side engaging portion (the pin 182 and/or the drive shaft 180). Further, the coupling 150 disengages from the apparatus body side engaging portion.

In the present exemplary embodiment, it is desired that the coupling 150 is a resin-made (e.g., polyacetal) product because of its rigidity, toughness, and processibility. To increase the rigidity of the coupling 150, it is useful to use a glass fiber reinforced resin if the load torque is high. Further, it is useful to use a metallic material. The material of the coupling 150 is appropriately selectable. However, in the present exemplary embodiment, the coupling 150 is a resin-made product because it is excellent in processibility.

The coupling 150 is chiefly composed of three portions. The first portion is the driven portion 150*a* that engages with the drive shaft 180 as illustrated in FIG. 7G. The driven portion 150*a* engages with the pin 182 serving as a rotational force giving portion (i.e., a body side rotational force transmitting portion) provided on the drive shaft 180 and receives a rotational force from the pin 182.

The second portion is the drive portion 150*b*. The drive portion 150*b* includes a pin (i.e., a rotational force transmitting portion) 155 engageable with the attaching portion 147*j* of the drive input gear (i.e., a rotational force receiving portion) 147 to transmit a rotational force to the gear 147.

The third portion is an intermediate portion 150*c* that connects the driven portion 150*a* to the drive portion 150*b*. The pin 182 includes two protrusions 182*a*1 and 182*a*2 protruding in a direction perpendicular to the rotational axis line L3 of the drive shaft 180 (see FIGS. 11A to 11D).

As illustrated in FIG. 7F, the driven portion 150*a* includes a drive shaft insertion aperture portion 150*m* that expands outward along the rotational axis line L2 of the coupling 150. Further, the drive portion 150*b* includes a spherical portion 150*i*, the pin 155, and a coupling regulated portion 150*j*. The regulated portion 150*j* extends along a line coaxial with the axial line L2 and engages with a regulated portion accommodating portion 160*b* (see FIGS. 12A to 12D). Thus, the regulated portion 150*j* can regulate the tilt direction of the axial line L2.

The aperture portion 150*m* includes a conical drive bearing surface 150*f* expanding toward the drive shaft 180 (i.e., toward the side opposite to the side where the drive input gear 147 is provided). The drive bearing surface 150*f* forms a recess 150*z* as illustrated in FIG. 7F. The recess 150*z* includes the aperture portion 150*m* on the side opposite to the side where the drive input gear 147 is provided in the direction of the axial line L2.

Figure 20A:
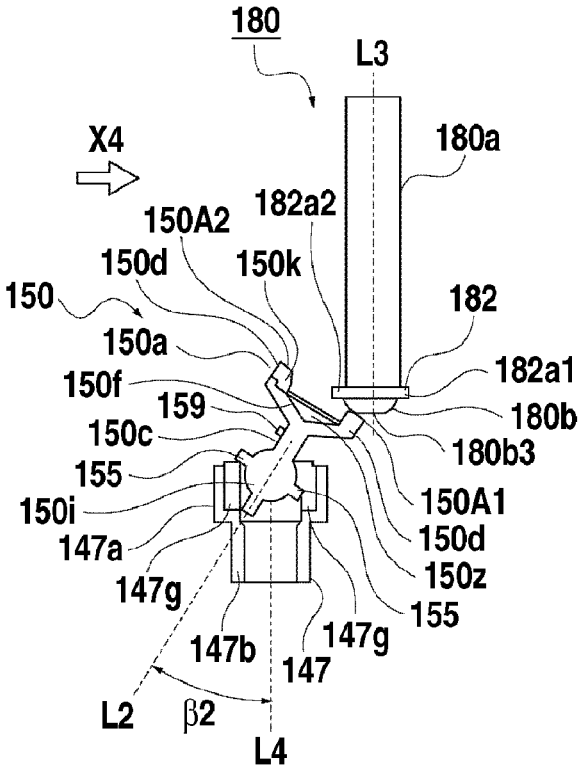
FIGS. 20A to 20D are vertical cross-sectional views illustrating an engagement state of a drive shaft and the rotational force transmitting member according to an exemplary embodiment of the present invention.
Figure 20B:
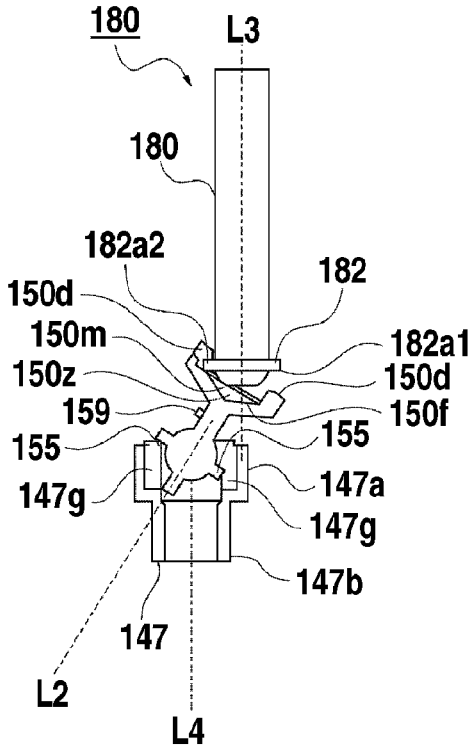

Thus, irrespective of the rotational phase of the development roller 110 in the cartridge B, the coupling 150 can move (incline) relative to the rotational axis line L3 of the drive shaft 180 without being stopped by a front end portion 180*b* of the drive shaft 180. More specifically, the coupling 150 can move (incline) between a pre-engagement angular position (i.e., the position illustrated in FIG. 20A), a rotational force transmitting angular position (i.e., the position illustrated in FIG. 20D), and a separating angular position (i.e., the position illustrated in FIG. 23C or 23D).

Two protrusions (protruding portions) (engaging portions) 150*d* (150*d*1 and 150*d*2) are symmetrically disposed on a circle whose center coincides with the axial line L2 at equal intervals with respect to the axial line L2, on an end surface of the circular recess 150*z*. Ingressive portions 150*k* (150*k*1 and 150*k*2) are provided between the protrusions 150*d*.

The ingressive portions 150*k* (150*k*1 and 150*k*2) are greater than the outer diameter of the pin 182 so that the pin 182 provided on the drive shaft 180 can be positioned. The pin 182 is the rotational force giving portion. Between the protrusions 150*d*, when a rotational force is transmitted from the drive shaft 180 to the coupling 150, the pin 182 is positioned the ingressive portions 150*k*1 and 150*k*2.

Further, as illustrated in FIG. 7D, a rotational force receiving surface (i.e., a rotational force receiving portion) 150*e* (150*e*1 and 150*e*2) is provided on the downstream side of each protrusion 150*d* in the clockwise direction. The rotational force receiving surface 150*e* is intersectional to the rotational direction of the coupling 150.

More specifically, the receiving surface 150*e*1 is provided on the protrusion 150*d*1. The receiving surface 150*e*2 is provided on the protrusion 150*d*2. When the drive shaft 180 is in a rotating state, the pins 182*a*1 and 182*a*2 contact any one of their receiving surfaces 150*e*. The coupling 150 rotates around the axial line L2.

In the present exemplary embodiment, the protrusions 150*d* (i.e., the rotational force receiving surfaces 150*e*) are positioned on a virtual circle whose center coincides with the axial line L2 and disposed in a mutually opposed relationship. Accordingly, the force from the drive shaft 180 can be uniformly transmitted to the coupling 150. The coupling 150 can rotate stably and accurately.

Further, in the present exemplary embodiment, only two protrusions 150*d* (i.e., the rotational force receiving surfaces 150*e*) are provided. Therefore, the clearance between two ingressive portions 150*k* can be kept wide. The pin 182 can smoothly enter the ingressive portion 150*k*. The rotational force receiving surface 150*e* can surely contact the pin 182.

The drive bearing surface 150*f*, as illustrated in FIG. 7F, has a conical shape having a front end angle $\alpha$2 (i.e., forming an angle $\alpha$2/2 with respect to the axial line L2). Therefore, when the coupling 150 engages with the drive shaft 180 and the coupling 150 is in the rotational force transmitting angular position, the front end 180*b* (see FIGS. 20A to 20D) of the drive shaft 180 contacts the drive bearing surface 150*f*.

Figure 22:
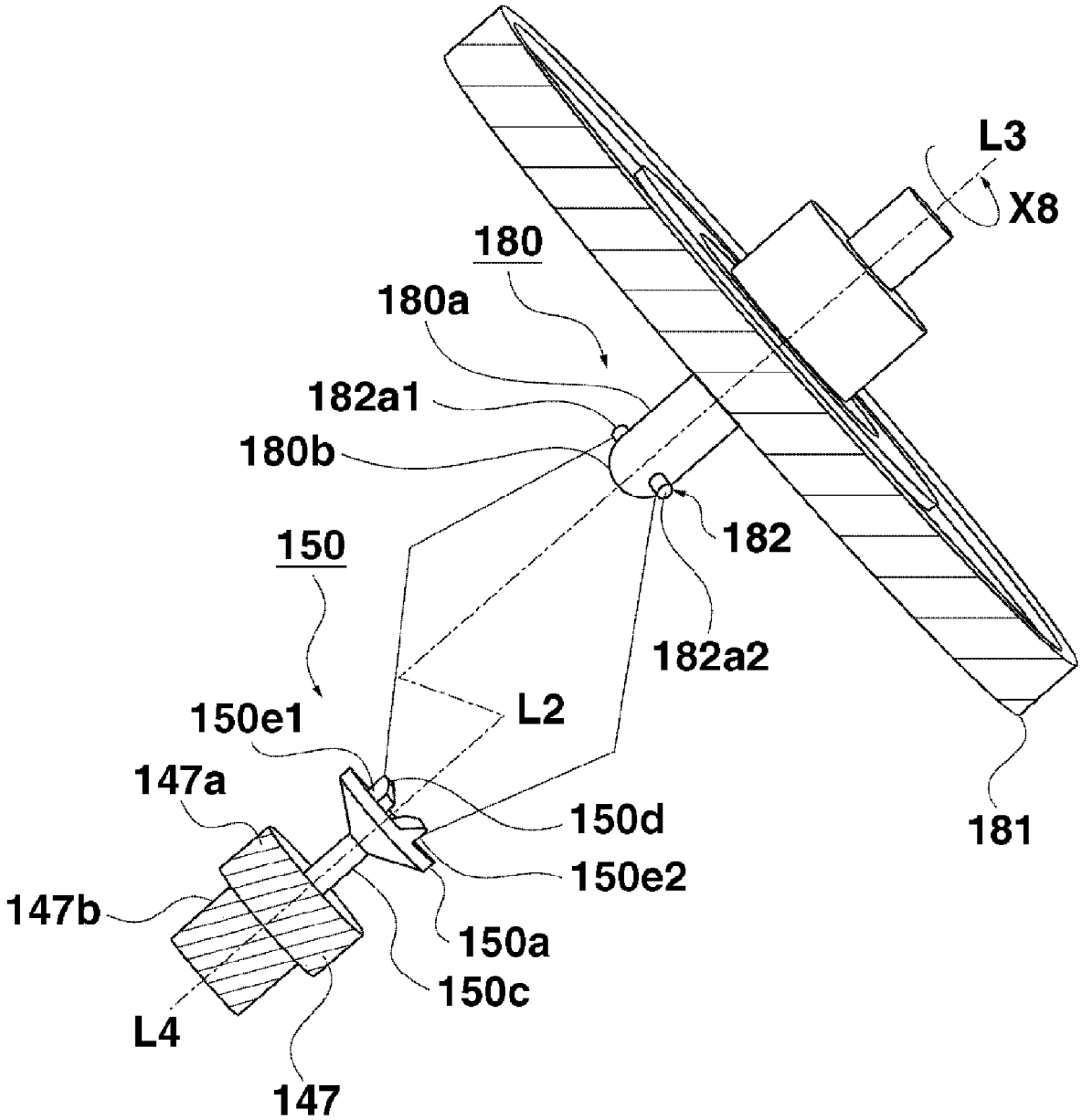
FIG. 22 is a perspective view illustrating the drive shaft and the rotational force transmitting member according to an exemplary embodiment of the present invention.

Further, the axis of the conical shape (i.e., the axial line L2 of the coupling 150) is substantially coaxial with the axial line L3 of the drive shaft 180 (see FIG. 22). Thus, the centers of the coupling 150 and the drive shaft 180 can be adjusted and the rotational torque transmitted to the coupling 150 can be stabilized. In the present exemplary embodiment, the front end angle $\alpha$2 is in a range from 60° to 150°. The aperture portion 150*m* has a flat portion 150*x* (see FIG. 7A or FIG. 7D) whose area is variable, e.g., wide (see FIG. 8C) or narrow, depending on the angle $\alpha$2.

Further, it is desired that the rotational force receiving surface 150*e* is disposed along a virtual circle C1 whose center coincides with the axial line L2 (see FIG. 7D). This is useful in that the rotational force transmission radius becomes constant and the transmitted rotational torque can be stabilized.

Further, it is desired that the protrusions 150*d* can stabilize the position of the coupling 150 in a force receiving state of the coupling 150. Therefore, in the present exemplary embodiment, two rotational force receiving surfaces 150*e* are disposed in an opposed relationship at angular intervals of 180°.

Further, in the present exemplary embodiment, a constant angle $\alpha$5 (e.g., $90° > \alpha 5 > 0°$) is formed between the rotational force receiving surface 150*e* and the flat portion 150*x* (see FIG. 7C). As illustrated in FIG. 7G, if the rotational force receiving surface 150*e* receives a driving force F2 from the pin 182, a component force F3 variable depending on the angle $\alpha$ acts on the coupling 150 in the direction of the axial line L2.

The coupling 150, when the component force F3 is applied, is pulled toward the drive shaft 180. More specifically, the coupling 150 moves in the direction of the drive shaft 180. Therefore, the recess 150*z* can easily engage with the front end portion 180*b* of the drive shaft 180. In other words, the coupling 150 can surely engage with the drive shaft 180. In the present exemplary embodiment, the constant angle $\alpha$5 is approximately 10°.

In the present exemplary embodiment, the diameter of the pin 182 is approximately 2 mm. In this case, the circumferential length of the ingressive portion 150*k* is approximately 8 mm. The circumferential length of the ingressive portion 150*k* is an interval between neighboring protrusions 150*d* along the virtual circle. However, the circumferential length of the ingressive portion 150*k* is not limited to the above-described example. As described above, when the circumferential length of the ingressive portion 150*k* is sufficient large compared to the diameter of the pin 182, the pin 182 can easily enter the ingressive portion 150*k*.

Further, the rotary C (the accommodation portion 130*a*) rotates in a state where the cartridge B is attached to the rotary C. While the rotary C rotates, the coupling 150 engages with the drive shaft 180. Then, the rotational force receiving surface 150*e* engages with the pin 182. The rotational force receiving surface 150*e* is pushed by the pin 182 that receives a force from the rotating drive shaft 180.

Thus, the rotational force receiving surface 150*e* receives a rotational force from the drive shaft 180. The rotary C further rotates until the development roller 110 of a desired cartridge B reaches the development position where the desired cartridge B faces the photosensitive drum 107. Then, the rotation of the rotary C is stopped. Further, the paired receiving surfaces 150*e* are positioned at the same distance from the axial line L2 and disposed in an opposed relationship with each other. In each protrusion 150*d*, the receiving surface 150*e* is provided on a surface extending in the intersecting direction.

Further, the ingressive portion (hollow) 150*k* is hollowed along the rotational direction and in the direction of the axial line L2. The ingressive portion 150*k* is provided between the protrusion 150*d*1 and the protrusion 150*d*2. When the drive shaft 180 is in a stopped state, if the coupling 150 engages with the apparatus body side engaging portion in a state where the cartridge B is attached to the rotary C, the pin 182 enters the ingressive portion 150*k*.

Then, the pin 182 of the rotating drive shaft 180 pushes the receiving surface 150*e*. Alternatively, when the coupling 150 engages with the apparatus body side engaging portion, if the apparatus body side engaging portion is already rotating, the pin 182 enters the ingressive portion 150*k* and pushes receiving surface 150*e*. Thus, the coupling 150 can rotate.

In the present exemplary embodiment, the rotational force receiving surface (i.e., the rotational force receiving portion) 150*e* can be disposed inside the drive bearing surface 150*f*. Alternatively, the receiving surface 150*e* can be located at a portion protruding outward from the drive bearing surface 150*f* in the direction of the axial line L2. When the receiving surface 150*e* is located inside the drive bearing surface 150*f*, the ingressive portion 150*k* is also located inside the drive bearing surface 150*f*.

More specifically, the ingressive portion 150*k* is a hollow located inside an annular portion of the drive bearing surface 150*f* and positioned between the protrusions 150*d*. Further, when the receiving surface 150*e* is located at the portion protruding outward from the drive bearing surface 150*f*, the ingressive portion 150*k* is a hollow positioned between the protrusions 150*d*.

In the present exemplary embodiment, the hollow is a through bore extending in the direction of the axial line L2 or can be a closed-end bore having a bottom surface. More specifically, the hollow can be any space positioned between the protrusions 150*d* if the pin 182 can enter and the drive bearing surface 150*f* can contact the front end portion 180*b* of the drive shaft 180 in a state where the cartridge B is attached to the rotary C.

The drive portion 150*b* includes a spherical surface portion so that the drive portion 150*b* can move between the rotational force transmitting angular position and the pre-engagement angular position (or the separating angular position) relative to the axial line L4 of the drive input gear 147 (see FIG. 10B1), irrespective of the rotational phase of the drive input gear 147 in the cartridge B.

The rotational force transmitting angular position is a first angular position. The pre-engagement angular position is a second angular position. Further, the separating angular position is a third angular position. According to the illustrated example, the drive portion 150*b* includes the spherical stopper portion 150*i* whose axial line coincides with the axial line L2.

A fixing bore 150*g*, which receives the transmission pin 155, is provided at a position passing through the center of the drive portion 150*b*. Further, the columnar coupling regulated portion 150*j* whose axial line coincides with the axial line L2 is provided on the opposite side of the spherical portion of the drive portion 150*b* relative to the intermediate portion 150*c*. The regulated portion 150*j* engages with the regulated portion accommodating portion 160*b* (see FIGS. 12A to 12D) and regulates the tilt direction of the axial line L2 of the coupling 150 as described below in more detail.

In the present exemplary embodiment, the coupling 150 is a single part. However, the coupling 150 can be composed of a plurality of separate members (e.g., the driven portion 150*a*, the intermediate portion 150*c*, and the drive portion 150*b*), which are integrally assembled and operable as a united body.

Further, in a state where the cartridge B is attached to the apparatus body A, when the protrusion 150*d* receives a rotational force from the drive shaft 180, the pin 155 of the coupling 150 transmits the rotational force to the development roller 110.

More specifically, as illustrated in FIG. 8B, the pin 155 engages with a rotational force receiving surface (i.e., a rotational force receiving portion) 147*h* (147*h*1 and 147*h*2) of the drive input gear 147 to transmit the rotational force. Thus, the drive input gear 147 can rotate around its rotational shaft and transmit the rotational force to the development roller 110 via the first gear portion 147*a* of the drive input gear 147. Further, the drive input gear 147 transmits the rotational force to the developer supply roller 115 via the second gear portion 147*b* of the drive input gear 147.

Next, the drive input gear 147 supporting the coupling 150 is described in more detail with reference to FIGS. 8A to 8F.

Apertures 147*g*1 and 147*g*2 illustrated in FIG. 8A are grooves extending along the direction of a rotational axis of the drive input gear 147. When the coupling 150 is attached, the rotational force transmission pin (i.e., the rotational force transmitting portion) (protruding portion) 155 enters the apertures 147*g*1 and 147*g*2.

The transmission pin 155 moves in the apertures 147*g*1 and 147*g*2. Thus, regardless of the rotational phase of the drive input gear 147 in the cartridge B, the coupling 150 is movable between the rotational force transmitting angular position and pre-engagement angular position (or the separating angular position).

Further, as illustrated in FIG. 8A, the rotational force receiving surface (i.e., the rotational force receiving portion) 147*h* (147*h*1 and 147*h*2) is provided on the upstream side of the aperture 147 (147*g*1 and 147*g*2) in the clockwise direction. A side surface of the transmission pin (i.e., the rotational force transmitting portion) 155 of the coupling 150 contacts the rotational force receiving surface 147*h*. Thus, the rotational force can be transmitted to the development roller 110.

The rotational force receiving surfaces 147*h*1 and 147*h*2 are intersectional with the rotational direction of the drive input gear 147. Thus, the rotational force receiving surface 147*h* (147*h*1 and 147*h*2) is pushed by the side surface of the transmission pin 155 and rotates around the rotational axis line L4 (see FIG. 8C). The axial line L4 represents the rotational axis line of the drive input gear 147.

Further, there is a clearance between the coupling 150 and the rotational force receiving surface (i.e., the rotational force receiving portion) 147*h* that engages with the pin (i.e., the rotational force transmitting portion) 155 so that the coupling 150 can tilt in all directions relative to the axial line L4, as described below (see FIG. 8B).

FIG. 8C is a cross-sectional view illustrating a process of fixing the coupling 150 to the drive input gear 147.

The fixing process includes moving the coupling 150 in a direction indicted by an arrow X33 and inserting the transmission portion 150*b* in the attaching portion 147*j*. In a state where the transmission portion 150*b* is not yet inserted in the attaching portion 147*j*, a diameter ϕZ6 of the stopper portion (i.e., the spherical portion) 150*i* is greater than a diameter ϕD15 (see FIG. 8A) of a circle configured by an internal ridgeline 147*m* (147 ml to 147*m*4) of the stopper portion 147*k*. More specifically, a relationship Z6>D15 is established.

During the insertion of the transmission portion 150*b*, the stopper portion 147*k* (147*k*1 to 147*k*4) elastically deforms and temporarily moves away toward the outside of the drive input gear 147 in the radial direction. Thus, the transmission portion 150*b* can be inserted into the attaching portion 147*j*. More specifically, a relationship D15>Z6 is temporarily established. When the transmission portion 150*b* is completely inserted in the attaching portion 147*j*, the stopper portion 147*k* (147*k*1 to 147*k*4) is released from the elastically deformed state and returns to the original state. More specifically, the relationship Z6>D15 is established.

Next, a fastening member 156 is inserted from the direction indicted by the arrow X33 to fix the coupling 150 to the drive input gear 147. In the present exemplary embodiment, an outer diameter ϕD10 of the driven portion 150*a* is less than a diameter ϕD16 of an aperture 156*i* of the fastening member 156. More specifically, a relationship D16>D10 is established. This relationship assures that the fastening member 156 can be inserted in the drive input gear 147 in a state where the coupling 150 is inserted in the drive input gear 147.

Figure 8F:
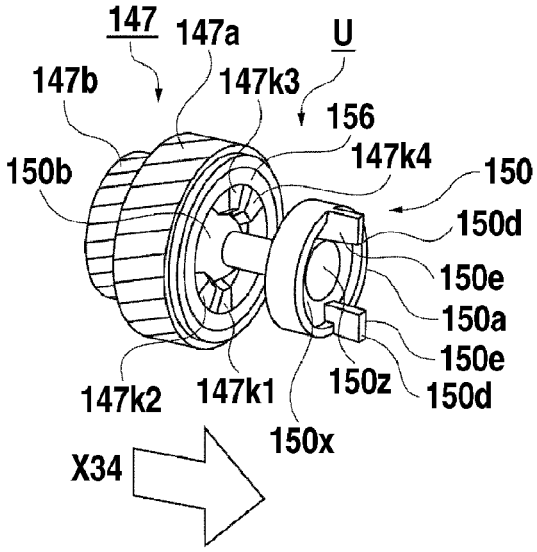

Further, as illustrated in FIG. 8F, the insertion of the fastening member 156 prevents the stopper portion 147*k* (147*k*1 to 147*k*4) from elastically deforming toward the outside of the drive input gear 147 in the radial direction. Thus, the relationship Z6>D15 can be maintained. In this state, even when any counter force acts on the coupling 150 in a direction opposed to the insertion direction, the coupling 150 can be prevented from being pulled out of the drive input gear 147.

When the counter force acts in the direction opposed to the insertion direction, the coupling 150 (transmission portion 150*b*) is urged to move outward from the attaching portion 147*j* in the direction indicated by the arrow X34. However, the transmission portion 150*b* contacts a stopper surface 147*l* (147*l*1 to 147*l*4 (although the surfaces 147*l*3 and 147*l*4 are not illustrated), see FIG. 8C) of the stopper portion 147*k* (147*k*1 to 147*k*4). Therefore, the movement of the coupling 150 is restricted. Thus, the coupling 150, the drive input gear 147, and the fastening member 156 are integrated as a drive unit U (see FIG. 8F, FIG. 16A, and FIG. 16B).

As illustrated in FIG. 8E, in which the coupling stopper portion 157*a* of the support member 157 is illustrated, the fastening member 156 and the support member 157 can be integrally formed. In this case, the above-described process of fixing the fastening member 156 to the drive input gear 147 can be omitted. Then, when the coupling 150 is attached to the development frame body (i.e., the cartridge frame body) 113, the coupling stopper portion 157*a* of the support member 157 can be inserted in the drive input gear 147 (i.e., the state illustrated in FIG. 8E).

In the state illustrated in FIG. 8E, the stopper portion 157*a* prevents the stopper portion 147*k* (147*k*1 to 147*k*4) of the gear 147 from elastically deforming outward in the radial direction. Thus, the stopper portion 157*a* can prevent the coupling 150 from being pulled out of or falling off the drive input gear 147. The function of the stopper portion 157*a* is similar to the function of the fastening member 156.

The coupling 150, when it is accommodated in the drive input gear 147, is movable (tiltable) between the rotational force transmitting angular position and the pre-engagement angular position (or the separating angular position). Further, the stopper portion 147*k* (147*k*1 to 147*k*4) regulates the movement of the coupling 150 relative to the drive input gear 147 in the direction indicated by the arrow X34. Namely, the diameter ϕD15 of the circular internal ridgeline 147*m* (147*m*1 to 147*m*4) is smaller than the diameter ϕZ6 of the stopper portion 150*i*.

Next, a movement range of the coupling 150 relative to the drive input gear 147 is described below with reference to FIGS. 10A1 to 10A5 and FIGS. 10B1 to 10B5.

FIGS. 10A1 to 10A5 and FIGS. 10B1 to 10B5 illustrate a coupling state of the drive input gear 147 and the coupling 150. FIGS. 10A1 to 10A5 illustrate the coupling state seen from the drive shaft (180) side. FIGS. 10B1 to 10B5 are perspective views illustrating the coupling state.

In the present exemplary embodiment, as illustrated in FIGS. 10B1 to 10B5, the rotational axis line L2 of the coupling 150 being attached as described above is tiltable in all directions relative to the axial line L4. The drive shaft 180 is positioned at one end of the rotary C in the longitudinal direction and is provided on the apparatus body A.

The drive shaft 180 is rotatable and provided on the apparatus body A that serves as a positioning member. More specifically, in a state where the drive shaft 180 is fixed to the apparatus body A, the drive shaft 180 cannot move in a direction substantially perpendicular to its rotational axis line.

In FIGS. 10A1 and 10B1, the axial line L2 coincides with the axial line L4. FIGS. 10A2 and 10B2 illustrate a state where the coupling 150 is tilted upward compared to the state illustrated in FIGS. 10A1 and 10B1. The coupling 150 inclines toward the direction where the aperture 147*g* is provided. In this state, the transmission pin 155 moves along the aperture 147*g* (see FIGS. 10A2 and 10B2). As a result, the coupling 150 inclines about the center that coincides with an axial line AX perpendicular to the aperture 147*g*.

FIGS. 10A3 and 10B3 illustrate a state where the coupling 150 is tilted rightward. When the coupling 150 inclines toward the direction perpendicular to the aperture 147*g*, the pin 155 rotates in the aperture 147*g*. The axial line of the rotating pin 155 is a center axial line AY of the pin 155.

FIGS. 10A4 and 10B4 illustrate a state where the coupling 150 is tilted downward. The coupling 150 inclines about the center that coincides with the axial line AX. FIGS. 10A5 and 10B5 illustrate a state where the coupling 150 is tilted leftward. The coupling 150 inclines about the center that coincides with the axial line AY.

If the direction is different from the above-described tilted direction or if the position is different from the above-described position (e.g., an intermediate state between FIGS. 10A2 and 10A3, between FIGS. 10A3 and 10A4, between FIGS. 10A4 and 10A5, or between FIGS. 10A5 and 10A2), the coupling 150 causes a tilt motion as a combination of the rotation around the axial line AX and the rotation around the axial line AY. In this manner, the axial line L2 can incline in any direction relative to the axial line L4.

However, it is unnecessary that the axial line L2 is constantly tiltable relative to the axial line L4 at a predetermined angular range in all directions (360°). In this case, for example, setting the aperture 147*g* as a wider aperture in the circumferential direction may be useful. According to the above-described setting, when the axial line L2 inclines relative to the axial line L4, the coupling 150 slightly rotates around the axial line L2 even when it cannot linearly incline a predetermined angle. As a result, the axial line L2 can incline the predetermined angle relative to the axial line L4. Namely, the looseness (play) of the aperture 147*g* in the rotational direction can be appropriately selected if necessary.

As described above (see FIGS. 8A to 8F), the stopper portion 150*i* contacts the stopper surface 147*l*. Therefore, in the attached state of the coupling 150, a spherical center P2 of the stopper portion (i.e., the spherical portion) 150*i* serves as a rotational center. Namely, irrespective of the phase of the drive input gear 147, the axial line L2 is tiltable in the attached state.

Figure 11A:
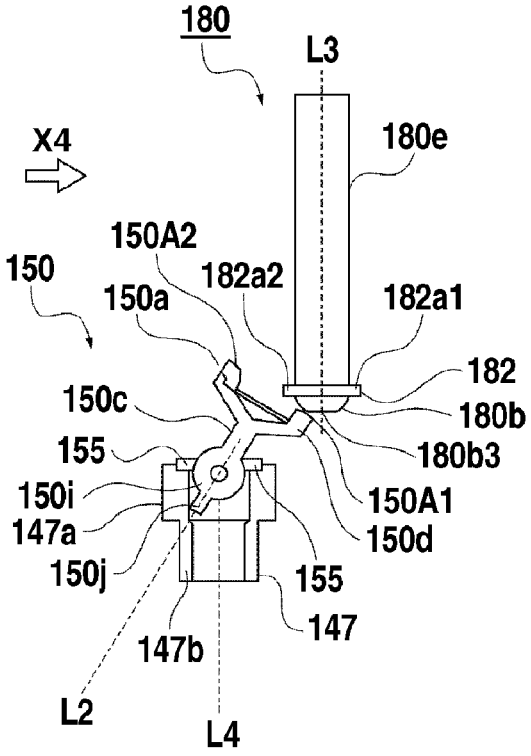
FIGS. 11A to 11D are vertical cross-sectional views illustrating the rotational force transmitting member according to an exemplary embodiment of the present invention.
Figure 11B:
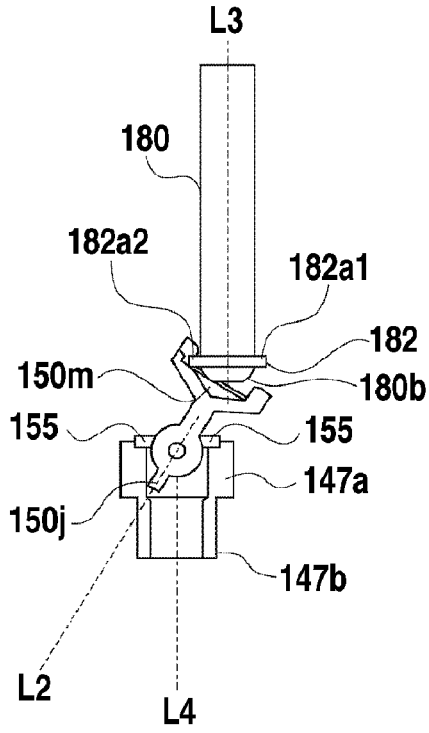
Figure 11C:
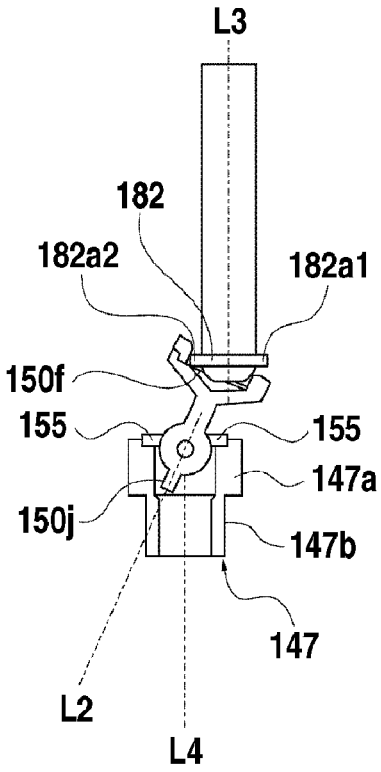
Figure 11D:
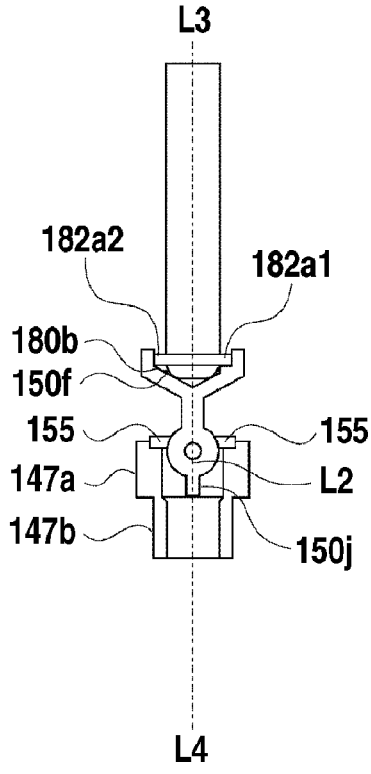

More specifically, the coupling 150 is rotatable around the axial line L4. Further, as described below, before the coupling 150 engages with the drive shaft 180, it is necessary that the axial line L2 is tilted relative to the axial line L4 toward the downstream side in the rotational direction X4 of the rotary C. Namely, as illustrated in FIGS. 11A to 11C, it is necessary that the axial line L2 of the coupling 150 is tilted relative to the axial line L4 so that the driven portion 150*a* is positioned on the downstream side in the rotational direction X4 of the rotary C.

FIG. 2 illustrates a state where the axial line L2 is inclined relative to the axial line L4. Further, as a cross-sectional view similar to that of FIG. 8E, FIG. 9 illustrates a state where the axial line L2 is inclined relative to the axial line L4.

Figure 9:
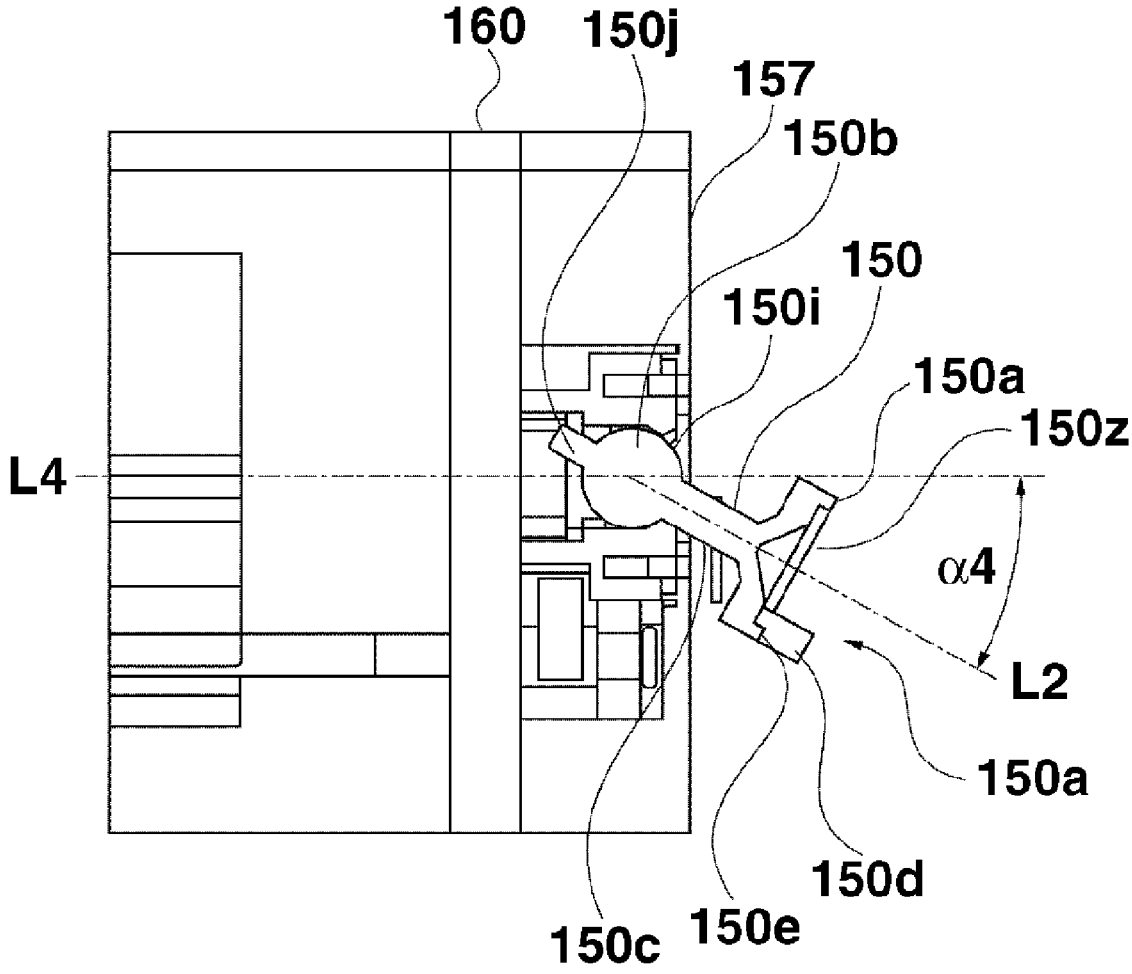
FIG. 9 is a cross-sectional view illustrating the development device according to an exemplary embodiment of the present invention.

The above-described configuration allows the axial line L2 to move from the inclined state illustrated in FIG. 9 to a state where the axial line L2 becomes parallel to the axial line L4. Further, a maximum tiltable angle α4 (see FIG. 9) between the axial line L4 and the axial line L2 can be set wider unless the driven portion 150*a* and the intermediate portion 150*c* contact an end member 151 and the support member 157. The angle α4 can be set as a value required when attached to or detached from the apparatus body. In the present exemplary embodiment, the maximum tiltable angle α4 is in a range from 20° to 80°.

As described above, the axial line L2 is required to be tilted relative to the axial line L4 toward the downstream side in the rotational direction X4 before the coupling 150 engages with the drive shaft 180 is described below. An example regulating method is described below.

Next, an angular position regulation member (hereinafter, referred to as a "regulation member") 160, which can regulate the tilt direction of the coupling 150, is described with reference to FIGS. 12A to 12D and FIGS. 13A to 13G.

The rotational force transmitting angular position is the first angular position. The pre-engagement angular position is the second angular position. Further, the separating angular position is the third angular position.

The regulation member 160 according to the present exemplary embodiment can hold the coupling 150 at the pre-engagement angular position (i.e., the second angular position) before the cartridge B is attached to the rotary C. More specifically, even when the cartridge B is solely present, the coupling 150 can be held at the pre-engagement angular position (i.e., the second angular position). Accordingly, the regulation member 160 can prevent the coupling 150 from being moved unwontedly when the cartridge B is carried.

Figure 12A:
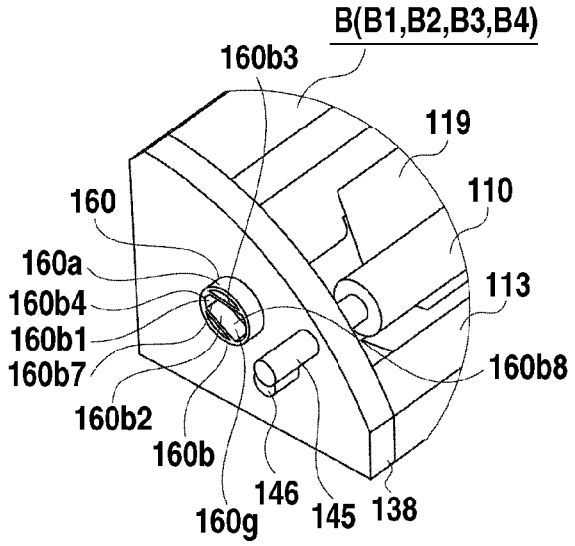
FIGS. 12A to 12D are perspective views illustrating a regulating portion according to an exemplary embodiment of the present invention.
Figure 12B:
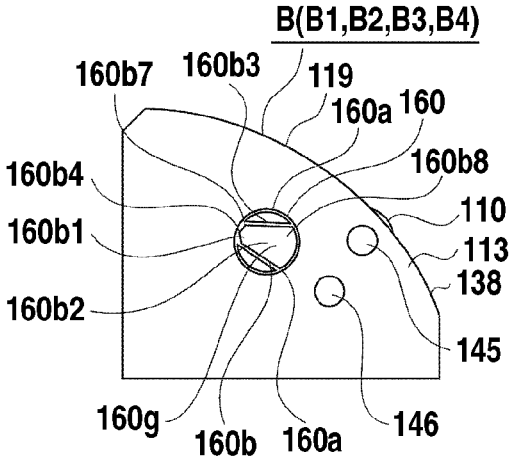
Figure 12C:
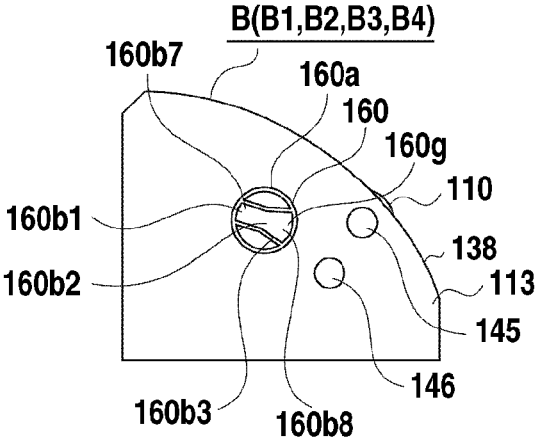
Figure 12D:
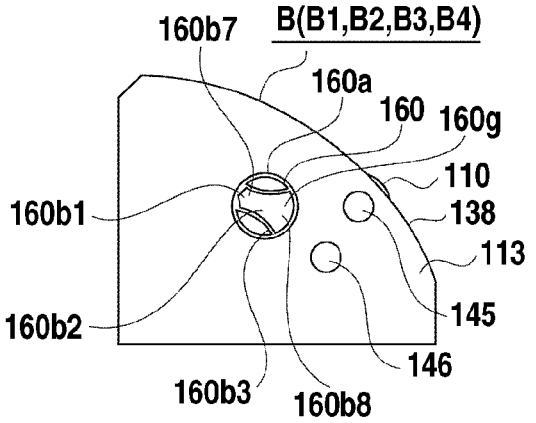

FIG. 12A is a perspective view illustrating the regulation member 160, which is seen from the outside of the development roller 110 in the longitudinal direction. FIG. 12B is a side view illustrating the regulation member 160, which is seen from the outside of the development roller 110 in the longitudinal direction. FIGS. 12C and 12D illustrate other examples of the regulation member 160, which are different in shape.

Figure 13A:
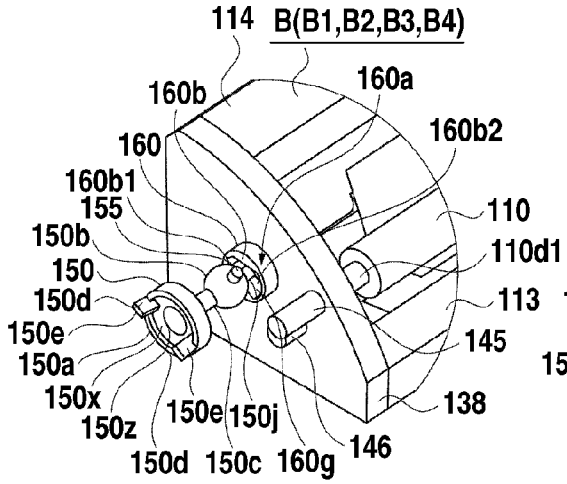
FIGS. 13A to 13G are perspective views illustrating a position relationship between the rotational force transmitting member and the regulating portion according to an exemplary embodiment of the present invention.
Figure 13B:
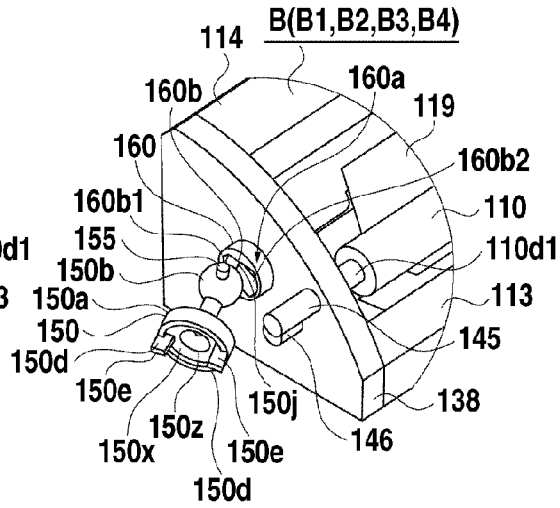
Figure 13C:
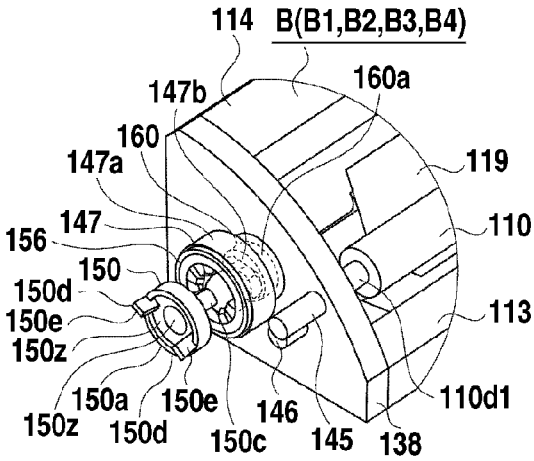
Figure 13D:
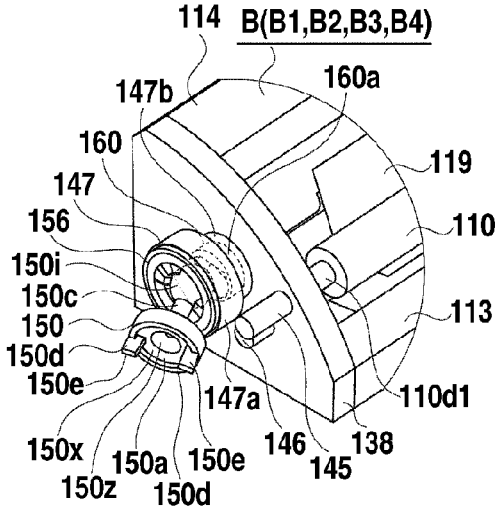

FIG. 13A is a perspective view illustrating a position relationship between the coupling 150 and the regulation member 160 when the coupling 150 is located at the rotational force transmitting angular position. FIG. 13B is a perspective view illustrating a position relationship between the coupling 150 and the regulation member 160 when the coupling 150 is located at the pre-engagement angular position. FIG. 13C and FIG. 13D illustrate the drive input gear 147 and the fastening member 156 in the states corresponding to FIG. 13A and FIG. 13B, respectively.

Figure 13E:
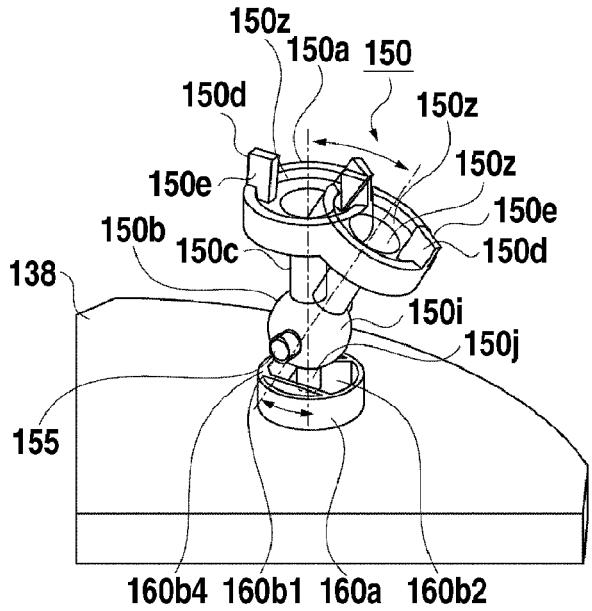
Figure 13F:
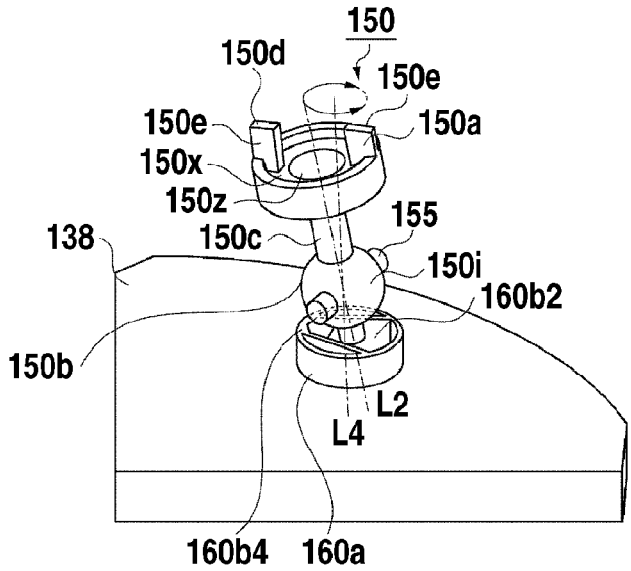
Figure 13G:
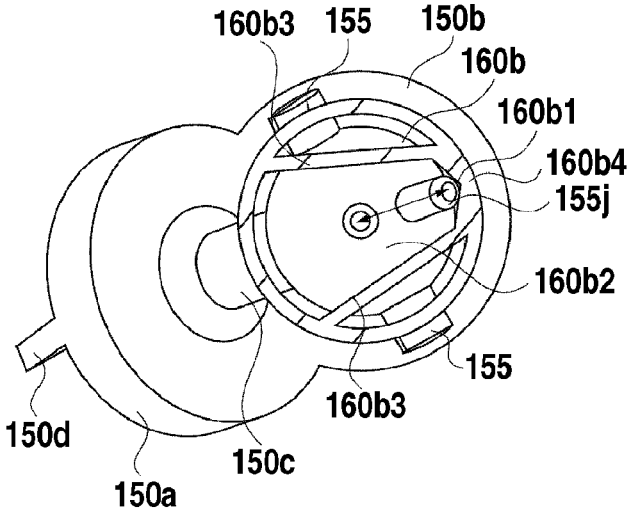

FIG. 13E is a perspective view illustrating the coupling regulated portion 150*j* located at a positioning portion (i.e., a regulating portion) 160*b*1. FIG. 13F is a perspective view illustrating the regulated portion 150*j* located at an allowance portion 160*b*2. FIG. 13G is a perspective view illustrating the coupling 150 engaged with the regulation member 160, which is seen from the direction of the coupling regulated portion 150*j*. The regulated portion 150*j* cannot be seen because the regulation member 160 has a bottom, although FIG. 13G does not illustrate the bottom of the regulation member 160.

The regulation member 160 includes a circular bearing portion 160*a* and the regulated portion accommodating portion 160*b*. In the present exemplary embodiment, the regulation member 160 includes a groove 160*g*. The bearing portion 160*a* surrounds the groove 160*g*. Further, the accommodating portion 160*b* includes the positioning portion 160*b*1 and the allowance portion 160*b*2. The regulation member 160 is integral with the above-described bearing 138. More specifically, the regulation member 160 is provided on an outer surface of the bearing 138.

The bearing portion 160*a* rotatably supports an inner cylindrical surface 147*i* (see FIG. 8C) of the drive input gear 147. More specifically, the inner cylindrical surface 147*i* of the drive input gear 147 is coupled with an outer cylindrical surface of the bearing portion 160*a*. Thus, the drive input gear 147 is rotatably attached to the bearing portion 160*a*. Further, the regulated portion 150*j* is accommodated in the accommodating portion 160*b*. In this state, the coupling 150 is freely movable within a range that the regulated portion 150*j* does not interfere with a wall 160*b*3 of the accommodating portion 160*b*. The regulated portion 150*j* has a columnar shape. The above-described configuration is effective to downsize the coupling attaching configuration.

Before the coupling 150 engages with the apparatus body side engaging portion, an elastic member (i.e., an urging member) places the coupling 150 at the pre-engagement angular position. In this state, the regulated portion 150*j* contacts the positioning portion (i.e., the regulating portion) 160*b*1. More specifically, a columnar portion of the regulated portion (i.e., a protruding portion) 150*j* collides against a V-groove wall 160*b*4 serving as the positioning portion 160*b*1 and regulates the tilt direction of the coupling 150.

The regulated portion (i.e., the protruding portion) 150*j* of the coupling 150 protrudes at a rear side opposed to the other rear side where the rotational force receiving surface (i.e., the rotational force receiving portion) 150*e* is provided.

More specifically, the regulated portion 150*j* collides against the V-groove portion 160*b*4 of a narrow portion 160*b*7 serving as the positioning portion 160*b*1 and regulates the tilt direction. Accordingly, the coupling 150 can be positioned at an optimum pre-engagement angular position where the coupling 150 can be surely engaged with the apparatus body side engaging portion. (FIG. 13E illustrates a state where the inclinedly illustrated coupling 150 is positioned at the pre-engagement angular position). More specifically, the positioning portion 160*b*1 can serve as a positioning means only when the coupling 150 is located at the pre-engagement angular position.

When the coupling 150 is located at a position other than the pre-engagement angular position, the coupling 150 is freely movable within a range that the regulated portion 150*j* does not interfere with the wall 160*b*3 of the allowance portion 160*b*2. More specifically, in a case where the coupling 150 in located between the pre-engagement angular position and the rotational force transmitting angular position, at the rotational force transmitting angular position, between the rotational force transmitting angular position and the separating angular position, or at the separating angular position, the coupling 150 is freely movable within a range that the regulated portion 150*j* does not interfere with the wall 1603 of the allowance portion 160*b*2.

In other words, when the regulated portion 150*j* does not contact the positioning portion (i.e., the regulating portion) 160*b*1, the coupling 150 is rotatable (the coupling 150 vertically extending in FIG. 13F and FIG. 13E is in this state). Thus, when the coupling 150 moves from the pre-engagement angular position to the rotational force transmitting angular position, or when the coupling 150 moves from the rotational force transmission position to the separating angular position, in a state where the coupling 150 is engaged with the apparatus body side engaging portion, the coupling 150 can move following the drive shaft 180.

Further, the coupling 150 can reduce a stress acting thereon even when the rotary C moves in a radial direction, more specifically, even when the coupling 150 moves in a radial direction of the rotary C. Accordingly, the coupling 150 can smoothly engage with the apparatus body side engaging portion and can smoothly disengage from the apparatus body side engaging portion. The allowance portion 160*b*2 includes a wider portion 160*b*8.

Further, the shape of the regulated portion accommodating portion 160*b* can be any one of example shapes illustrated in FIG. 12C and FIG. 12D when the positioning portion 162*a* and the allowance portion 162*b* can satisfy the above-mentioned function. More specifically, in an exemplary embodiment illustrated in FIG. 12C, the shape of the positioning portion (i.e., the regulating portion) 160*b*1 is an arc shape. Further, the wall 160*b*3 has a flexed shape. Further, in an exemplary embodiment illustrated in FIG. 12D, the wall 160*b*3 has a curved shape.

Figure 14:
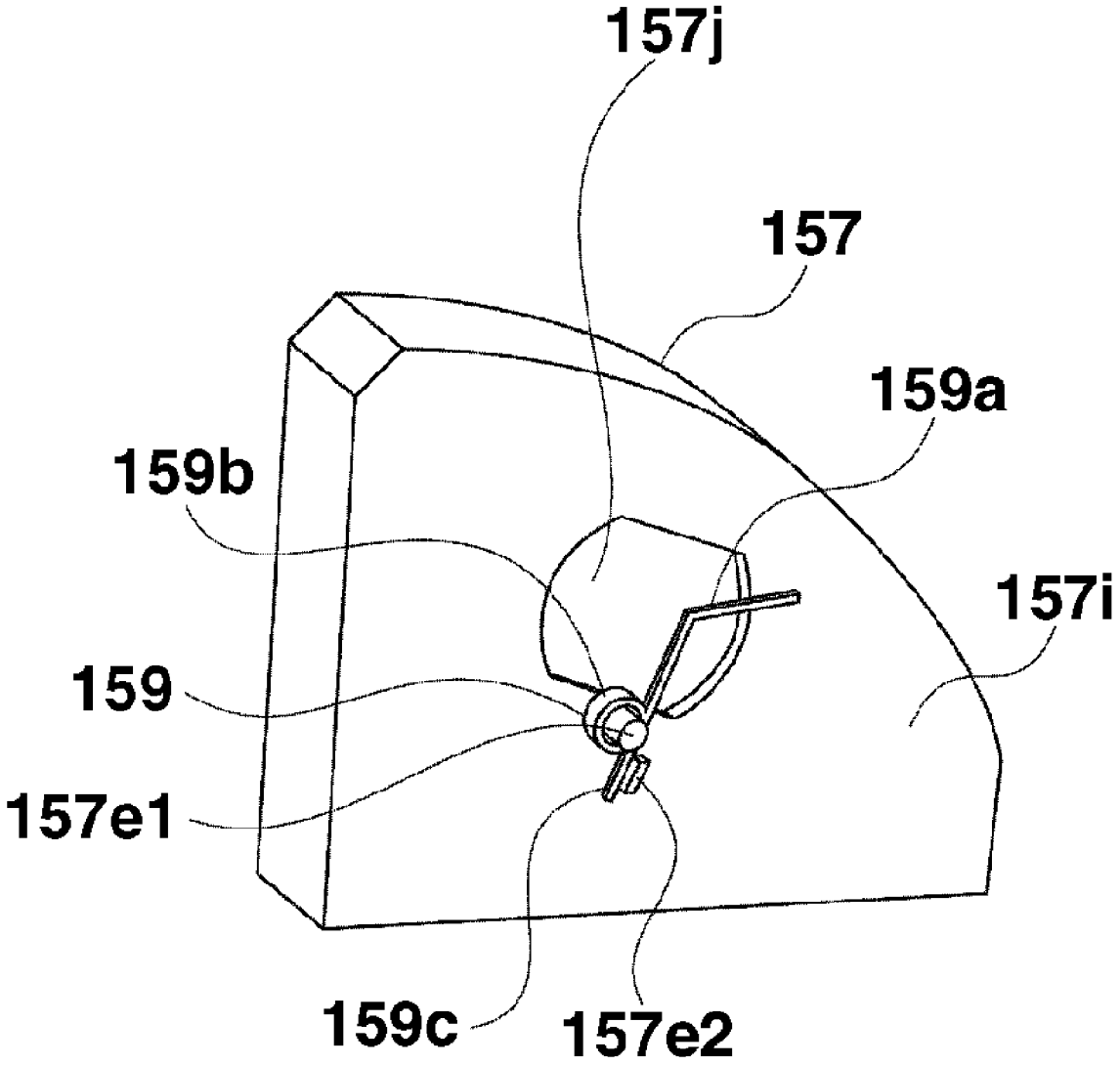
FIG. 14 is a perspective view illustrating an elastic member (i.e., an urging member) and a support member according to an exemplary embodiment of the present invention.
Figure 15:
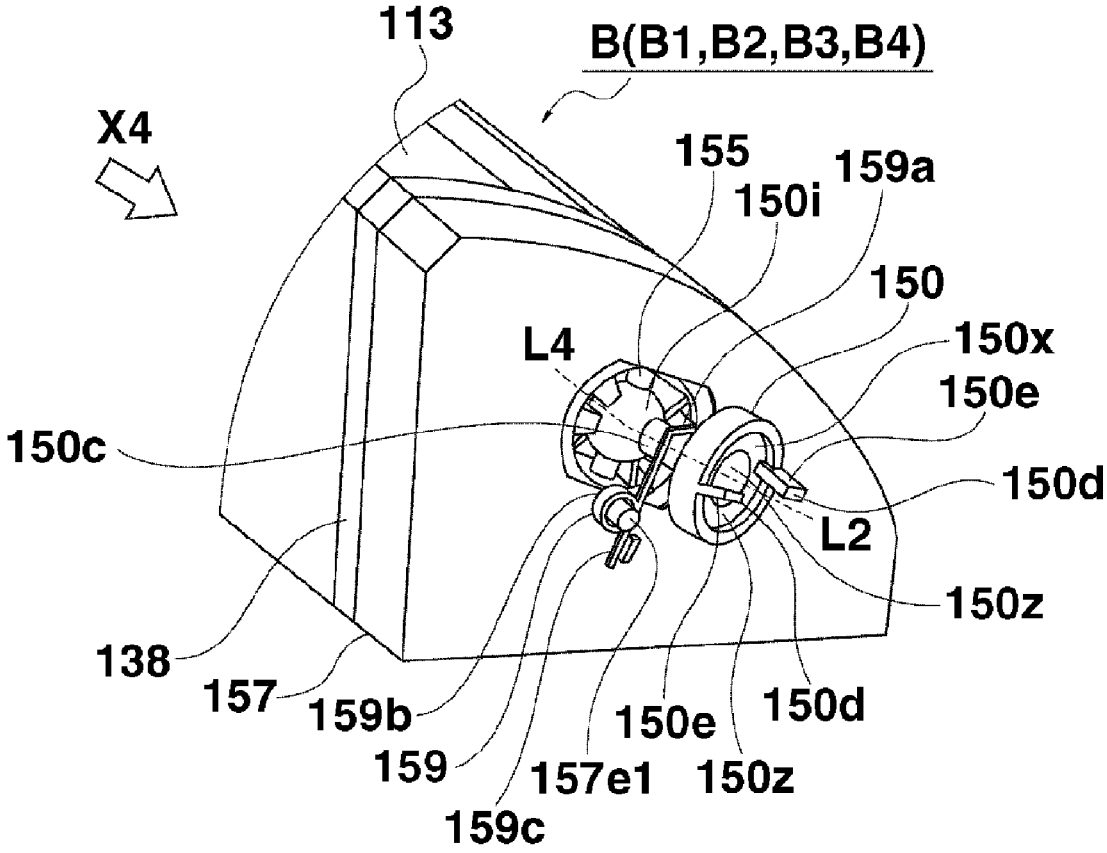
FIG. 15 is a perspective view illustrating a development device drive portion according to an exemplary embodiment of the present invention.

Next, an example of a coupling elastic member (i.e., an urging member), which can move the coupling 150 to the pre-engagement angular position, is described below with reference to FIGS. 14 and 15. FIG. 14 is a perspective view illustrating an elastic member 159 attached to the support member 157. FIG. 15 is a perspective view illustrating the cartridge B including the elastic member (hereinafter, referred to as a "spring") 159 attached to the support member 157.

As illustrated in FIG. 14, a spring attaching portion 157*e*1 and a spring stopper 157*e*2 are provided on an outer surface 157*i* of the support member (i.e., attaching member) 157. Further, a coil portion 159*b* of the torsion coil spring (i.e., the urging member or the elastic member) 159 is coupled around the attaching portion 157*e*1.

Further, a stopper arm 159*c* of the spring 159 contacts the spring stopper 157*e*2. Further, as illustrated in FIG. 15, a contact portion 159*a* of the spring 159 contacts the intermediate portion 150*c* of the coupling 150. In this state, the spring 159 generates elastic force when it is distorted. Thus, the axial line L2 of the coupling 150 is inclined relative to the axial line L4 (the state illustrated in FIG. 15). More specifically, the inclined coupling 150 is held at the pre-engagement angular position.

In the present exemplary embodiment, the spring 159 is not limited to the above-described torsion coil spring and can be any other spring. For example, a leaf spring, a rubber, and a sponge are examples of the elastic member (i.e., the urging member) that can generate elastic force. However, to incline the axial line L2, a predetermined amount of stroke is necessary for the spring 159. Therefore, it is desired that the spring 159 can obtain a required stroke.

Further, to position the coupling 150 at pre-engagement angular position (i.e., the first angular position), the spring (i.e., the urging member or the elastic member) 159 elastically urges the coupling 150 so that the regulated portion 150*j* of the coupling 150 can be positioned at the regulating portion 160*b*1.

Then, when the rotary C rotates, the coupling 150 contacts the apparatus body side engaging portion according to the movement of the cartridge B. Thus, the coupling 150 rotates against the elastic force of the spring (i.e., the elastic member) 159. The regulated portion 150*j* moves from the regulating portion 160*b*1 to the allowance portion 160*b*2. Correspondingly, the coupling 150 moves from the pre-engagement angular position to the rotational force transmitting angular position. Thus, the coupling 150 faces the drive shaft 180 and receives rotational force from the drive shaft 180.

Further, if the rotary C further rotates from the position where the coupling 150 faces the drive shaft 180, the coupling 150 moves from the rotational force transmitting angular position to the separating angular position against the elastic force of the spring 159 according to the movement of the cartridge B. Thus, the coupling 150 disengages from the apparatus body side engaging portion.

Next, an example configuration of the rotary C is described below with reference to FIGS. 16A and 16B through FIGS. 19A and 19B.

Figure 16A:
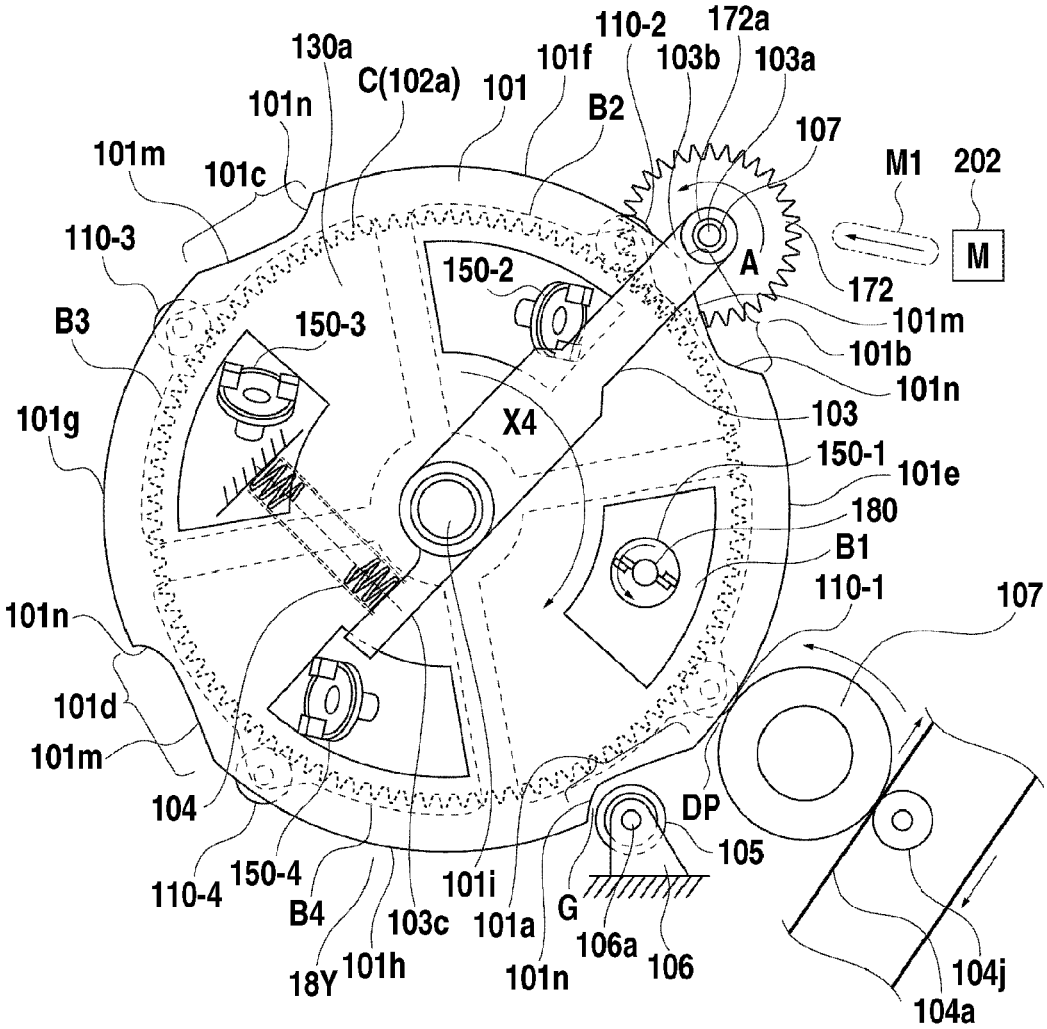
FIGS. 16A and 16B are vertical cross-sectional views illustrating a movable member according to an exemplary embodiment of the present invention.
Figure 17:
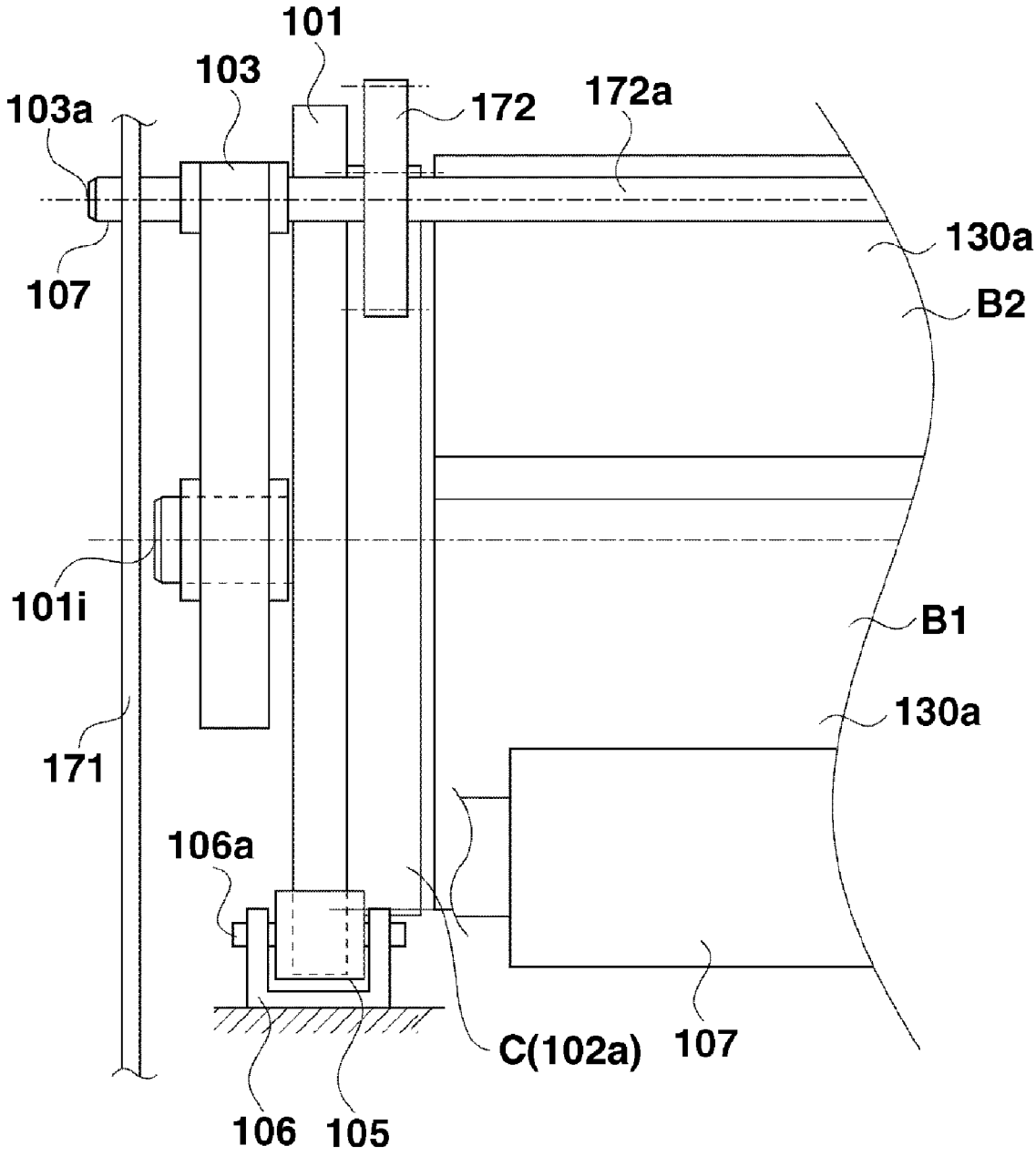
FIG. 17 is a vertical cross-sectional view illustrating the movable member according to an exemplary embodiment of the present invention.
Figure 18A:
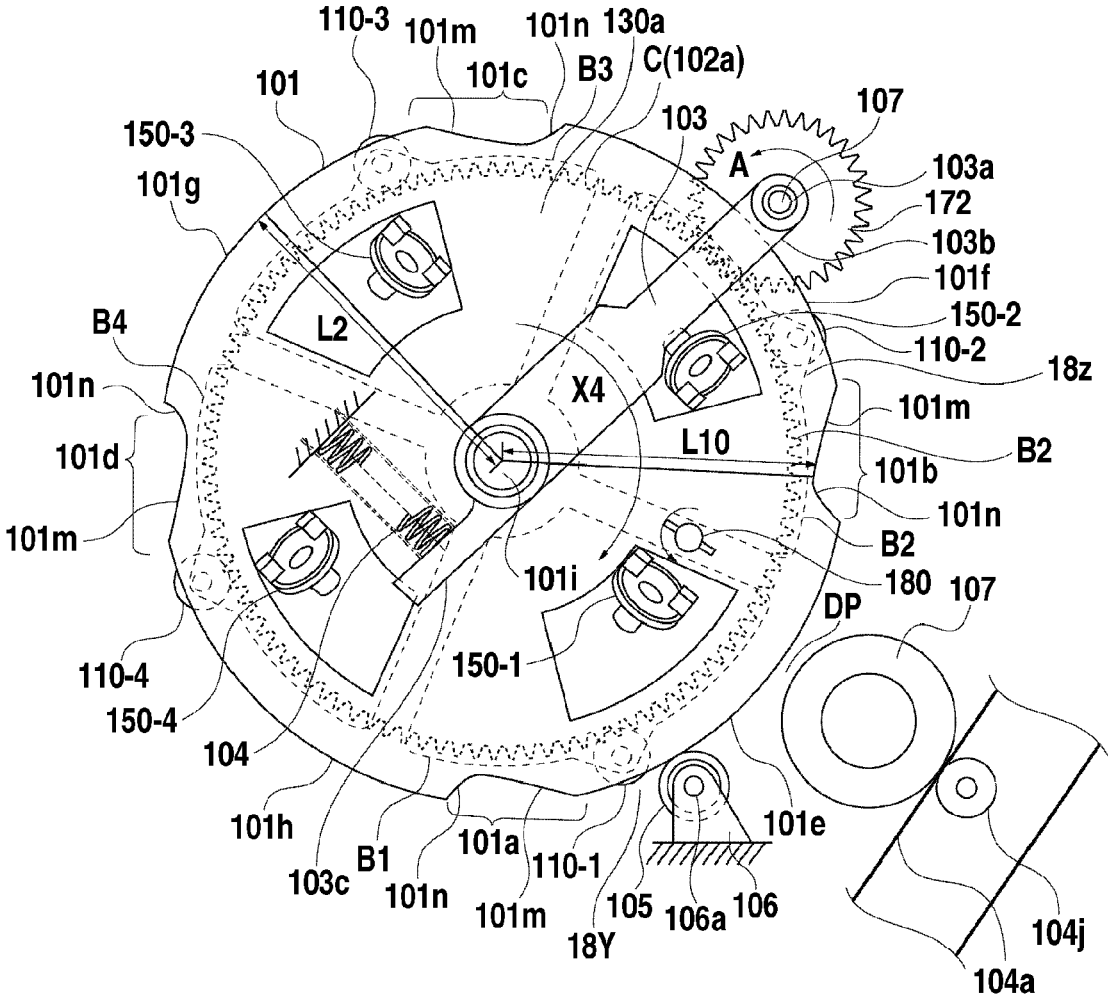
FIGS. 18A and 18B are vertical cross-sectional views illustrating the movable member according to an exemplary embodiment of the present invention.
Figure 19A:
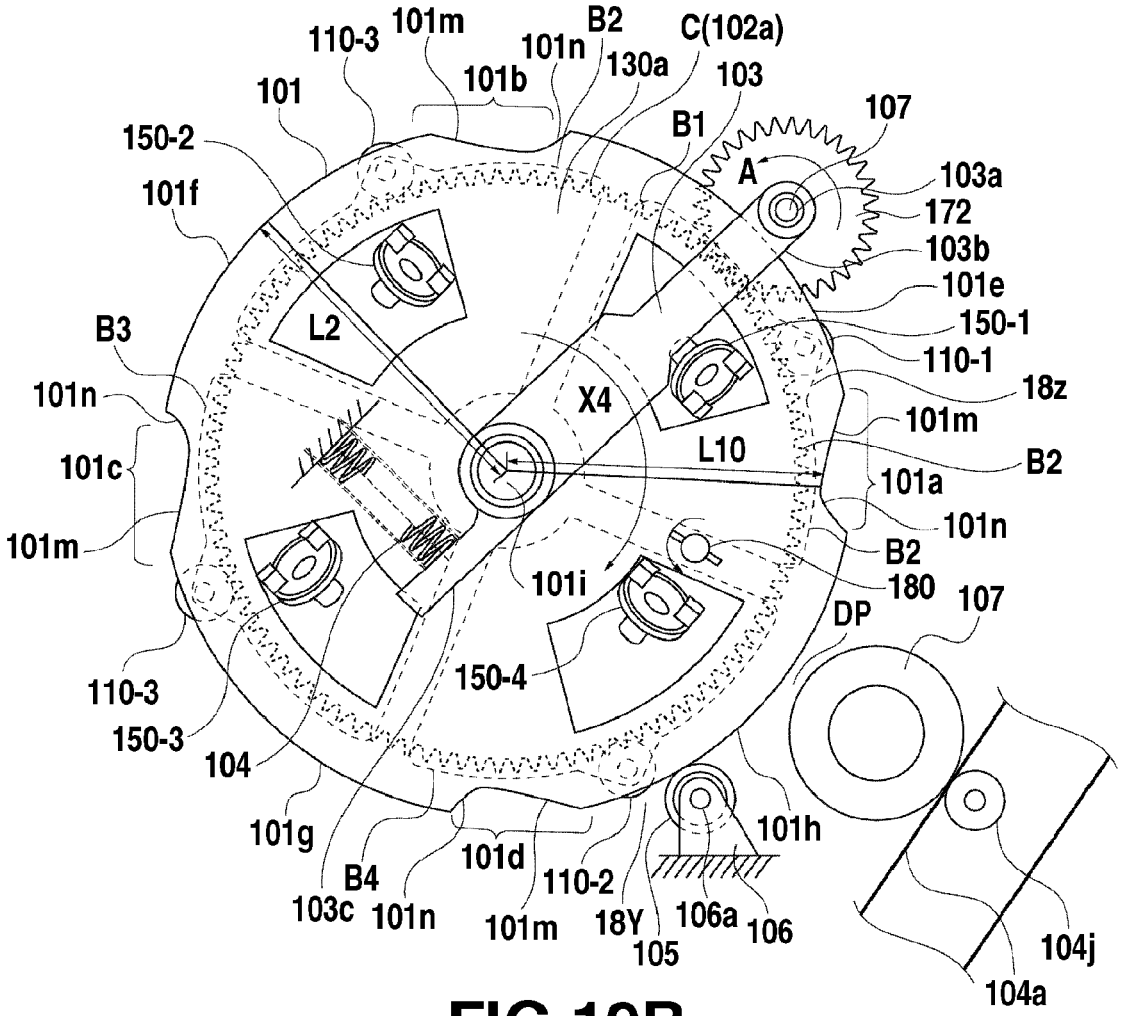
FIGS. 19A and 19B are vertical cross-sectional views illustrating the movable member according to an exemplary embodiment of the present invention.

FIG. 16A, FIG. 18A, and FIG. 19A are front views illustrating the configuration of a driving force transmission mechanism, which is seen from the direction of the drive shaft 180. FIG. 16A illustrates a state where a development roller 110-1 of the cartridge B1 is located at a development position DP where the cartridge B1 faces the photosensitive drum 107. FIG. 17 is a right side view of the mechanism illustrated in FIG. 16A, which is seen from the right direction.

Figure 16B:
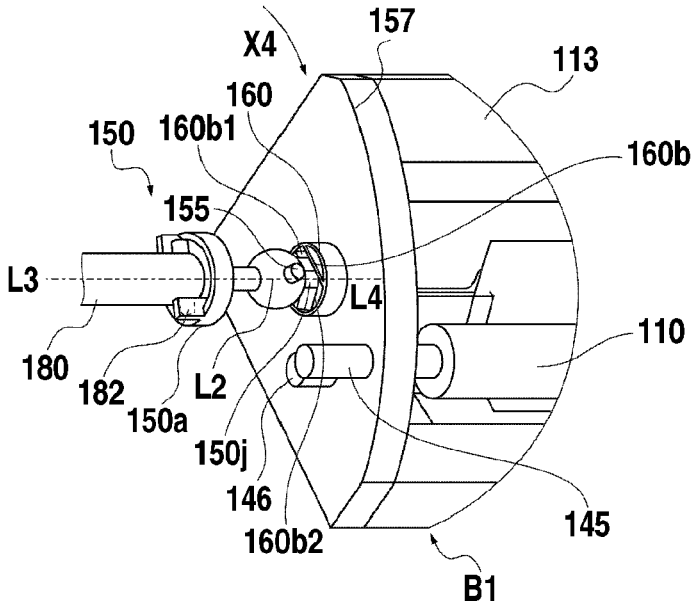

When the rotary C further rotates in the direction indicated by the arrow X4 from the state illustrated in FIGS. 16A and 16B, the cartridge B1 is positioned at a post-development retracting position 18Y (see FIG. 18A) and at a pre-development retracting position 18Z (see FIG. 19A). However, a body frame 171 illustrated in FIG. 17 is omitted in each of FIG. 16A, FIG. 18A, and FIG. 19A. Further, the transfer belt 104*a*, the transfer roller 104*j*, the coupling 150, and the drive shaft 180 illustrated in FIG. 16A, FIG. 18A and FIG. 19A are omitted in FIG. 17.

Figure 18B:
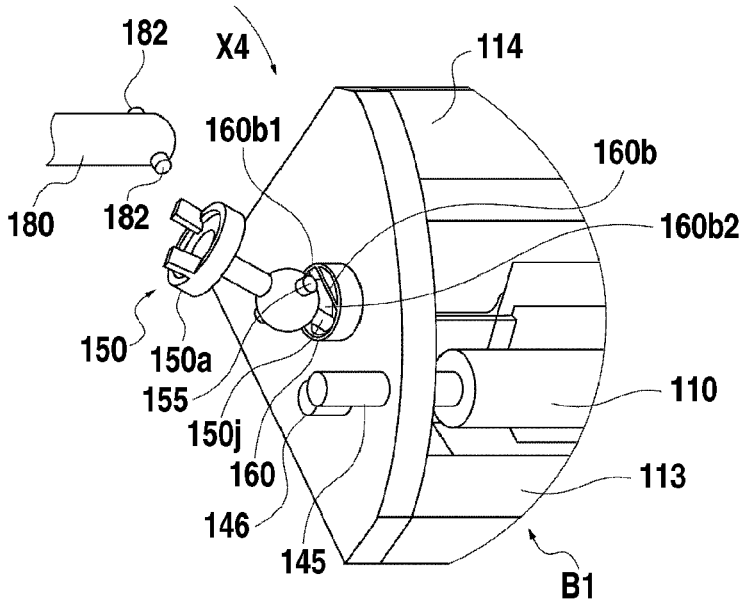
Figure 19B:
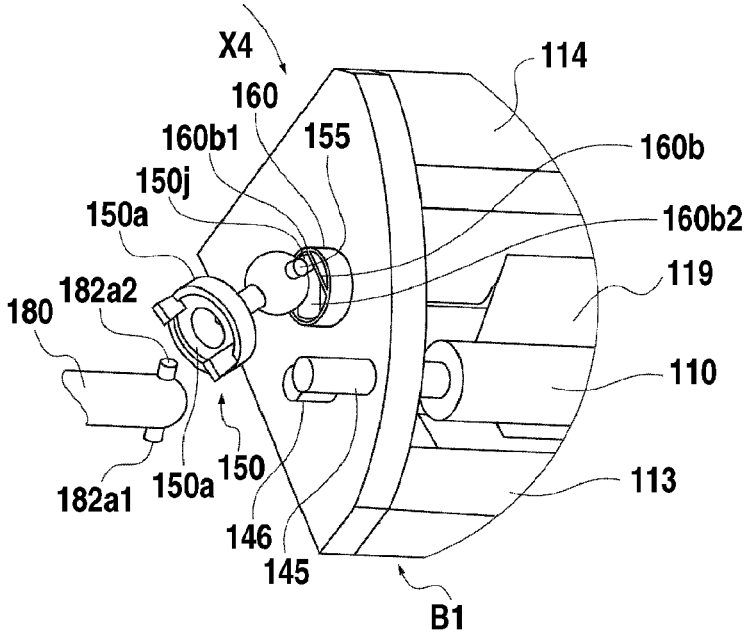

FIG. 16B, FIG. 18B, and FIG. 19B are perspective views illustrating the coupling 150, the regulating portion 160, and the drive shaft 180 corresponding to the illustrations of FIG. 16A, FIG. 18A, and FIG. 19A, which are seen from the drive shaft (180) side.

The driving force transmission mechanism illustrated in FIGS. 16A and 16B through FIGS. 19A and 19B can rotate the rotary C to successively move four cartridges B1 to B4 supported by the rotary C to the development position DP that faces the photosensitive drum 2. Hereinafter, an example configuration of the driving force transmission mechanism is described below.

The drive gear 172 serving as a first driving force transmission member is rotatably supported by a shaft 107. The shaft 107 is rotatably supported by the apparatus body A. The gear 172 can rotate around its rotational shaft when rotational force is transmitted from a motor M (i.e., a driving source).

A rotational force transmission mechanism M1 configured to transmit rotational force from the motor M to the gear 172 is, for example, a gear train, a toothed belt, or any other appropriate member that can transmit the rotational force.

An arm 103 is a swing member that is swingably supported by the apparatus body A. The arm 103 has one end side 103*b* rotatably supported by the shaft 107 provided on the body frame 171. Further, the arm 103 has the other end side 103*c* that rotatably supports the rotary C. An arm spring (e.g., a compression spring) 104 has one end fixed to the apparatus body A and the other end attached to the other end side 103*c* of the arm 103. The elastic force of the arm spring 104 resiliently urges the arm 103 toward the center of the shaft 107 in the direction indicated by the arrow A (see FIGS. 16A and 16B, FIGS. 18A and 18B, and FIGS. 19A and 19B).

The rotary C, which supports four cartridges B (B1 to B4) as described above, is rotatably supported by the arm 103. More specifically, each cartridge B is attached to the rotary C. Further, the couplings 150 (150-1 to 150-4) of the cartridges B (B1 to B4) are supported by and protrude from the rotary C in the direction of the axial line L4 (see FIGS. 16A and 16B, FIGS. 18A and 18B, and FIGS. 19A and 19B). Thus, rotational force transmission from the drive shaft 180 (i.e., the member other than the rotary C) to the couplings 150 (150-1 to 150-4) is feasible.

Further, the rotary C includes a gear portion (i.e., rotation support member gear) 102*a* provided along the rotational direction of the rotary C. The gear portion 102*a* meshes with the drive gear 172. Namely, when the drive gear 172 rotates in the direction indicated by the arrow A (see FIGS. 16A and 16B, FIGS. 18A and 18B, and FIGS. 19A and 19B), the rotary C rotates in the direction indicated by the arrow X4. Further, when the gear 172 stops rotating, the rotary C stops rotating.

A regulation roller 105 is rotatably supported by a roller holder 106 mounted on the apparatus body A. The regulation roller 105 is a regulation member that regulates a swing motion of the rotary C. Further, if the regulation roller 105 has a surface layer made of an elastic rubber member, the regulation roller 105 can be noiseless and surely rotatable with a high friction coefficient.

Further, the roller 105 is an elastic roller that is rotatably supported by a shaft 106*a* fixed to the apparatus body A. The shaft 106*a* supporting the roller 105 is parallel to the rotational axis line of the rotary C. When the rotary C rotates around its rotational shaft, the roller 105 contacts contact portions 101*e* to 101*h* of a cam 101 and is driven by the rotary C.

The cam 101 is a rotational member (i.e., a guide member) that integrally rotates with the rotary C. The cam 101 includes the contact portions 101*e* to 101*h* where the cam 101 contacts the roller 105 and separating portions (i.e., disengaged portions) 101*a* to 101*d* where the cam 101 does not contact the roller 105. The separating portions 101*a* to 101*d* are recesses.

The contact portions 101*e* to 101*h* and the separating portions (i.e., the recesses) 101*a* to 101*d* are alternately disposed along the outer cylindrical surface of the cam 101 at substantially the same angle about a rotational center 101*i* of the cam 101. The cam 101 is positioned at one end and the other end of the cartridges B1 to B4 supported by the rotary C in the longitudinal direction and is integrally provided with the rotary C.

Each of the separating portions (i.e., the recesses) 101*a* to 101*d* includes a slope 101*m* provided at the upstream side thereof so as to rise from the downstream side to the upstream side in the rotational direction X4. Providing the slope 101*m* (see FIGS. 16A and 16B, FIGS. 18A and 18B, and FIGS. 19A and 19B) is effective to enable the cartridges B1 to B4 to smoothly move away in a direction intersecting with the rotational direction according to the rotation of the rotary C. More specifically, the cartridges B1 to B4 can smoothly move away from the development position DP in the radial direction of the rotary C according to the rotation of the rotary C.

Similarly, the recess includes a slope 101*n* (see FIGS. 16A and 16B, FIGS. 18A and 18B, and FIGS. 19A and 19B) provided at the downstream side thereof so as to rise from the upstream side to the downstream side in the rotational direction X4. Providing the slope 101*n* is effective to enable the cartridges B1 to B4 to smoothly move toward the development position DP in the direction intersecting with the rotational direction X4 according to the rotation of the rotary C. More specifically, the cartridges B1 to B4 can smoothly move toward the development position DP in the radial direction of the rotary C according to the rotation of the rotary C.

The cam 101 rotates integrally with the rotary C. When contact portion 101*e* contacts the regulation roller (i.e., the regulation member) 105, the development roller 110-1 of the cartridge B1 is separated from the photosensitive drum 107. Similarly, when other contact portions 101*f* to 101*h* contact the regulation roller 105, the development rollers 110-2 to 110-4 of the cartridges B2 to B4 are respectively separated from the photosensitive drum 107 (see FIGS. 18A and 18B and FIGS. 19A and 19B).

In the present exemplary embodiment, as illustrated in FIG. 17, the cam (i.e., the rotational member) 101, the rotary (i.e., the rotation support member) C, the arm (i.e., swing member) 103, and the regulation roller (i.e., the regulation member) 105 are disposed on one end side and the other end side of the supported cartridge B1 in the longitudinal direction.

In the states illustrated in FIGS. 18A and 18B and FIGS. 19A and 19B, the rotary C is rotating as described below. However, FIGS. 18A and 18B and FIGS. 19A and 19B, the rotary C also illustrate the rotary C in a stopped state and positioned at a retracting position. When the rotary C is in the retracting position, each of the cartridges B1 to B4 does not perform development.

As illustrated in FIGS. 18A and 18B and FIGS. 19A and 19B, in the above-described state, each of the development rollers 110-1 to 110-4 does not contact the photosensitive drum 107. For example, in FIGS. 18A and 18B, the development roller 110-1 is positioned at the retracting position 18Y on the downstream side of the roller 105. Similarly, in FIGS. 19A and 19B, the development roller 110-1 is positioned at the retracting position 18Z on the upstream side of the roller 105. Further, at the retracting position, the roller 105 supports a lower part of the rotary C. Further, the roller 105 supports a lower part of the rotary C disposed on the other end side. Thus, the roller 105 regulates the swing motion of the rotary C that supports respective cartridges B1 to B4.

On the other hand, in a state where the development roller 110-1 contacts the photosensitive drum 107 as illustrated in FIGS. 16A and 16B, the roller 105 is separated from the cam 101 and faces to a bottom surface of the recess (separating portion) 101*a*. FIG. 16A illustrates a state where the cartridge B1 is positioned at the development position DP.

In a state where the development roller 110-2 is positioned at the development position DP and contacts the photosensitive drum 107, the roller 105 is spaced from the cam 101 and faces a bottom surface of the recess 101*b*. Similarly, in a state where the development roller 110-3 is positioned at the development position DP, the roller 105 is spaced from the cam 101 and faces a bottom surface of the recess 101*c*. Further, in a state where the development roller 110-4 is positioned at the development position DP, the roller 105 is spaced from the cam 101 and faces a bottom surface of the recess 101*d*. In each of the above-described cases, the cam 101 does not contact the regulation roller 105. Accordingly, the arm 103 elastically urged by the spring 104 presses the rotary C to apply an appropriate pressure to the development roller 110-1 (to 110-4) that contacts the photosensitive drum 107.

The drive gear 172 rotates in the direction indicated by the arrow A when rotational force is transmitted from the motor M. Correspondingly, as described above, the rotary C rotates in the direction indicated by the arrow X4. Further, the cam 101 provided on the rotary C integrally rotates with the rotary C in the direction indicated by the arrow X4.

FIGS. 18A and 18B and FIGS. 19A and 19B illustrate a state where the rotary C is rotating while receiving the rotational force from the drive gear 172. FIGS. 18A and 18B illustrate a state where the cartridge B1 retracts from the development position DP to the post-development retracting position 18Y after completing the development by the cartridge B1 and the cartridge B2 moves from the pre-development retracting position 18Z to the development position DP.

Similarly, FIGS. 19A and 19B illustrate a state where the cartridge B4 retracts from the development position DP to the post-development retracting position 18Y after completing the development by the cartridge B4 and the cartridge B1 moves from the pre-development retracting position 18Z to the development position DP.

Further, the rotary C includes the gear portion (i.e., the rotation support member gear) 102*a* provided on the entire circumferential surface along the rotational direction thereof. The drive gear (i.e., a swing member gear) 172 is provided so as to be coaxial with the rotational center 103*a* around which the arm 103 is rotatably supported by the apparatus body A. The gear 172 meshes with the gear portion 102*a*. Accordingly, the gear 172 and the gear portion 102*a* can be constantly held in the above-described meshing state irrespective of the swing motion of the arm 103.

The rotational center 103*a* coincides with an axial line of a shaft 172*a* that rotatably supports the gear 172. The shaft 172*a* is fixed to the body frame 171. Further, one end of the arm 103 is rotatably attached to the shaft 172*a*.

As described above, as illustrated in FIGS. 16A and 16B, FIGS. 18A and 18B, and FIGS. 19A and 19B, the elastic force (i.e., the urging force) of the spring 104 can be used to press the development roller 110-1 to the photosensitive drum 107. When the rotary C rotates from this state, the above-described pressed contact between the development roller 110-1 and the photosensitive drum 107 can be released. If the pressed contact state is released, the spring 104 resiliently urges the cam 101 against the roller 105. Thus, the cam 101 can surely contact the roller 105.

As described above, the outer cylindrical surface of the cam 101 can contact the roller 105 at respective contact portions 101*e* to 101*h*, i.e., the portions other than the separating portions (i.e., the recesses) 101*a* to 101*d*. In the state where the roller 105 contacts the contact portions 101*e* to 101*h*, the cartridges B1 to B4 cannot contact the photosensitive drum 107.

Therefore, the cartridges B1 to B4 can be successively moved to the development position without giving any adverse influence to the photosensitive drum 107. The contact portions 101*e* to 101*h* and the separating portions 101*a* to 101*d* are alternately disposed along the rotational direction of the cam 101 (i.e., the rotary C). Further, a distance L10 between the separating portions 101*a* to 101*d* and the rotational center 101*i* of the cam 101 is shorter than a distance L2 between the contact portions 101*e* to 101*h* and the rotational center 101*i* of the cam 101 (see FIGS. 18A, 18B, 19A, and 19B).

When the cartridge B1 (to B4) moves toward the development position DP, the rotational force transmission from the drive gear 172 is shut off by a controller (not illustrated) and the rotary C stops rotating. Then, the cartridge B1 reaches the development position DP. At the development position DP, the development roller 110-1 (-110-4) is pressed against the photosensitive drum 107. In this state, as illustrated in FIGS. 16A and 16B, the roller 105 is spaced from and faces the separating portion (i.e., the recess) 101*b* (-101*d*) of the cam 101.

More specifically, the separating portion 101*b* (-101*d*) and the roller 105 are held in a mutually separated state. While the above-described operation is repeated, the cartridges B1 to B4 can successively reach the development position DP. In the present exemplary embodiment, a clearance G (see FIG. 2) between the roller 105 and the bottom surface of the recess (i.e., the separating portion) 101*b* is approximately 1.5 mm.

As described above in the present exemplary embodiment, the rotary C is integrally formed with the cam 101 that includes the contact portions 101*e* to 101*h* and the separating portions 101*a* to 101*d*, and the roller 105 is provided on the apparatus body A. Therefore, the cartridges B1 to B4 can be moved in the circumferential direction by simply rotating the rotary C, and the cartridges B1 to B4 (i.e., the development rollers 110-1 to 110-4) can be brought into contact with or separated from the photosensitive drum 107.

An example operation of the coupling 150 is described below with reference to FIGS. 16A and 16B, FIGS. 18A and 18B, and FIGS. 19A and 19B.

When the cartridge B is located at the pre-development retracting position 18Z (see FIGS. 19A and 19B), the coupling 150 is held at the pre-engagement angular position by the elastic force of the spring 159 (the state illustrated in FIGS. 19A and 19B). In this case, as illustrated in FIG. 19B, the regulated portion 150*j* contacts the positioning portion 160*b*1 of the accommodating portion 160*b* so as to regulate the angular position of the coupling 150. Namely, the coupling 150 is held at the pre-engagement angular position (the state illustrated in FIGS. 19A and 19B).

In this state, the rotary C rotates in the direction indicated by the arrow X4 and the coupling 150 engages with the apparatus body side engaging portion in a process in which the cartridge B1 moves from the pre-development retracting position 18Z (see FIGS. 19A and 19B) to the development position DP (see FIGS. 16A and 16B). Then, the coupling 150 moves from the pre-engagement angular position (i.e., the state illustrated in FIGS. 19A and 19B) to the rotational force transmitting angular position (i.e., the state illustrated in FIGS. 16A and 16B).

When the cartridge B1 is positioned at the development position DP (see FIGS. 16A and 16B), the coupling 150 is located at the rotational force transmitting angular position where the coupling 150 engages with the apparatus body side engaging portion. Further, the coupling 150 receives rotational force transmitted from the drive shaft 180. In this case, as illustrated in FIG. 16B, the regulated portion 150*j* stays in the allowance portion 160*b*2 of the accommodating portion 160*b* without contacting a wall 163*b*3. Then, the coupling 150 is positioned when the coupling 150 engages with the apparatus body side engaging portion.

When the rotary C rotates in the direction indicated by the arrow X4 and engages with the apparatus body side engaging portion, the coupling 150 moves from the pre-engagement angular position to the rotational force transmitting angular position. In this case, the regulated portion 150*j* moves against the elastic force of the spring 159 toward the allowance portion 160*b*2 from the state where the regulated portion 150*j* contacts the positioning portion 160*b*1. Then, the regulated portion 150*j* is held in a state where the regulated portion 150*j* does not contact the wall 163*b*3 of the allowance portion 160*b*2.

Thus, the coupling 150 is brought into a substantially rotatable state from the state where the coupling 150 is positioned at the pre-engagement angular position.

The rotary C stops rotating in the state where the coupling 150 is engaged with the apparatus body side engaging portion. More specifically, at the timing when the rotary C reaches the development position DP, the coupling 150 engages with the apparatus body side engaging portion.

In the state illustrated in FIGS. 16A and 16B, the rotary C rotates in the direction indicated by the arrow X4. Then, in a process in which the cartridge B is moved from the development position DP (see FIGS. 16A and 16B) to the post-development retracting position 18Y (see FIGS. 18A and 18B), the coupling 150 moves from the rotational force transmitting angular position (see FIG. 16B) to the separating angular position (see FIG. 18B).

Correspondingly, the engagement between the coupling 150 and the apparatus body side engaging portion is released and the transmission of rotational force from the apparatus body side engaging portion to the coupling 150 is released. More specifically, the coupling 150 disengages from the apparatus body side engaging portion.

Immediately after the coupling 150 is separated from the apparatus body side engaging portion, the coupling 150 is held at the separating angular position (see FIGS. 18A and 18B). In this case, as illustrated in FIG. 18B, the regulated portion 150*j* stays in the allowance portion 160*b*2 of the accommodating portion 160*b* without contacting the wall 163*b*3.

If the coupling 150 held at the separating angular position reaches a position where the coupling 150 does not interfere with the drive shaft 180, the coupling 150 moves toward the pre-engagement angular position due to the function of the regulation member 160 and the spring 159.

Namely, the coupling 150 inclines toward the pre-engagement angular position. Then, as illustrated in FIG. 19B, the regulated portion 150*j* contacts the positioning portion 160*b*1 and the coupling 150 is held at the pre-engagement angular position.

While the rotary C rotates in the direction indicated by the arrow X4, the rotary C causes a swing motion in a direction perpendicular to the arrow X4 due to the above-described function of the cam 101 and the roller 105. Correspondingly, when the cartridge B moves from the pre-engagement angular position to the rotational force transmitting angular position, or when the cartridge B moves from the rotational force transmitting angular position to the separating angular position, the cartridge B not only moves in the rotational direction X4 of the rotary C but also moves in the swing direction of the rotary C.

In the present exemplary embodiment, similar to the cartridge B, the drive portion 150*b* of the coupling 150 causes a mixed motion as a combination of a movement in the circumferential direction X4 of the rotary C and a movement in the swing direction of the rotary C (i.e., a direction perpendicular to the direction X4). On the other hand, the driven portion 150*a* of the coupling 150 moves following the drive shaft 180. More specifically, the coupling 150 moves along a tilting orbit according to which the drive portion 150*b* serving as a tilting fulcrum does not link with the driven portion 150*a* serving as a tilting front end.

In this case, the regulated portion 150*j* regulating the tilting direction of the coupling 150 stays in the allowance portion 160*b*2. Accordingly, the regulated portion 150*j* can freely move around without contacting the wall 160*b*3. Namely, the coupling 150 is substantially rotatable. More specifically, the accommodating portion 160*b* has a shape that does not interfere with the tilting of the coupling 150 when the coupling 150 is not located on the pre-engagement angular position and regulates the tilt direction of the coupling 150 only when the coupling 150 is located on the pre-engagement angular position. Thus, the stress acting on the regulated portion 150*j* can be minimized.

As described above, according to the present exemplary embodiment, the rotational center 101*i* of the rotary C is swingable. Namely, even when the rotational center 101*i* of the rotary C is swingable, the cartridge B according to the present exemplary embodiment can surely engage the apparatus body side engaging portion with the coupling 150. Further, the cartridge B can surely disengage the apparatus body side engaging portion from the coupling 150.

As described above, the coupling 150 is rotatable (swingable) relative to the axial line L4 anywhere in the circumferential direction. More specifically, the coupling 150 is tiltable relative to the axial line L4 in substantially all directions.

In the present exemplary embodiment, the rotational movement of the coupling 150 does not means that the coupling itself does not rotate around the axial line L2 of the coupling 150. The rotational movement rather means that the inclined axial line L2 of the coupling 150 rotates around the axial line L4 (see FIG. 13F). However, the coupling itself may rotate around the axial line L2 within a range of a play or a provided clearance.

In the present exemplary embodiment, the axial line L2 is tiltable relative to the axial line L1 in all directions. However, it is not always required that the coupling 150 is linearly tiltable within a predetermined angle in all directions (i.e., 360°).

Further, the tiltable range in the context of the present exemplary embodiment indicates a range in which the coupling can move (incline) toward the rotational force transmitting angular position when a user attaches the cartridge B to the apparatus body A regardless of the phase of the stopped drive shaft having the rotational force giving portion.

Further, the tiltable according to the present exemplary embodiment indicates a range in which the coupling can move (incline) toward the separating angular position when a user detaches the cartridge B from the apparatus body A regardless of the phase of the stopped drive shaft.

Further, there is a clearance between the coupling 150 and the rotational force receiving surface (i.e., the rotational force receiving portion) 147*h* that engages with the pin (i.e., the rotational force transmitting portion) 155. Therefore, the coupling 150 can tilt relative to the axial line L4 in substantially all directions (see FIG. 8B).

Further, in the present exemplary embodiment, as described above, the engagement between the apparatus body side engaging portion and the coupling 150 is accomplished when the rotary C is rotating or immediately after the rotary C is stopped. Then, the development roller 110 is brought into a rotatable state or starts rotating.

More specifically, if the drive shaft 180 is already rotating before the coupling 150 starts engaging with the apparatus body side engaging portion, the coupling 150 starts rotating upon engaging with the apparatus body side engaging portion. Correspondingly, the development roller 110 starts rotating.

Further, if the apparatus body side engaging portion is in a stopped state, the coupling 150 is kept in a stopped state even when the engagement between the coupling 150 and the apparatus body side engaging portion is accomplished. Then, if the drive shaft 180 starts rotating, the coupling 150 starts rotating. Further, the development roller 110 starts rotating.

In any case, according to the present exemplary embodiment, it is unnecessary to move a body side rotational force transmitting member (e.g., a body side coupling) back and forth in the axial line direction thereof. Accordingly, the time required for the image formation (including the development) can be reduced. In the present exemplary embodiment, the drive shaft 180 is already rotating before the coupling 150 starts engaging the apparatus body side engaging portion. Accordingly, the image formation can be promptly started. Therefore, the time required for the image formation can be further reduced compared to the case where the drive shaft 180 is stopped.

Further, in the present exemplary embodiment, the coupling 150 can be disengaged from the apparatus body side engaging portion in a state where the apparatus body side engaging portion is rotating.

Accordingly, in the present exemplary embodiment, even when the drive shaft 180 is fixed to the apparatus body A and cannot move in a direction perpendicular to the rotational axis line thereof, the development roller 110 can be brought into contact with the photosensitive drum 107 in a state where the development roller 110 is rotating.

Further, even when the drive shaft 180 is in the above-described fixed state, the development roller 110 can be separated from the photosensitive drum 107 in a state where the development roller 110 is rotating. This is because the coupling 150 can receive driving force from the drive shaft 180 within a predetermined angular range (i.e., a rotational force transmittable angular range) with respect to the rotational force transmitting angular position (i.e., an angular position where the development roller 110 contacts the photosensitive drum 107). Thus, the present exemplary embodiment can reduce the load acting on the photosensitive drum 107 when the development roller 110 is brought into contact or separated from the photosensitive drum 107.

Further, in the present exemplary embodiment, it is unnecessary to stop the drive shaft 180 when the coupling 150 is engaged with or separated from the apparatus body side engaging portion.

More specifically, the coupling 150 according to the present exemplary embodiment can engage and disengage from the apparatus body side engaging portion even when the drive shaft 180 is rotating.

Then, in the present exemplary embodiment, the rotary C operates in the following manner. More specifically, the rotary C moves toward the photosensitive drum 107 along its swing direction to perform formation of a yellow image. Then, the rotary C moves away from the photosensitive drum 107 in the radial direction and stops rotation of the development roller 110.

The direction along which the rotary C moves toward the photosensitive drum 107 is the direction along which the development roller 110 is brought into contact with the photosensitive drum 107. Further, the direction along which the rotary C moves away from the photosensitive drum 107 is the direction along which the development roller 110 separates from the photosensitive drum 107. As soon as the rotary C starts rotating, the coupling 150 separates from the apparatus body side engaging portion and prepares for a second color development operation.

More specifically, in the present exemplary embodiment, the operations for engaging and separating the coupling 150 with and form the apparatus body side engaging portion can be performed according to the rotation of the rotary C. Accordingly, the time to be set between the first color development and the second color development can be reduced.

Similarly, the time to be set between the second color development and the third color development, the time to be set between the third color development and the fourth color development, the time to be set between the fourth color development and the home position, and the time to be set between the home position and the first color development can be reduced. As a result, the total time required to obtain a sheet of composite color image can be reduced.

In the present exemplary embodiment, the rotary C can be rotated in a direction opposite to the rotational direction X4.

More specifically, when the rotary C rotates in the direction opposite to the rotational direction X4 in the state illustrated in FIGS. 16A and 16B, the coupling 150 can disengage from the apparatus body side engaging portion in a process in which the cartridge B1 moves from the development position DP (see FIGS. 16A and 16B) to the pre-development retracting position 18Z (see FIGS. 19A and 19B).

More specifically, the coupling 150 can disengage from the apparatus body side engaging portion when the rotary C rotates in the opposite direction. In this case, the coupling 150 moves from the rotational force transmitting angular position to the pre-engagement angular position in a process in which the coupling 150 disengages from the apparatus body side engaging portion. Then, if the rotary C rotates in the rotational direction indicated by the arrow X4, the coupling 150 is brought into a state where the coupling 150 can engage with the apparatus body side engaging portion.

As described above, immediately before or when the cartridge B stops at a predetermined position of the apparatus body A, the coupling 150 engages with the apparatus body side engaging portion (i.e., the operation continuing from FIGS. 19A and 19B to FIGS. 16A and 16B). Then, the coupling 150 disengages from the apparatus body side engaging portion when the cartridge B moves from the predetermined position of the apparatus body A after a predetermined time of rotation (i.e., the operation continuing from FIGS. 16A and 16B to FIGS. 18A and 18B).

Next, an engaging operation (i.e., engagement between the coupling and the apparatus body side engaging portion), a rotational force transmission operation, and a separating operation, which can be performed by the coupling, are described below with reference to FIGS. 20A to 20D through FIGS. 24A and 24B.

FIGS. 20A to 20D are vertical cross-sectional views illustrating the drive shaft 180, the coupling 150, and the drive input gear 147. FIGS. 21A to 21D are vertical cross-sectional views illustrating example phase differences between the drive shaft 180 and the coupling 150. FIGS. 23A to 23D are vertical cross-sectional views illustrating the drive shaft 180, the coupling 150, and the drive input gear 147.

Figure 24A:
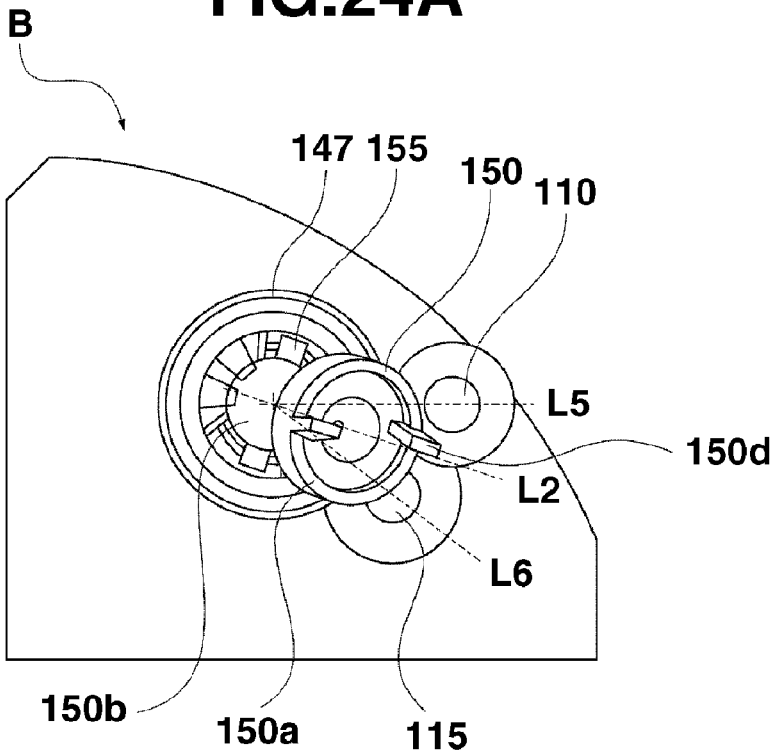
FIGS. 24A and 24B are vertical cross-sectional views illustrating the disengagement of the drive shaft from the rotational force transmitting member according to an exemplary embodiment of the present invention.
Figure 24B:
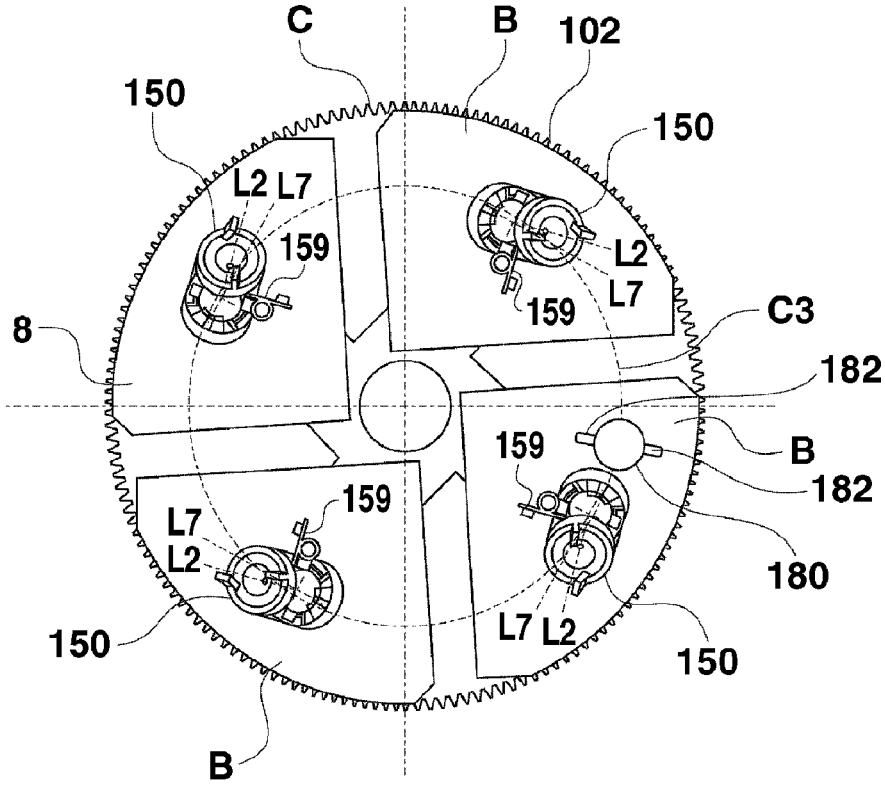

FIG. 24A is a front view illustrating the coupling 150, the development roller 110, and the developer supply roller 115, which are seen from the drive shaft (180) side when the coupling 150 is positioned at the pre-engagement angular position. FIG. 24B is a front view illustrating the coupling 150, the cartridge B, and the rotary C, seen from the drive shaft (180) side when the coupling 150 is positioned at the pre-engagement angular position.

In a process in which the cartridge B reaches the development position DP according to the rotation of the rotary C, the coupling 150 is located at the pre-engagement angular position. More specifically, the coupling 150 is resiliently urged beforehand by the spring (i.e., the urging member or the elastic member) 159 and the axial line L2 is kept in an inclined state relative to the axial line L4 of the drive input gear 147 so that the driven portion 150*a* is positioned on the downstream side in the rotational direction X4.

More specifically, at the pre-engagement angular position, the driven portion 150*a* is positioned on the downstream side of the drive portion 150*b* in the rotational direction X4. In the present exemplary embodiment, when the coupling 150 is located at the pre-engagement angular position, if seen from the drive shaft (180) side, the axial line L2 of the coupling 150 is positioned between a straight line L5 and a straight line L6 (see FIG. 24A).

In this case, the straight line L5 is a straight line passing through the center (i.e., the axial line L4) of the drive input gear 147 and the center (i.e., the axial line L1) of the development roller 110. Further, the straight line L6 is a straight line passing through the center of the drive input gear 147 and the center of the developer supply roller 115.

More specifically, the axial line L2 is positioned between the development roller 110 and the developer supply roller 115 (see FIG. 24A). Further, the axial line L2 is positioned on the downstream side in the rotational direction X4 of the rotary C relative to a tangential line L7 of a circle C3 that is coaxial with the rotary C and passes through the center of the drive portion 150*b*. Further, the axial line L2 faces outward with respect to the radial direction of the rotary C (see FIG. 24B).

A downstream side front end position 150A1 (in the rotational direction X4 of the rotary C) of the inclined coupling 150 is positioned close to the gear 147 in the direction of the axial line L4 compared to a front end 180*b*3 of the drive shaft 180. Further, in the rotational direction X4, an upstream side front end position 150A2 is positioned close to the pin 182 in the directions of the axial lines L3 and L4 compared to the front end 180*b*3 of the drive shaft 180 (see FIGS. 20A and 20B).

In the driven portion 150*a* illustrated in FIGS. 7A and 7C, the front end position 150A (150A1 and 150A2) is a position most separated from the drive portion 150*b* in the direction of the axial line L2 and is a position most separated in a direction perpendicular to the axial line L2. Namely, the front end position 150A can be an edge line of the driven portion 150*a* or an edge line of the driven protrusion 150*d*, which is dependent on the rotational phase of the coupling 150 (indicated by 150A in FIGS. 7A and 7C).

In the rotational direction (X4) of the rotary C, the downstream side front end position 150A1 passes through the front end 180*b*3. Then, after the coupling 150 passes through the drive shaft 180, the drive bearing surface 150*f* (having a conical shape) or the protrusion 150*d* of the coupling 150 contacts the front end portion 180*b* of the drive shaft 180 or the pin 182.

Figure 20C:
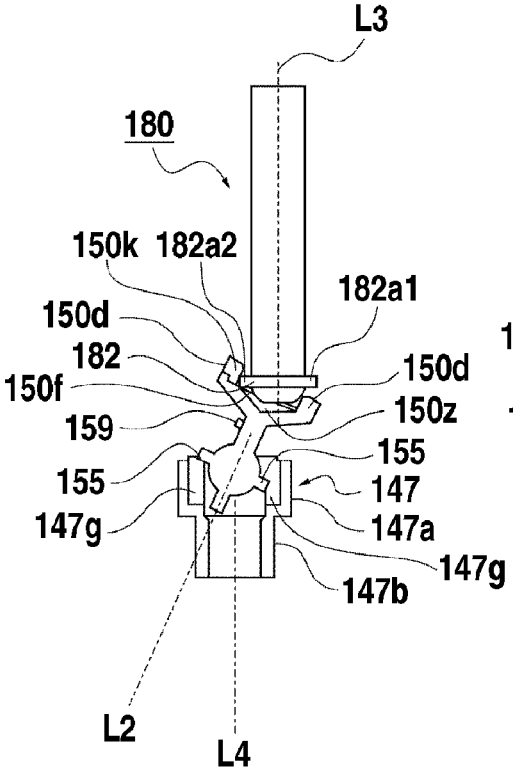

Then, the axial line L2 continuously inclines according to the rotation of the rotary C so that the axial line L2 becomes parallel to the axial lines L3 and L4 (see FIG. 20C). In this case, the rotary C temporarily stops rotating at the state illustrated in FIG. 20C. The coupling 150 is located at an intermediate position between the pre-engagement angular position and the rotational force transmitting angular position.

When the pin 182 contacts the protrusions 150*d* provided at two portions, the coupling 150 is located at an angular position where the coupling 150 can transmit rotational force. The drive shaft 180 rotates while the rotation of the rotary C is stopped. The pin 182 positioned in the ingressive portion 150*k* reduces the clearance relative to the protrusion 150*d*. A rotational phase difference between the coupling 150 and the drive shaft 180 may start the rotational force transmission from the drive shaft 180 to the coupling 150 when the rotation of the rotary C is stopped. Further, at latest, the rotational force transmission from the drive shaft 180 to the coupling 150 begins before the rotary C reaches a stop position illustrated in FIG. 20D.

Then, the position of the cartridge B relative to the apparatus body A is finally determined. More specifically, the rotary C stops rotating. In this case, the drive shaft 180 and the drive input gear 147 are positioned on substantially the same straight line (namely, the axial line L3 coincides with the axial line L4). More specifically, the coupling 150 moves (inclines or swings) from the pre-engagement angular position to the rotational force transmitting angular position, so as to allow its front end position 150A1 to detour the drive shaft 180.

Then, the coupling 150 rotates from the pre-engagement angular position toward the rotational force transmitting angular position where the axial line L2 substantially coincides with the axial lines L3 and L4. Then, the coupling 150 engages with the drive shaft 180 (see FIG. 20D). In other words, the recess 150*z* is overlapped with the front end portion 180*b*.

Thus, stable transmission of rotational force from the drive shaft 180 to the coupling 150 can be realized. Further, in this case, the pin 155 is positioned in the aperture 147*g*. The pin 182 is positioned in the ingressive portion 150*k*. In the present exemplary embodiment, the drive shaft 180 is already rotating when the coupling 150 starts engaging with the drive shaft 180. Therefore, the coupling 150 can immediately start rotating.

As described above, according to the present exemplary embodiment, in an attached state, the coupling 150 is tiltable relative to the axial line L4. More specifically, the coupling 150 is substantially rotatable with respect to the axial line L4 when the regulated portion 150*j* is positioned in the allowance portion 160*b*2. Accordingly, the coupling 150 inclines according to the rotation of the rotary C without interfering with the drive shaft 180 and can engage with the drive shaft 180.

Further, in the present exemplary embodiment, as described above, the drive shaft 180 is constantly rotating. Namely, in an engagement operation, the phase of the drive shaft 180 is constantly changing. The phase relationship between the drive shaft 180 and the coupling 150 is variable. Even in such a case, the above-described engagement operation of the coupling 150 is feasible regardless of the phase relationship between the drive shaft 180 and the coupling 150, as described below with reference to FIGS. 21A to 21D.

Figure 21A:
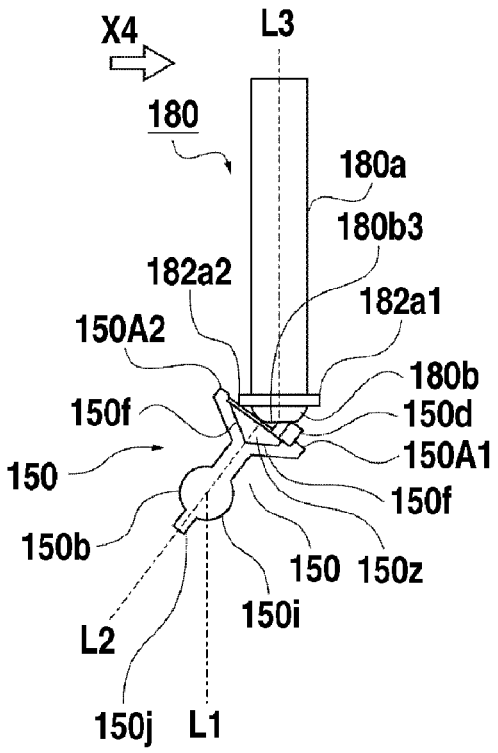
FIGS. 21A to 21D are vertical cross-sectional views illustrating an engagement state of the drive shaft and the rotational force transmitting member according to an exemplary embodiment of the present invention.
Figure 21B:
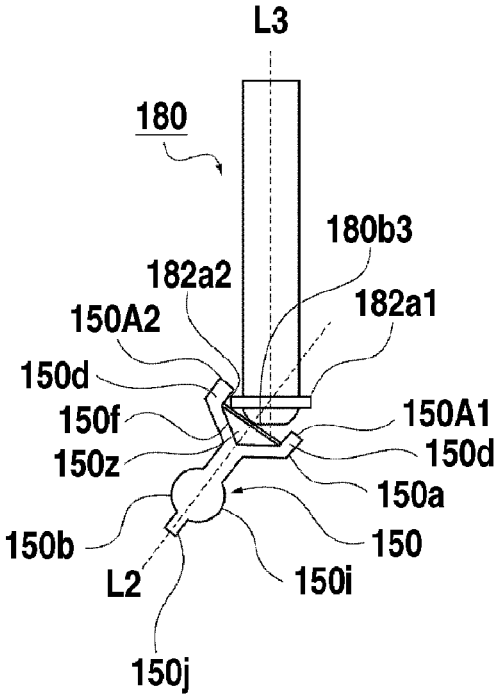
Figure 21C:
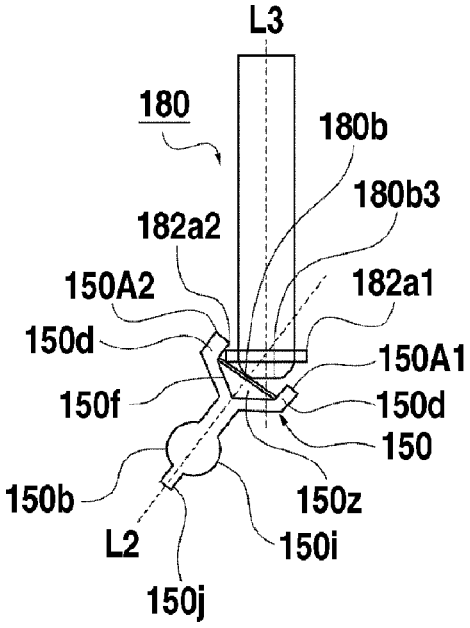
Figure 21D:
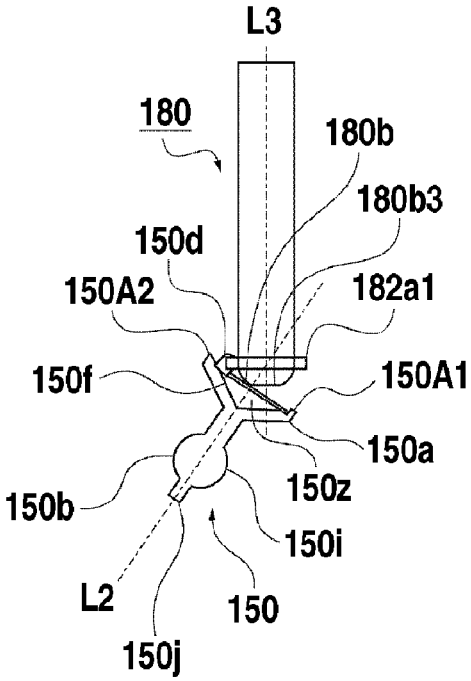

FIGS. 21A to 21D illustrate a phase relationship between the coupling 150 and the drive shaft 180. FIG. 21A illustrates a confronting relationship between the pin 182 and the drive bearing surface 150*f* positioned on the upstream side in the rotational direction X4 of the rotary C. FIG. 21B illustrates a confronting relationship between the pin 182 and the protrusion 150*d* of the coupling 150. FIG. 21C illustrates a confronting relationship between the front end portion 180*b* of the drive shaft 180 and the protrusion 150*d* of the coupling 150. FIG. 21D illustrates a confronting relationship between the front end portion 180*b* and the drive bearing surface 150*f*.

As illustrated in FIGS. 10A1 to 10A5 and 10B1 to 10B5, in an attached state, the coupling 150 is tiltable relative to the drive input gear 147 in all directions. More specifically, the coupling 150 is substantially rotatable. Therefore, as illustrated in FIGS. 21A to 21D, the coupling 150 is tiltable in the rotational (attaching) direction X4 regardless of the phase of the drive input gear 147.

Further, regardless of the phase relationship between the drive shaft 180 and the coupling 150, the downstream side front end position 150A1 (in the rotational direction X4 of the rotary C) is positioned close to the cartridge B (and on the downstream side in the rotational direction X4 of the rotary C) compared to the front end 180*b*3 of the drive shaft 180.

Further, the tilt angle of the coupling 150 is set in such a manner that the upstream side front end position 150A2 (in the rotational direction X4) is positioned close to the pin 182 compared to the front end 180*b*3 of the drive shaft 180. The above-described setting enables the downstream side front end position 150A1 (in the rotational direction X4) to pass through the front end 180*b*3 of the drive shaft 180 according to a rotational operation of the rotary C.

In the case illustrated in FIG. 21A, the drive bearing surface 150*f* contacts the pin 182. In the case illustrated in FIG. 21B, the protrusion 150*d* contacts the pin 182. In the case illustrated in FIG. 21C, the protrusion 150*d* contacts the front end portion 180*b*. In the case illustrated in FIG. 21D, the drive bearing surface 150*f* contacts the front end portion 180*b*.

Further, the contact force (i.e., the urging force), which is generated when the rotary C rotates, causes the axial line L2 to move toward a position where the axial line L2 coincides with the axial line L4. Then, the axial line L2 is finally aligned with the axial line L4. Accordingly, the axial line L2 and the axial line L4 can coincide with each other regardless of the phase relationship between the drive shaft 180 and the coupling 150 or the phase relationship between the coupling 150 and the drive input gear 147.

Next, an example rotational force transmission operation to be performed to rotate the development roller 110 is described below with reference to FIG. 22.

When the drive shaft 180 receives rotational force from a motor (not illustrated), the drive shaft 180 rotates together with a gear (i.e., a helical gear) 181 in the direction indicated by an arrow X8. Then, the pin 182 integral with the drive shaft 180 contacts the rotational force receiving surfaces 150*e*1 and 150*e*2 of the coupling 150 and rotates the coupling 150.

Further, as described above, the coupling 150 is connected to the development roller 110 via the drive input gear 147 so that the rotational force can be transmitted. Therefore, the rotational force of the coupling 150 is transmitted via the drive input gear 147 to the development gear 145 attached to the axial portion 110*b* of the development roller 110. Thus, the development roller 110 can be rotated.

Further, even if the axial line L3 slightly deviates from the axial line L4, when the coupling 150 slightly inclines, the coupling 150 can rotate without giving a large load on the development roller 110 and the drive shaft 180.

Next, an example disengagement of the coupling 150 from the drive shaft 180 according to the movement of the cartridge B from a predetermined position (i.e., the development position DP), when the rotary C rotates in one direction, is described below with reference to FIGS. 23A to 23D.

First, when the cartridge B moves from the predetermined position, each rotational force transmission pin takes the following position. At the timing when the image forming operation is completed, as apparent from the foregoing description, the pin 182 is positioned at the ingressive portion 150*k*. The pin 155 is positioned in the bore 150*g*.

Next, an example operation for disengaging the coupling 150 from the drive shaft 180, which is performed in association with an operation for switching to the next cartridge B after completing the image forming operation of the cartridge B (i.e., the operation continuing from FIGS. 16A and 16B to FIGS. 18A and 18B), is described below.

At the timing when the image forming operation is completed, the coupling 150 is located at the rotational force transmitting angular position. Namely, the axial line L2 is aligned with the axial line L4 (see FIG. 23A). Then, the gear 147 moves together with the cartridge B in the rotational direction X4.

Then, the drive bearing surface 150*f*, or the protrusion 150*d*, positioned on the upstream side in the rotational direction X4 contacts the front end portion 180*b* of the drive shaft 180 or the pin 182. Then, the axial line L2 starts inclining toward the upstream side of the rotational direction X4 (see FIG. 23B). The inclining direction of the axial line L2 in this case is opposite to the direction of the coupling 150 inclined when the coupling 150 engages with the drive shaft 180, with respect to the gear 147.

More specifically, the inclining direction is opposite to the direction of the pre-engagement angular position with respect to the axial line L4. The upstream side front end portion 150A2 (in the rotational direction X4) moves according to the rotational operation of the rotary C, while it contacts the front end portion 180*b* of the drive shaft 180. Then, as the separating angular position of the axial line L2, the upstream side front end portion 150A2 continuously inclines until it reaches the front end 180*b*3 (see FIG. 23C).

Figure 23A:
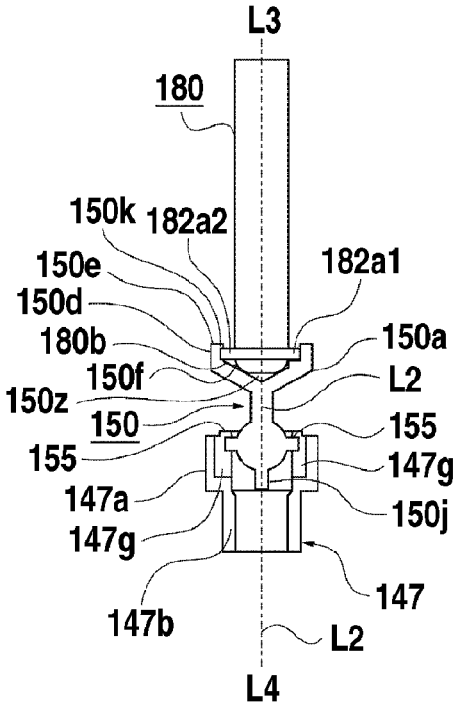
FIGS. 23A to 23D are vertical cross-sectional views illustrating an example disengagement of the drive shaft from the rotational force transmitting member according to an exemplary embodiment of the present invention.
Figure 23B:
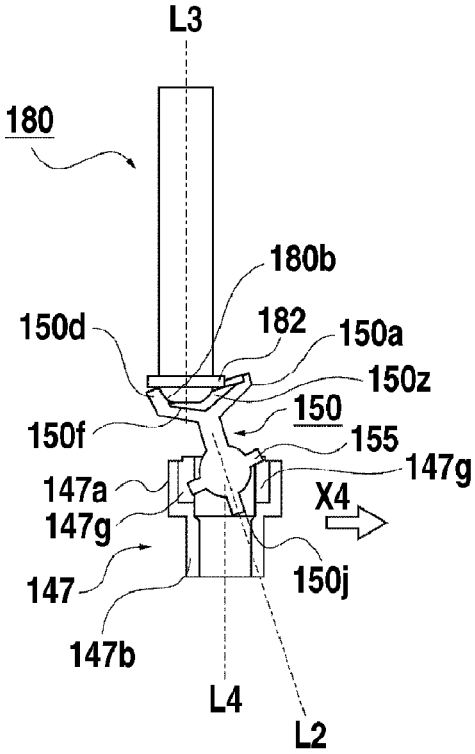
Figure 23C:
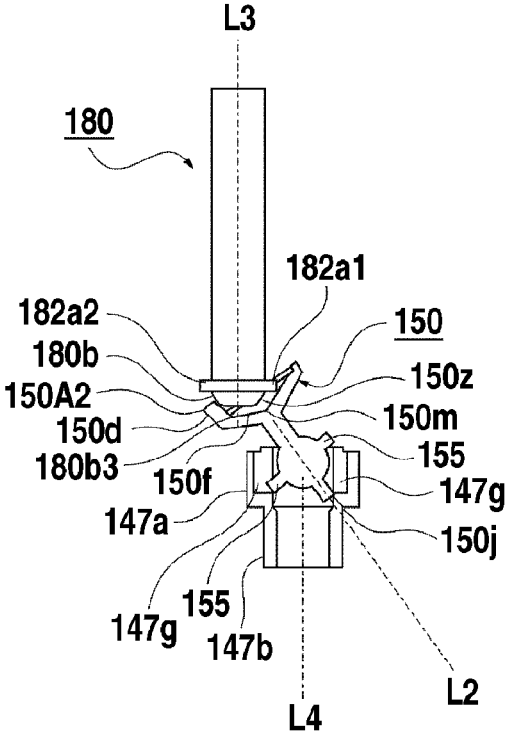
Figure 23D:
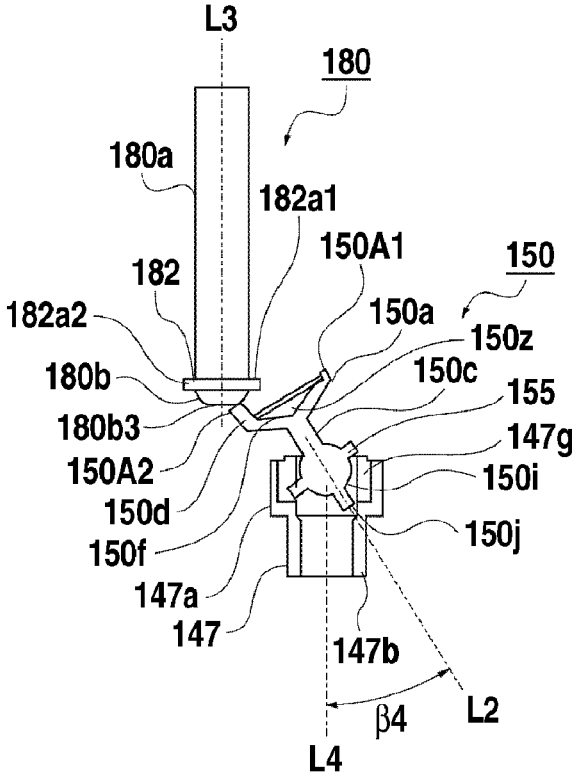

Then, in this state, the coupling 150 passes through the front end 180*b*3 while the coupling 150 contacts the front end 180*b*3 (see FIG. 23D). More specifically, the coupling 150 moves from the rotational force transmitting angular position to the separating angular position, so as to allow a part of the coupling 150 (i.e., the upstream side front end position 150A2) positioned on the upstream side of the drive shaft 180 in the rotational direction X4 to detour the drive shaft 180. Subsequently, the cartridge B moves to the state illustrated in FIGS. 18A and 18B according to the rotation of the rotary C.

Further, while the rotary C makes one complete revolution, the coupling 150 is pressed by the above-described urging member 159 and the axial line L2 of the coupling 150 inclines toward the downstream side in the rotational direction X4. More specifically, the coupling 150 moves from the separating angular position to the pre-engagement angular position. Thus, after the rotary C makes one complete revolution, the coupling 150 is brought into a state where the coupling 150 can engage with the drive shaft 180.

As apparent from the foregoing description, the angle of the coupling 150 relative to the axial line L4 at the pre-engagement angular position is greater than the angle at the separating angular position. This is because, in the engagement of the coupling 150, setting of the pre-engagement angular position is determined beforehand considering dimensional tolerances of respective parts so as to provide a long distance between the downstream side front end position 150A1 and the front end portion 180*b*3 of the drive shaft 180 in the rotational direction X4 (see FIG. 20B).

On the other hand, in the separation of the coupling 150, the axial line L2 inclines in association with the rotation of the rotary C (at the separating angular position). Therefore, in the rotational direction X4, the upstream side front end position 150A2 substantially coincides with the front end portion 180*b*3 of the drive shaft 180 in the direction of the axial lines L3 and L4 (see FIG. 23C).

An angle β2 between the axial line L2 and the axial line L4 at the engagement angular position (see FIG. 20A) and an angle β4 between the axial line L2 and the axial line L4 at the separating angular position (see FIG. 23D) are greater than an angle β1 between the axial line L2 and the axial line L3 at the rotational force transmitting angular position.

Figure 20D:
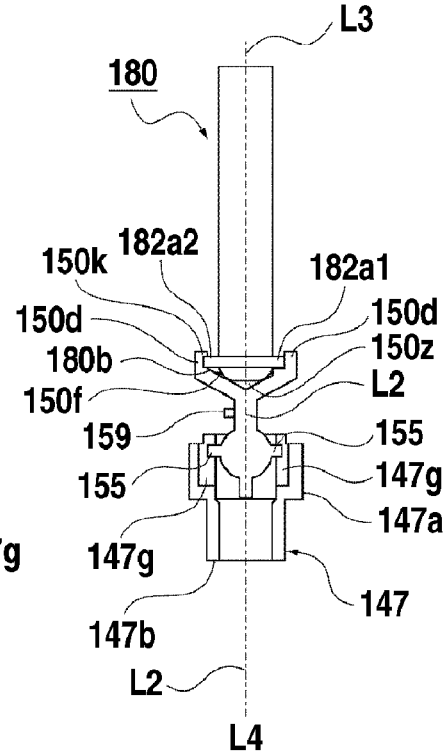

In this case, the angle β1 is an angle formed between the axial line L3 and the axial line L4 in FIG. 20D and FIG. 23A. It is desired that the angle β1 is equal to 0°. Further, it is desired that the angles β2 and β4 are in a range from 20° to 60°. If the angles β2 and β4 are the above-described "rotational force transmittable angular range", the angles β2 and β4 are set in a range from 20° to 60° with respect to the rotational force transmitting angular position. In the present exemplary embodiment, the inclining direction of the coupling 150 positioned at the pre-engagement angular position is somewhere between the rotational center of the development roller 110 and the rotational center of the developer supply roller 115.

Thus, even when the rotational center 101*i* of the rotary C is swingable, the coupling 150 can surely engage with the apparatus body side engaging portion.

Further, the cartridge B attached to the rotary C can move in a direction substantially perpendicular to the axial line L3 according to the rotation of the rotary C so that the apparatus body side engaging portion can selectively engage with and disengage from the coupling 150.

As described above, in an attached state, the coupling 150 is tiltable relative to the axial line L4 of the drive input gear 147. The coupling 150 inclines according to the rotation of the rotary C without interfering with the drive shaft 180. Thus, the coupling 150 can disengage from the apparatus body side engaging portion.

The increase in rotary drive torque when the coupling 150 disengages from the apparatus body side engaging portion is described below. The following is first and second factors [1] and [2] with respect to the increase in rotary drive torque.

[1] First Factor with Respect to Increase in Rotary Drive Torque

First, the first factor with respect to the increase in rotary drive torque in the separation of the coupling 150 is described below with reference to FIGS. 25A to 25D and FIGS. 26A to 26D. It is now assumed that the straight line L5 is parallel to the rotational force receiving surface 150*e* (150*e*1 and 150*e*2) and is perpendicular to the rotational axis line L2 of the coupling 150.

Figure 25A:
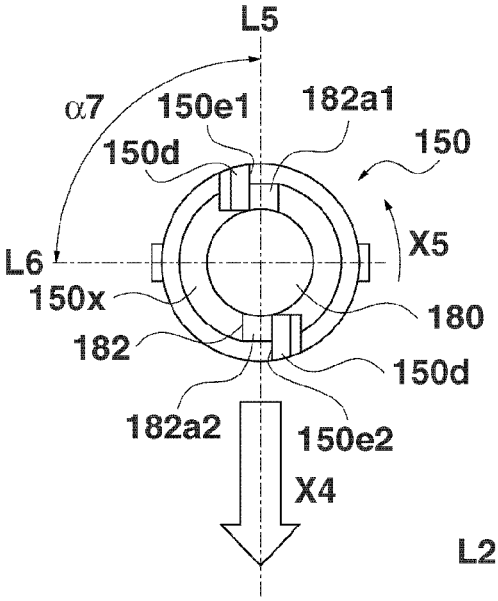
FIGS. 25A to 25D are side views illustrating a conventional rotational force transmitting member.
Figure 25B:
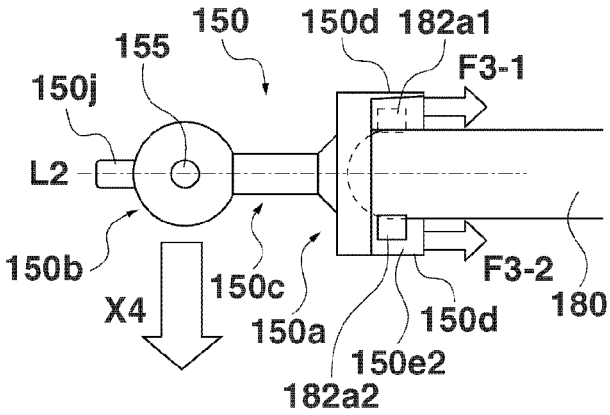

FIG. 25A and FIG. 25B illustrate the coupling 150 located at the rotational force transmitting angular position and engaged with the apparatus body side engaging portion, which are seen from the apparatus body side and a direction perpendicular to the rotational axis line L2 of the coupling 150, respectively.

Figure 25C:
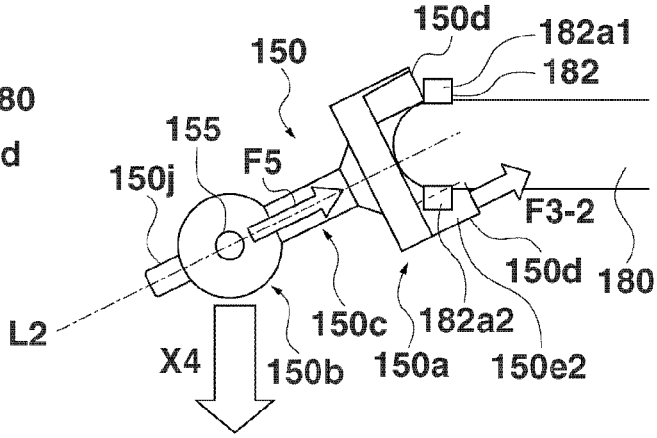

FIG. 25C illustrates the coupling 150 having moved in the direction indicated by the arrow X4 (i.e., the rotational direction of the rotary) from the state illustrated in FIG. 25B, in which the coupling 150 is located at an intermediate inclined angular position between the rotational force transmitting angular position and the separating angular position.

Figure 25D:
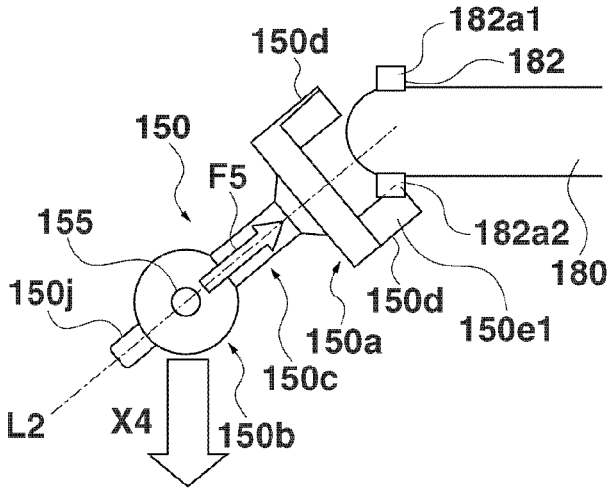

FIG. 25D illustrates the coupling 150 having further moved in the direction indicated by the arrow X4 from the state illustrated in FIG. 25C, in which the coupling 150 is located at the separating angular position and disengages from the apparatus body side engaging portion.

FIGS. 26A to 26D illustrate the coupling 150 having rotated approximately 120° around the rotational axis line L2 of the coupling 150 in the direction indicated by an arrow X5 from the states illustrated in FIGS. 25A to 25D, respectively. The direction indicated by the arrow X5 is the direction along which the coupling 150 is driven and transmitted. Illustrations of FIGS. 26A to 26D are similar to those of FIGS. 25A to 25D and represent a sequential movement of the coupling 150 relative to the apparatus body side engaging portion from the engaged state to the disengaged state.

The coupling 150 moves in the direction indicated by the arrow X4 (i.e., the rotational direction of the rotary) from the state illustrated in FIGS. 25A and 25B and disengages from the apparatus body side engaging portion. In this case, the coupling 150 moves from the rotational force transmitting angular position to the separating angular position, and the pin 182 (182*a*1 and 182*a*2) separates from the rotational force receiving surface 150*e* (150*e*1 and 150*e*2).

In this case, the component force F3 (see FIG. 7G) is generated between the rotational force receiving surface 150*e* and the pin 182. Therefore, a separating force F5 acts on the stopper portion 150*i* of the coupling 150. When the coupling 150 moves in the direction indicated by the arrow X4 according to the rotation of the rotary C, the separating force F5 of the coupling 150 acts on the rotary C. The rotary C can be rotated with an increased drive torque. In other words, the drive torque of the rotary C for transmitting the separating force F5 to the coupling 150 is variable depending to the magnitude of the separating force F5.

The above-described separating force F5 is variable depending on a rotational phase a6 of the straight line L5 relative to the movement direction X4 of the coupling 150 (i.e., the rotational direction of the rotary) around the rotational axis line L2 of the coupling 150. The straight line L5 is parallel to the rotational force receiving surface 150*e* and perpendicular to the rotational axis line L2 of the coupling 150.

The rotational phase a6 is a positive value defined in the driving and transmitting direction of the coupling 150 (see FIGS. 26A to 26D). For example, as illustrated in FIG. 25A, it is assumed that the rotational phase $\alpha 6$ is 0 (i.e., $\alpha 6=0°$). In this case, the movement direction X4 is parallel to the line L5. First, when the coupling 150 moves from the rotational force transmitting angular position to the separating angular position, the pin 182*a*1 disengages from the rotational force receiving surface 150*e*1 (see FIG. 25C).

The separating force F5 at this moment is equal to a component force F3-1 illustrated in FIG. 25B. Next, the rotational force receiving surface 150*e*2 separates from the pin 182*a*2 (see FIG. 25C). The separating force F5 at this moment is equal to a component force F3-2 illustrated in FIG. 25C. Therefore, in this case, the required force F5 in the separation of the coupling 150 is constantly equal to the component force F3 (F3-1 and F3-2) during a time interval from the separation start timing to the separation end timing.

Next, as illustrated in FIGS. 26A to 26D, it is assumed that the angle $\alpha 5$ between the rotational force receiving surface 150*e* and the flat portion 150*x* is approximately 10° (see FIG. 7C) and the rotational phase $\alpha 6$ is in a range from approximately 90° to 150°. In this case, even when the coupling 150 moves from the rotational force transmitting angular position to the separating angular position, an engaging amount between the rotational force receiving surface 150*e*1 and the pin 182*a*1 is substantially equal to an engaging amount between the rotational force receiving surface 150*e*2 and the pin 182*a*2.

Figure 26B:
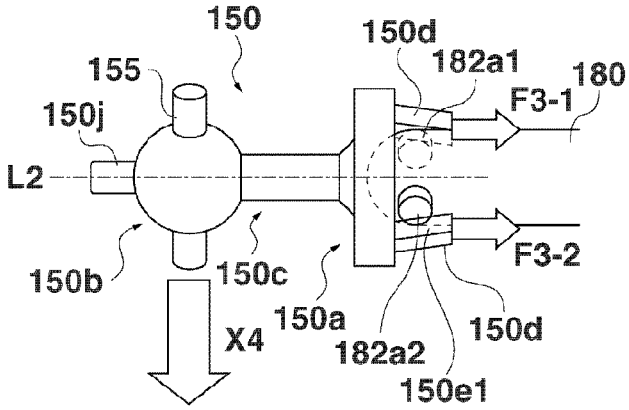
FIGS. 26A to 26D are front views illustrating the conventional rotational force transmitting member.
Figure 26A:
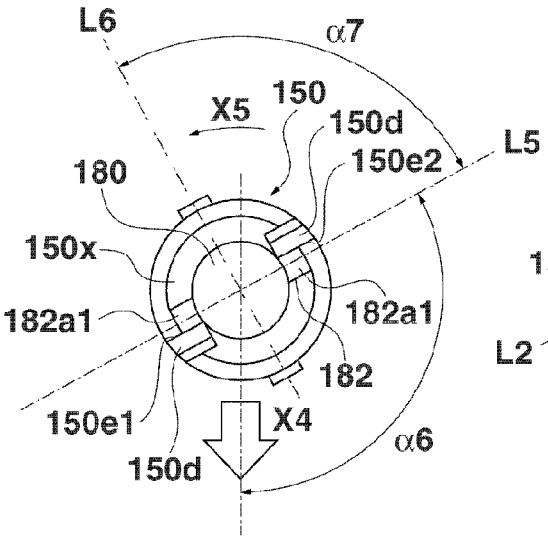
Figure 26C:
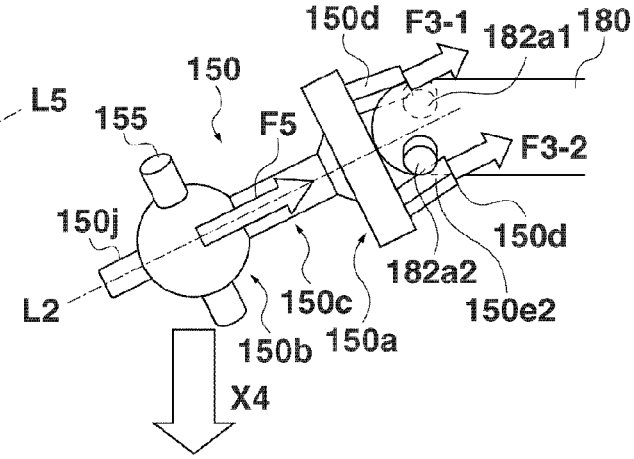
Figure 26D:
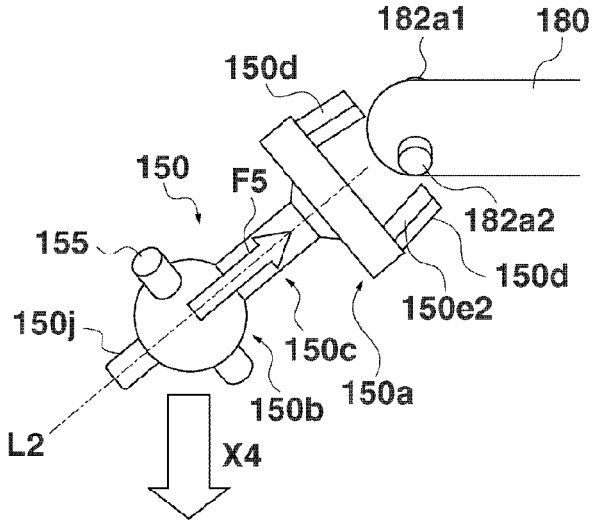

Therefore, the coupling rotational force receiving surfaces 150*e*1 and 150*e*2 can simultaneously disengage from the pins 182*a*1 and 182*a*2 (see FIGS. 26C and 26D). Therefore, the required force F5 in the separation of the coupling 150 is equal to a sum of the component forces F3-1 and F3-2 illustrated in FIG. 26C. More specifically, the required force F5 in the separation of the coupling 150 is equal to two times the component force F3.

As described above, the separating force F5 required for the rotary C to pull the coupling 150 becomes larger when the rotational phase a6 is in a range from approximately 90° to 150°. In the state illustrated in FIG. 26A, the rotational phase is approximately 120° and therefore the separating force F5 becomes larger as described above.

As described above, when the coupling 150 moves in the direction indicated by the arrow X4 according to the rotation of the rotary C, the separating force F5 of the coupling 150 acts on the rotary C. Therefore, when the separating force F5 becomes larger, the drive torque of the rotary C becomes larger.

[2] Second Factor with Respect to Increase in Rotary Drive Torque

Next, the second factor with respect to the increase in rotary drive torque in the separation of the coupling 150 is described below with reference to FIGS. 27A to 27F. In the disengagement of the coupling 150 from the apparatus body side engaging portion, the rotary drive torque increases according to the movement of the coupling 150 from the rotational force transmitting angular position to the separating angular position.

In the following description, only the case where the rotary drive torque becomes larger, as partly described in [1], is discussed. More specifically, the rotational phase a6 is in a range from approximately 90° to 150°. Especially, as an example case, it is assumed that rotational phase a6 is equal to approximately 120° (see FIG. 26A and FIG. 27B). Further, to simplify the description, the apparatus body side engaging portion is not illustrated.

Figure 27A:
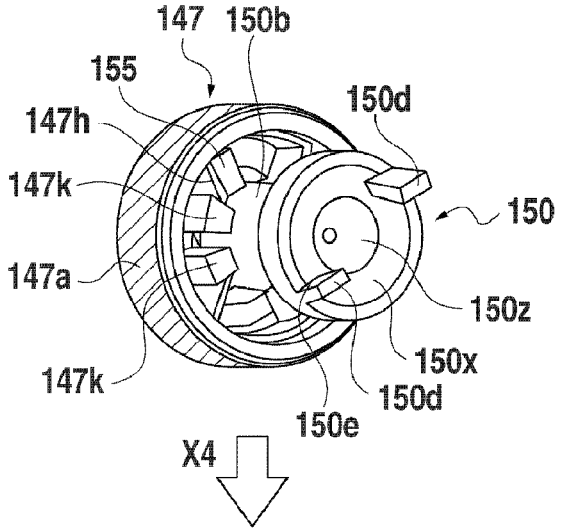
FIGS. 27A to 27F are front views illustrating the conventional rotational force transmitting member.
Figure 27B:
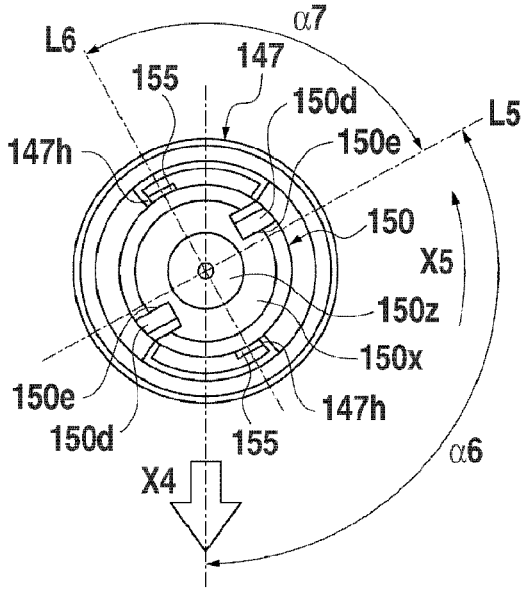

FIG. 27A illustrates the coupling 150 and the drive input gear 147 at the rotational force transmitting angular position, which is seen from the apparatus body side. FIG. 27B illustrates the coupling 150 and the drive input gear 147 at the rotational force transmitting angular position, which is seen from the direction of the rotational axis line L2 of the coupling 150.

Figure 27C:
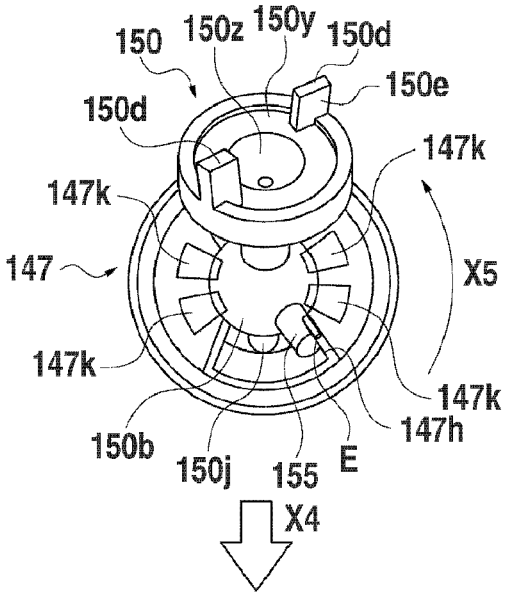
Figure 27D:
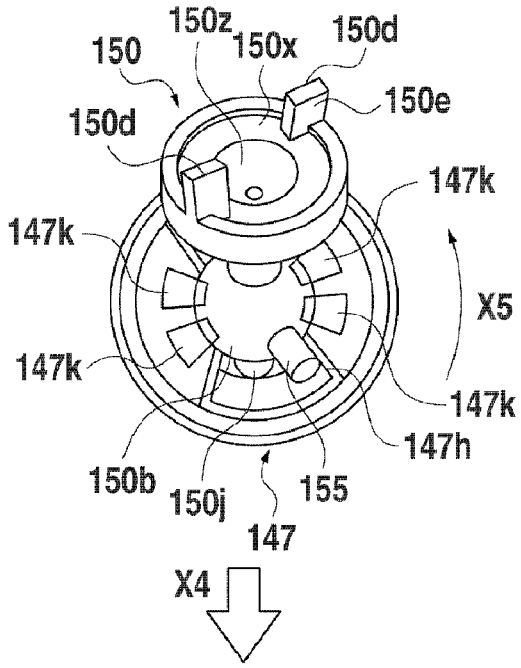

FIG. 27C illustrates the coupling 150 and the drive input gear 147 having moved from the state illustrated in FIG. 27B in the rotational direction X4 of the rotary, in which the coupling 150 is located at the separating angular position. FIG. 27D illustrates the drive input gear 147 having rotated from the state illustrated in FIG. 27C in the direction indicated by the arrow X5 (i.e., the driving and transmitting direction of the coupling 150).

Figure 27E:
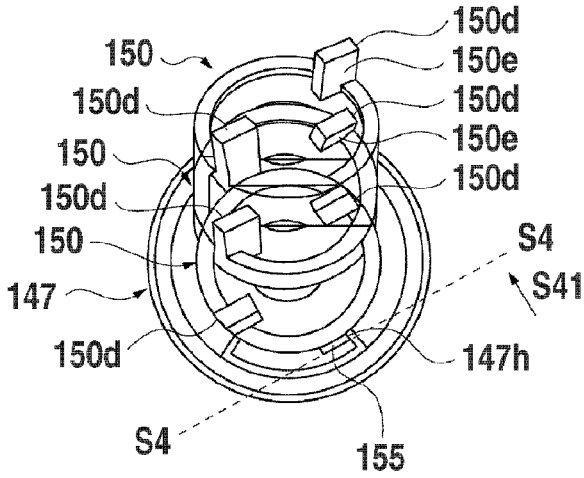
Figure 27F:
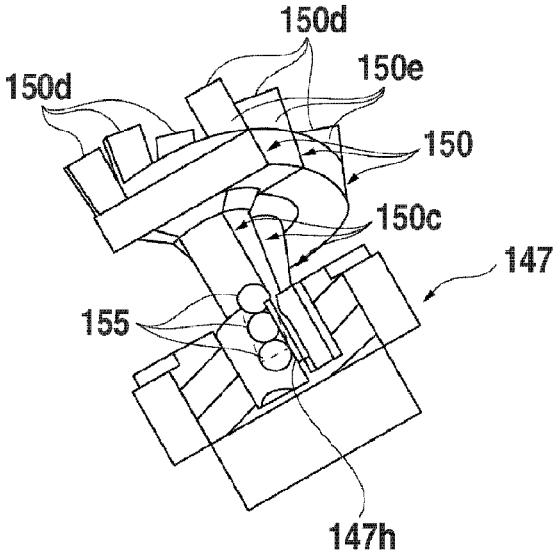

FIG. 27E indicates overlapped illustrations of the coupling 150 located at three angular positions, more specifically at the rotational force transmitting angular position, at the separating angular position, and at an intermediate position between the rotational force transmitting angular position and the separating angular position, which are seen from the direction of the rotational axis line L4 of the drive input gear 147. FIG. 27F is a cross-sectional view illustrating the coupling 150 and the drive input gear 147 taken along a line S4 illustrated in FIG. 27E, which is seen from the direction of an arrow S41.

The coupling 150 moves from the state where driving force is transmitted from the drive shaft 180 (see FIGS. 27A and 27B) in the direction indicated by the arrow X4 (i.e., the rotational direction of the rotary) and disengages from the drive shaft 182 (see FIGS. 27C and 27D). As described above, when the coupling 150 moves in the direction indicated by the arrow X4, the coupling 150 shifts from the rotational force transmitting angular position to the separating angular position.

In this case, when the coupling 150 shifts from the rotational force transmitting angular position to the separating angular position, the rotational force transmission pin 155 of the coupling 150 moves in a direction approaching the rotational force receiving surface 147*h* of the gear 147 (indicated by a slant line E in FIG. 27C).

In this case, the coupling 150 moves along a locus illustrated in FIGS. 27E and 27F to shift from the rotational force transmitting angular position to the separating angular position. The gear 147 rotates in the direction indicated by the arrow X5 according to an approaching amount of the rotational force transmission pin 155 toward the rotational force receiving surface 147*h*, until it reaches a position where the rotational force transmission pin 155 does not interfere with the rotational force receiving surface 147*h* (see FIG. 27D).

Namely, the drive input gear 147 rotates in the direction indicated by the arrow X5 according to the movement of the coupling 150 from the rotational force transmitting angular position to the separating angular position. More specifically, when the coupling 150 is located at the rotational force transmitting angular position, the coupling 150 and the drive input gear 147 rotate at the same speed.

However, when the coupling 150 moves toward the separating angular position, the rotational speed of the drive input gear 147 becomes higher than the rotational speed of the coupling 150. Namely, the rotational speed of the drive input gear 147 is increased compared to that of the coupling 150. The increase in the rotational speed is caused by the movement of the coupling 150 from the rotational force transmitting angular position to the separating angular position.

Further, the movement of the inclined angular position is caused by the movement of the coupling 150 toward the direction indicated by the arrow X4, namely by the rotation of the rotary. The drive input gear 147 can be accelerated by the rotation of the rotary. More specifically, the rotary drive torque gives force required to accelerate the gear 147. More specifically, the torque required to accelerate the drive input gear 147 can increase the drive torque of the rotary.

Next, an example change of the rotary drive sequence, which is dependent on the internal body temperature of the electrophotographic image forming apparatus, is described below with reference to FIG. 28 through FIGS. 30A and 30B. In the present exemplary embodiment, the rotary drive sequence indicates a temporal change in the rotational speed of the rotary C.

Figure 28:
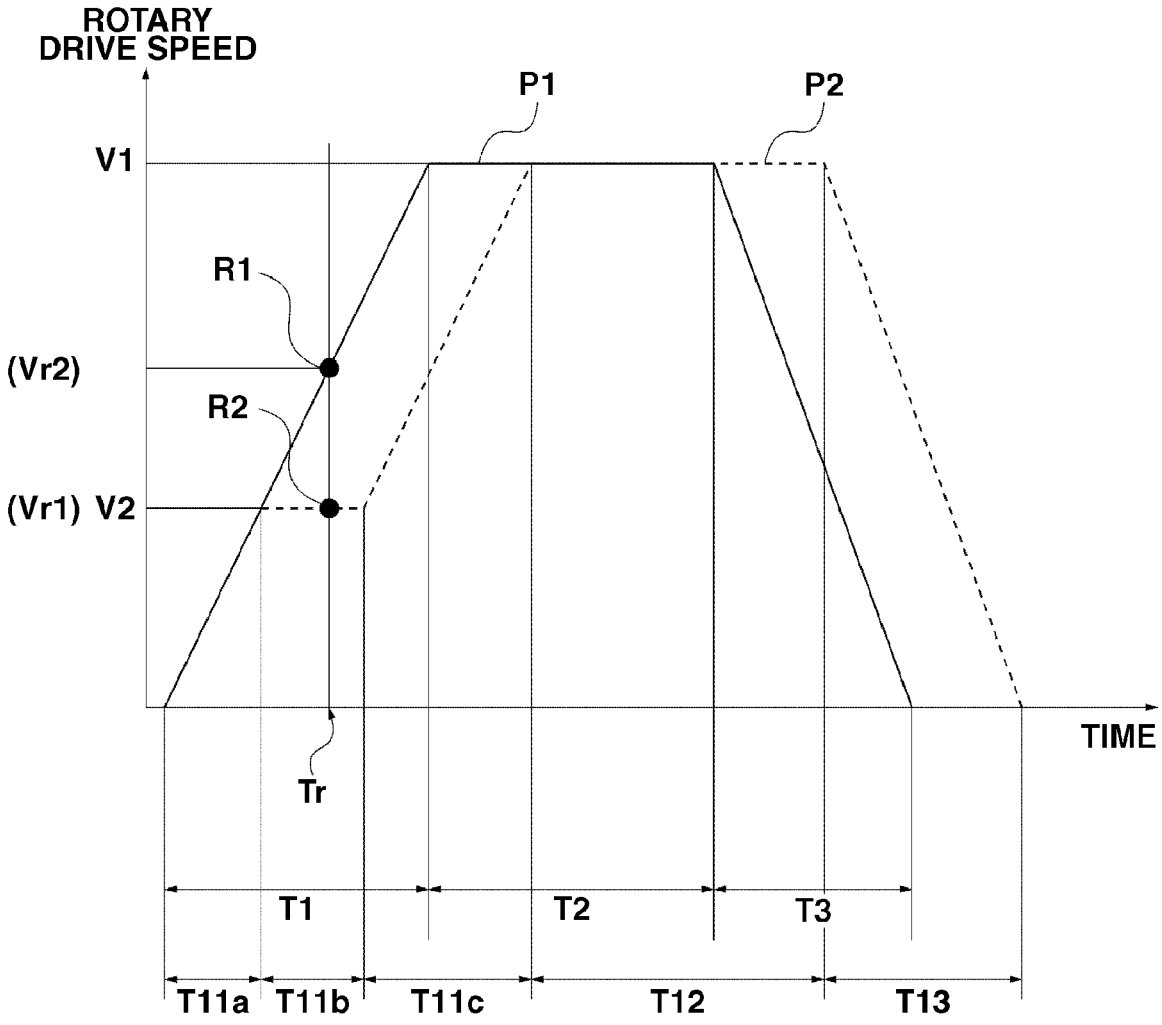
FIG. 28 is a graph illustrating rotary drive sequences according to an exemplary embodiment of the present invention.

FIG. 28 illustrates a rotary drive sequence employable in a low-temperature environment and a rotary drive sequence employable in an environment other than the low-temperature environment. In FIG. 28, the abscissa axis represents the time and the ordinate axis represents the rotary drive speed. The rotary drive sequence other than the low-temperature environment (hereinafter, referred to as an "ordinary sequence") is expressed by a sequence P1.

The rotary drive sequence in the low-temperature environment (hereinafter, referred to as a "low-temperature sequence") is expressed by a sequence P2. Further, time Tr indicates the timing when the coupling 150 disengages from the apparatus body side engaging portion. A vertical line passing through the time Tr intersects with the ordinary sequence P1 and the low-temperature sequence P2 at a point R1 and a point R2, respectively.

Figure 29A:
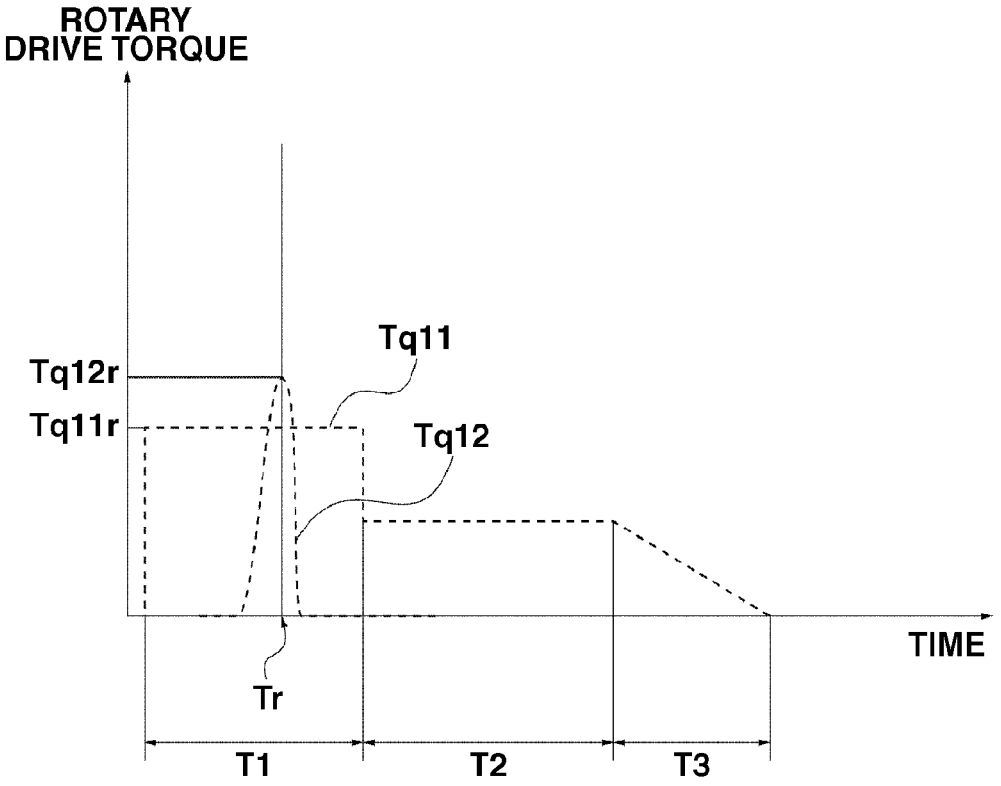
FIGS. 29A and 29B are graphs illustrating temporal variations in rotary drive torque according to an exemplary embodiment of the present invention.
Figure 29B:
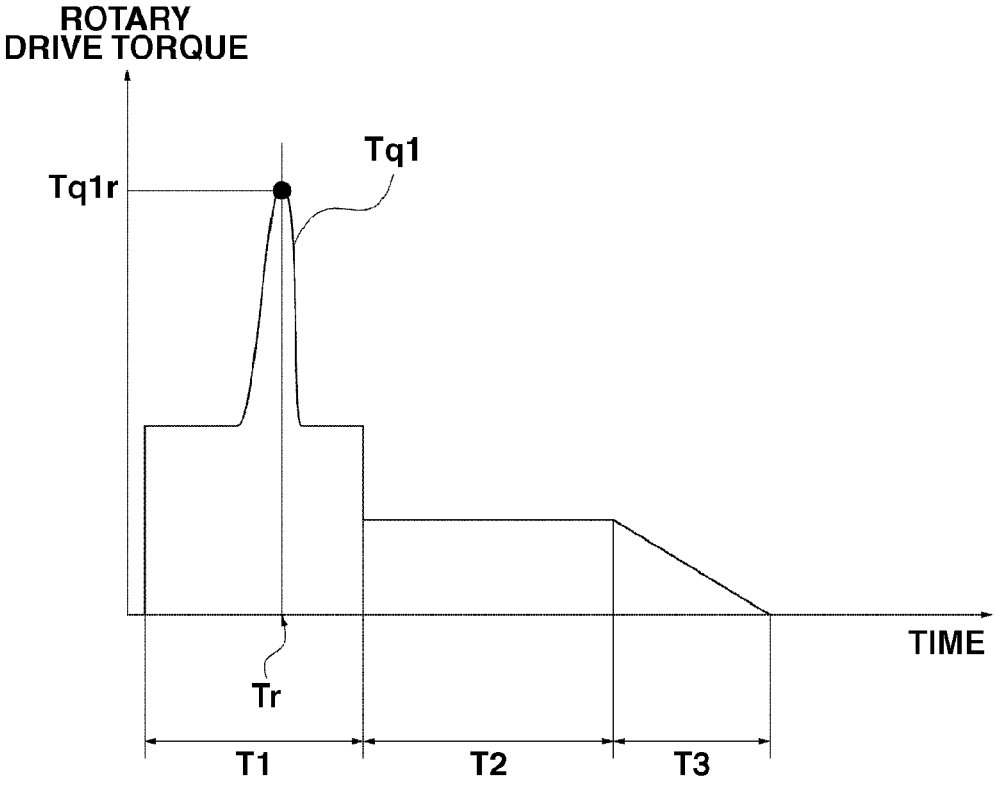
Figure 30A:
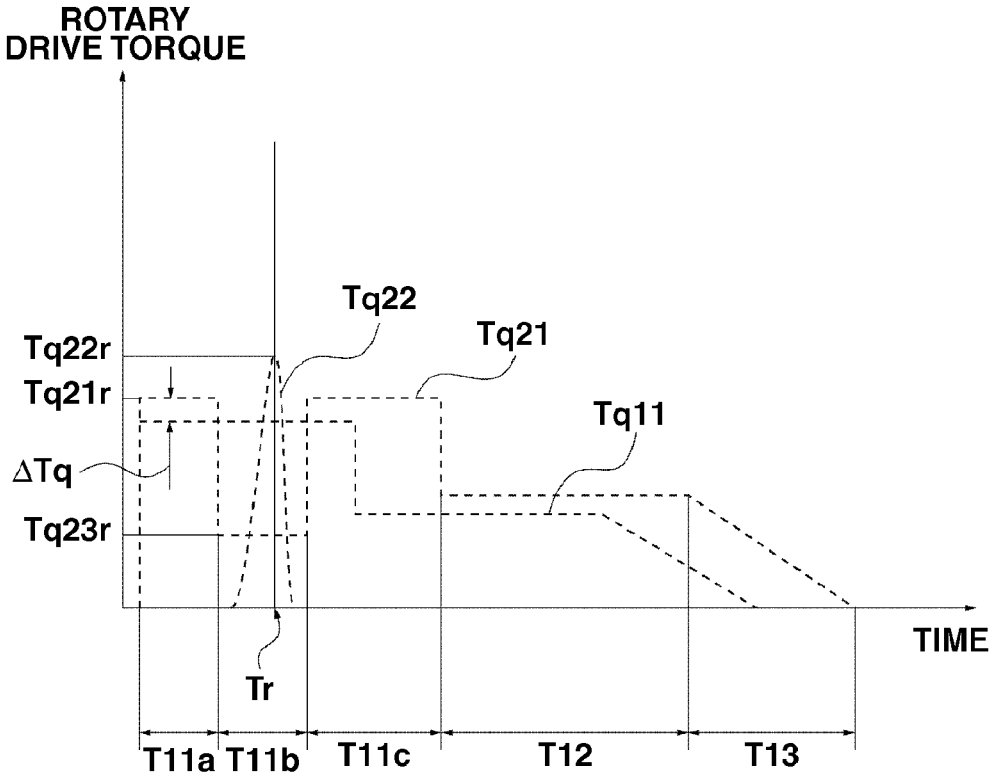
FIGS. 30A and 30B are graphs illustrating temporal variations in rotary drive torque according to an exemplary embodiment of the present invention.
Figure 30B:
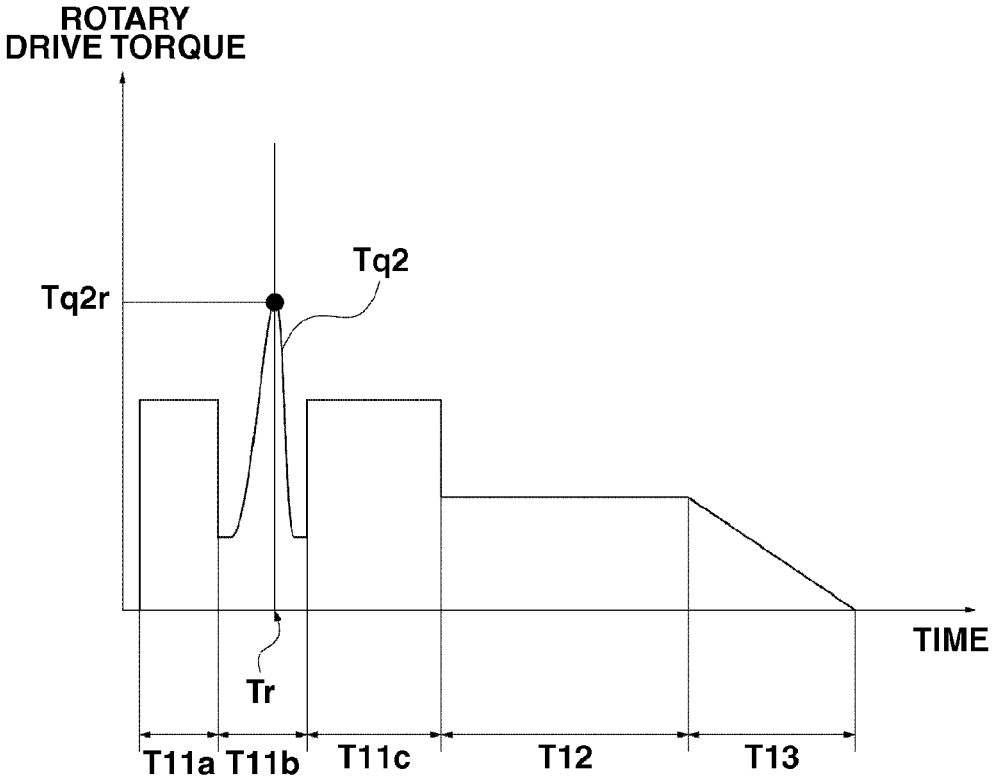

FIGS. 29A and 29B illustrate temporal changes of the rotary drive torque in the ordinary sequence P1. FIGS. 30A and 30B illustrate temporal changes of the rotary drive torque in the low-temperature sequence P2. The abscissa axis represents the time and the ordinate axis represents the rotary drive torque. Hereinafter, torque curves illustrated in FIG. 29A and FIG. 30A are described in detail.

First, a torque curve Tq11 represents a temporal change of the rotary drive torque in the ordinary sequence P1, in which the disengagement of the coupling is not taken into consideration. Further, a torque curve Tq21 represents a temporal change of the rotary drive torque in the low-temperature sequence P2, in which the disengagement of the coupling is not taken into consideration.

On the other hand, a torque curve Tq12 represents a temporal change of the rotary drive torque in the ordinary sequence P1, in which only the disengagement of the coupling is taken into consideration. Further, a torque curve Tq22 represents a temporal change of the rotary drive torque in the low-temperature sequence P2, in which only the disengagement of the coupling is taken into consideration.

In FIG. 29B, a torque curve Tq1 represents a temporal change of the rotary drive torque, which is obtained by adding the torque curves Tq11 and Tq12. In FIG. 30B, a torque curve Tq2 represents a temporal change of the rotary drive torque, which is obtained by adding the torque curves Tq21 and Tq22.

The rotary drive sequence is switchable between the ordinary sequence P1 and the low-temperature sequence P2 according to the internal body temperature of the electrophotographic image forming apparatus. First, according to an example switching method, a temperature detection unit 203 (i.e., a temperature detection sensor) provided in the apparatus body A detects the internal body temperature of the electrophotographic image forming apparatus.

If the detected internal body temperature is higher than an arbitrary setting temperature, the ordinary sequence P1 is selected and employed by a drive control unit 201 (i.e., a controller) that can control a rotary drive motor 202. The driving force from the rotary drive motor 202 is first transmitted to the first driving force transmission member 172 and then transmitted to the movable member C (i.e., the rotary).

If the detected internal body temperature is equal to or less than the arbitrary setting temperature, the low-temperature sequence P2 is selected and employed. Further, when the rotary C is driven according to the rotary drive sequence, the rotary C rotates by an angle required to move from a state where a certain cartridge is located at the development position to a state where the next cartridge is positioned at the development position during a time interval between the start and the end of the rotary drive sequence. The angle required in this case is constant regardless of the content of the rotary drive sequence.

According to the ordinary sequence P1, the rotary C accelerates from 0 to a predetermined speed V1 during a first time interval of T1 and continuously rotates at the predetermined speed V1 during a second time interval of T2, and then decelerates from the predetermined speed V1 to 0 during a third time interval of T3. The coupling 150 disengages from the apparatus body side engaging portion during the time interval T1, i.e., during the acceleration of the rotary (see the point R1 illustrated in FIG. 28).

On the other hand, according to the low-temperature sequence P2, the rotary C accelerates from 0 to a predetermined speed V2 during a first time interval of T11*a* and continuously rotates at the predetermined speed V2 during a second time interval of T11*b*. Then, the rotary C again accelerates from the predetermined speed V2 to the predetermined speed V1 during a third time interval of T11*c* and continuously rotates at the predetermined speed V1 during a fourth time interval of T12. Finally, the rotary C decelerates from the predetermined speed V1 to 0 during a fifth time interval of T13.

The predetermined speed V1 is higher than the predetermined speed V2. The coupling 150 disengages from the apparatus body side engaging portion during the time interval T11*b*, i.e., during the constant speed rotation of the rotary (see the point R2 illustrated in FIG. 28).

The rotary drive torque at the timing Tr when the coupling 150 disengages from the apparatus body side engaging portion is described below considering the ordinary sequence P1. First, the rotary C accelerates as described above. Therefore, the rotary drive torque increases by an amount equivalent to an acceleration torque (i.e., a torque required in acceleration) Tq11*r*.

Further, the rotary drive torque increases by an amount equivalent to a separating torque Tq12*r* as described above when the coupling 150 disengages from the apparatus body side engaging portion during the time interval T1 (i.e., during the acceleration of the rotary). Namely, in an environment other than the low-temperature environment, when the coupling 150 disengages from the apparatus body side engaging portion, the increase of the rotary drive torque appears at two phases, i.e., when the coupling 150 disengages from the apparatus body side engaging portion and when the rotary accelerates. More specifically, the rotary drive torque increases up to a separation torque Tq1*r*, which is equal to a sum of the acceleration torque Tq11*r* and the separating torque Tq12*r*.

Next, the rotary drive torque at the timing Tr when the coupling 150 disengages from the apparatus body side engaging portion is described below considering the low-temperature sequence P2. First, in the low-temperature environment, as described above, a body side support portion engaging with a sliding portion of a movable member shrinks and the viscosity of grease to be used to lower the contact resistance between the sliding portion and the support portion decreases. Therefore, the movable member is subjected to a larger resistance force. Due to the above-described causes, the rotary drive torque increases by an amount indicated by a low-temperature torque increase ΔTq.

Further, the rotary drive torque increases by an amount indicated by a separating torque Tq22*r* as described above when the coupling 150 disengages from the apparatus body side engaging portion. Accordingly, in the low-temperature environment, when the coupling 150 disengages from the apparatus body side engaging portion, the movable member is subjected to a larger resistance force due to the separating operation itself, the shrinkage of the body side support portion engaging with the sliding portion of the movable member, and the reduction in viscosity of the grease to be used to lower the contact resistance between the sliding portion and the support portion.

The rotary drive torque increases by the above-described two factors. More specifically, the rotary drive torque increases up to a separation torque Tq2*r*, which is equal to a sum of the low-temperature torque increase ΔTq and the separating torque Tq22*r*. The separation torque Tq2*r* in the low-temperature sequence P2 is equal to or less than the separation torque Tq1*r* in the ordinary sequence P2.

If the ordinary sequence P1 is employed in the low-temperature environment, the rotary drive torque in the phase that the coupling 150 disengages from the apparatus body side engaging portion increases the resistance force acting on the movable member by the following reasons. Namely, the above-described disengagement, the acceleration of the rotary, the shrinkage of the body side support portion engaging with the sliding portion of the movable member, and the reduction in viscosity of the grease to be used to lower the contact resistance between the sliding portion and the support portion are the causes.

More specifically, the rotary drive torque increases up to a sum of the acceleration torque Tq11*r*, the low-temperature torque increase ΔTq, and the separating torque Tq22*r*. On the other hand, if the low-temperature sequence P2 is employed, the coupling 150 disengages from the apparatus body side engaging portion when the rotary C is rotating at the predetermined speed V1.

More specifically, a factor that increases the rotary drive torque when the coupling 150 disengages from the apparatus body side engaging portion is a constant-speed torque Tq23*r* required when the rotary C is rotating at the predetermined speed V2, not the acceleration torque Tq11*r* (i.e., a rotary acceleration factor). In general, the torque required for the constant speed rotation is smaller than the acceleration torque, i.e., Tq11*r*>Tq23*r*. In other words, the rotary drive torque required in the disengagement of the coupling 150 can be reduced by employing the low-temperature sequence P2. Accordingly, switching the rotary drive sequence to the low-temperature sequence P2 dedicated to the low-temperature environment is effective to prevent the rotary drive torque from increasing excessively.

As described above, switching the rotary drive sequence to the low-temperature sequence P2 in the low-temperature environment can suppress the increase in rotary drive torque when the coupling 150 disengages from the apparatus body side engaging portion. This is one of the effects brought by the present exemplary embodiment of the present invention.

In the present exemplary embodiment, the above-mentioned setting temperature is 7° C. If the above-mentioned low-temperature sequence P2 is employed, the time interval T11*b* during which the rotary C rotates at the predetermined speed V2 is additionally provided compared to the case where the ordinary sequence P1 is employed. The time interval during which the rotary C rotates at the predetermined speed V1 becomes shorter.

As described above, the rotational angle of the rotary C that rotates during the rotary drive sequence is constant regardless of the content of the rotary drive sequence. Further, as described above, the predetermined speed V1 is higher than the predetermined speed V2. Therefore, in the low-temperature sequence P2 according to which the rotary C rotates at the predetermined speed V2 for a long time, it takes a long time to rotate the same angle compared to the ordinary sequence P1.

More specifically, if the low-temperature sequence P2 is employed, the time of image formation requiring the rotation of the rotary becomes longer than the time required when the ordinary sequence P1 is employed. In other words, the number of sheets that can be output by the electrophotographic image forming apparatus per unit time decreases.

However, if the internal body temperature becomes equal to or less than the above-described setting temperature in the low-temperature environment and the rotary C is driven according to the low-temperature sequence P2 to perform image formation, the internal body temperature gradually increases due to the frictional heat of respective drive parts, heat generation by the motor, and influence of other heat source provided in the apparatus body. Then, if the internal body temperature exceeds the above-mentioned setting temperature, the ordinary sequence P1 is applied and the number of output sheets per unit time increases.

Namely, the number of output sheets per unit time of the apparatus temporarily decreases when the low-temperature sequence is employed in the low-temperature environment. In other words, if the internal body temperature increases during the image formation, the number of output sheets per unit time of the apparatus increases to an ordinary level. Thus, according to the present exemplary embodiment, a low-cost compact rotary drive motor is usable because the influence to the number of output sheets per unit time of the apparatus in the low-temperature environment can be minimized.

In summary, it is assumed that the cartridge B (the rotary C) has acceleration $\alpha 1$ at the timing when the coupling 150 disengages from the apparatus body side engaging portion if the temperature is T1, and the cartridge B (the rotary C) has acceleration $\alpha 2$ at the timing when the coupling 150 disengages from the apparatus body side engaging portion if the temperature is T2. In this case, the drive control unit can control the acceleration of the rotary C so as to satisfy a relationship that $\alpha 1$ is equal to or less than $\alpha 2$ (i.e., $\alpha 1$ $\alpha 2$) if T1 is equal to or less than T2 (i.e., $T1 \leqq T2$).

Further, the cartridge B (the rotary C) has speed Vr1 at the timing when the coupling 150 disengages from the apparatus body side engaging portion if the temperature is T1, and the cartridge B (the rotary C) has speed Vr2 at the timing when the coupling 150 disengages from the apparatus body side engaging portion if the temperature is T2. In this case, the drive control unit can control the speed of the rotary C so as to satisfy a relationship that Vr1 is equal to or less than Vr2 (i.e., $Vr1 \leqq Vr2$) if T1 is equal to or less than T2 (i.e., $T1 \leqq T2$) (see FIG. 28).

In the present exemplary embodiment, when the temperature is equal to or less than 7° C., the acceleration $\alpha 1$ is set to 0 and the speed Vr1 is set to a constant speed. The above-described control is desired when the easiness of control and the throughput in the image formation are taken into consideration.

As apparent from the foregoing description, the above-described exemplary embodiment can prevent a movable member from being excessively subjected to a moving load when the coupling member of the development device disengages from the apparatus body side engaging portion in the low-temperature environment. As a result, the above-described exemplary embodiment can provide an electrophotographic image forming apparatus using a development device that can use a low-cost compact movable member drive motor.

An electrophotographic image forming apparatus using a development device according to a second exemplary embodiment of the present invention is described below. The second exemplary embodiment of the present invention can be applied to an electrophotographic image forming apparatus (e.g., FIG. 4) itself. Portions similar to those described in the above-described first exemplary embodiment are denoted by the same reference numerals and their descriptions are not repeated.

Figure 31:
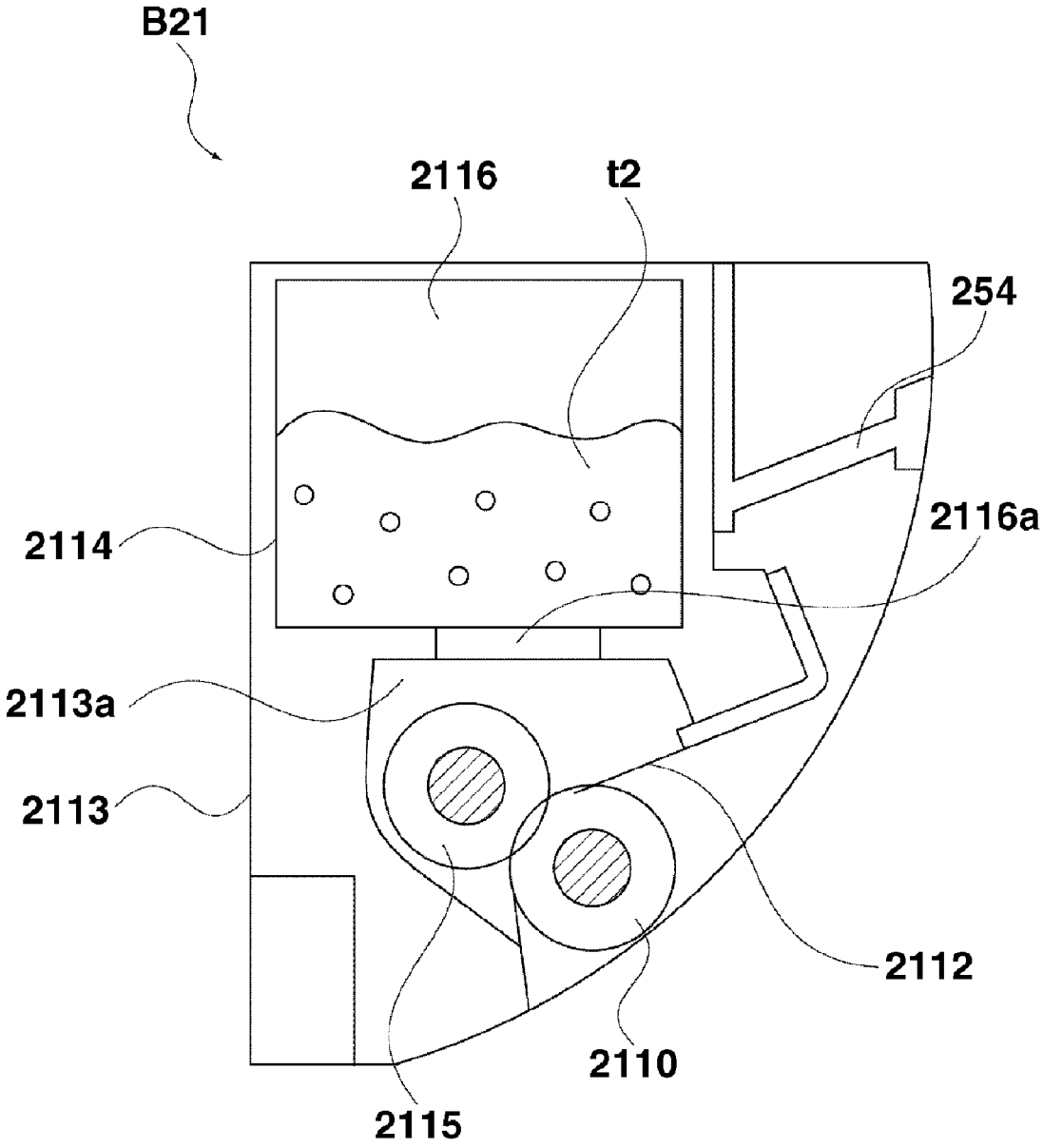
FIG. 31 is a cross-sectional side view illustrating a development device according to another exemplary embodiment of the present invention.
Figure 32:
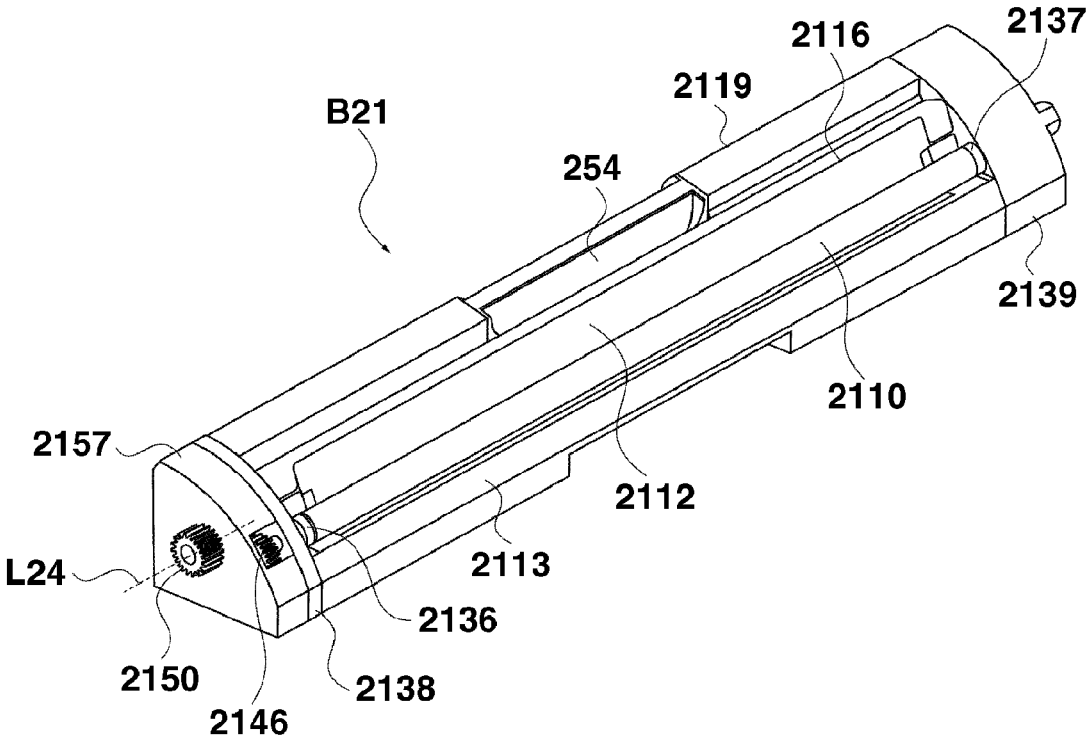
FIG. 32 is a perspective view illustrating the development device according to another exemplary embodiment of the present invention.
Figure 33:
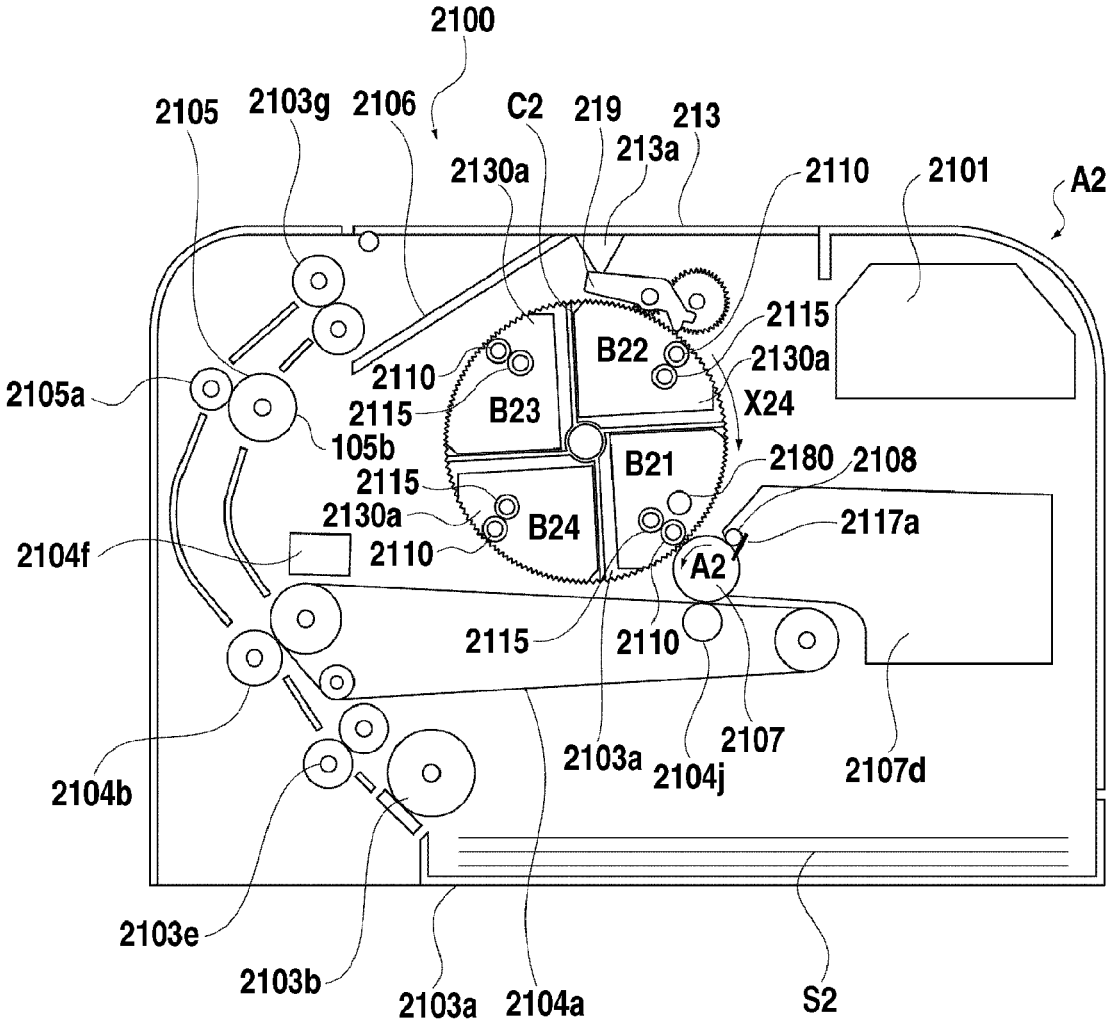
FIG. 33 is a cross-sectional side view illustrating an electrophotographic image forming apparatus according to another exemplary embodiment of the present invention.

First, a development cartridge (hereinafter, referred to as "cartridge") B21, which is operable as a development device according to the present exemplary embodiment, is described below with reference to FIG. 31 to FIG. 33. FIG. 31 is a cross-sectional view illustrating the cartridge B21. FIG. 32 is a perspective view illustrating the cartridge B21. FIG. 33 is a cross-sectional view illustrating a color electrophotographic image forming apparatus body (hereinafter, referred to as an "apparatus body") A2.

Similar to the first exemplary embodiment, a user can attach the development cartridge B21 to a development cartridge accommodation portion 2130*a* provided on a development rotary C2 provided in the apparatus body A2 (see FIG. 33). When the rotary C2 rotates in one direction, a driving force receiving member 2150 (described below) of the cartridge B21 engages with a driving force transmission member 2180 provided on the apparatus body A2 and disengages from the driving force transmission member 2180.

Figure 34A:
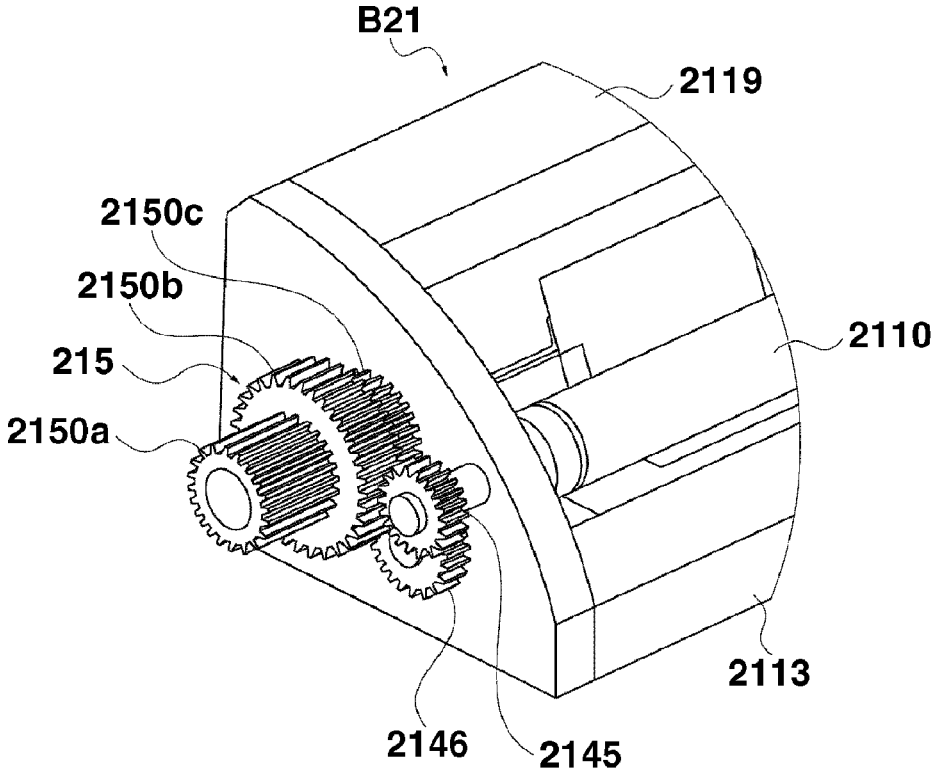
FIGS. 34A and 34B are perspective views illustrating a rotational force transmitting member according to another exemplary embodiment of the present invention.
Figure 34B:
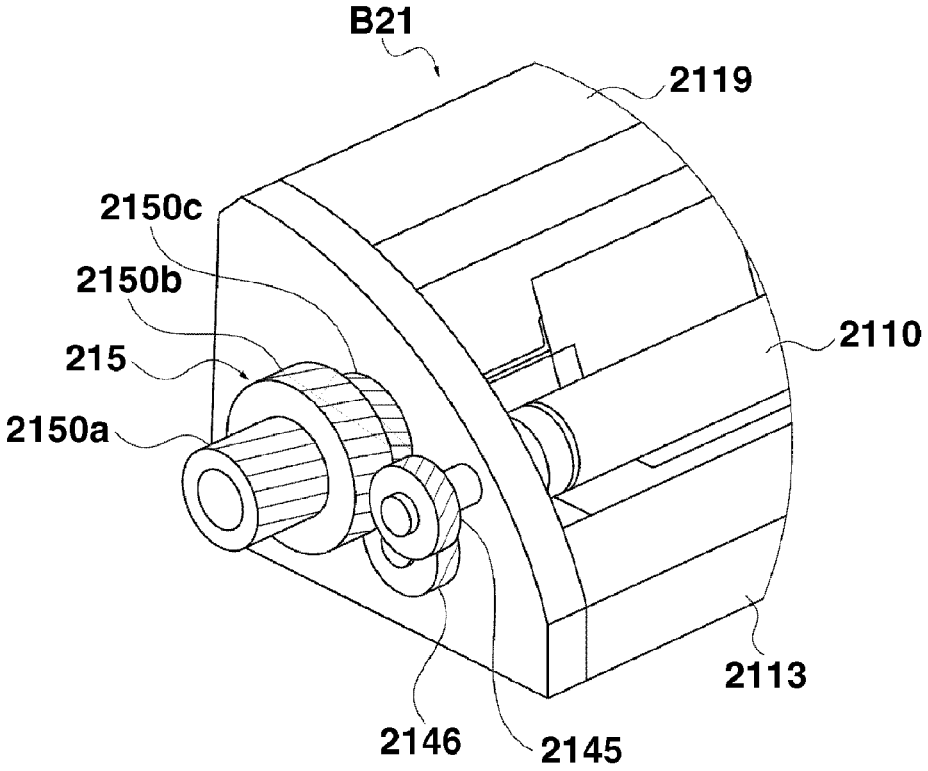

As illustrated in FIGS. 34A and 34B, a development gear 2145 is disposed coaxially with and fixed to a development roller 2110 and a developer supply gear 2146 is disposed coaxially with and fixed to a developer supply roller 2115 (see FIG. 31). Further, the development gear 2145 and the developer supply gear 2146 mesh with the driving force receiving member 2150.

Thus, when the driving force receiving member 2150 receives rotational force from the apparatus body A2, the received rotational force can be transmitted to the development roller 2110 via the development gear 2145 and to the developer supply roller 2115 via the developer supply gear 2146. In this case, the rotational force transmitted from the apparatus body A2 and received by the driving force receiving member 2150 can be also transmitted to a rotational member other than the development roller 2110 and the developer supply roller 2115.

Next, the driving force receiving member 2150 is described below in more detail.

As illustrated in FIG. 34A, the driving force receiving member 2150 is rotatably attached to a development unit 2119 at a position where it can mesh with the development gear 2145 and the developer supply gear 2146. The driving force receiving member 2150 includes a driven transmission portion 2150*a*, a development gear portion (i.e., a first gear portion) 2150*b*, and a developer supply gear portion (i.e., a second gear portion) 2150*c*, which respectively mesh with the development gear 2145 and the developer supply gear 2146.

The rotational force transmitted from the apparatus body A2 and received by the driving force receiving member 2150 is transmitted to the development roller 2110 and the developer supply roller 2115. Further, the driving force receiving member 2150 is rotatable around the axial line L24 and is attached to the development unit 2119.

The above-describe driven transmission portion can be modified into a shape illustrated in FIG. 34B as long as it fulfills the above-mentioned function. More specifically, in the exemplary embodiment illustrated in FIG. 34B, the driven transmission portion is constituted by helical gears. Further, the exemplary embodiments illustrated in FIGS. 34A and 34B can be modified in various ways using, for example, spur gears, helical gears, or magnet couplings. More specifically, the driven transmission portion can be modified into any shape if it can transmit the rotational force to the development gear 2145 and the developer supply gear 2146.

The driving force receiving member 2150 engages with the driving force transmission member 2180 immediately before or when the cartridge B21 stops at a predetermined position of the apparatus body A2. Further, when the cartridge B21 moves from the predetermined position of the apparatus body A2 after the driving force receiving member 2150 rotates for a predetermined time, the driving force receiving member 2150 disengages from the second driving force transmission member 2180.

Figure 35A:
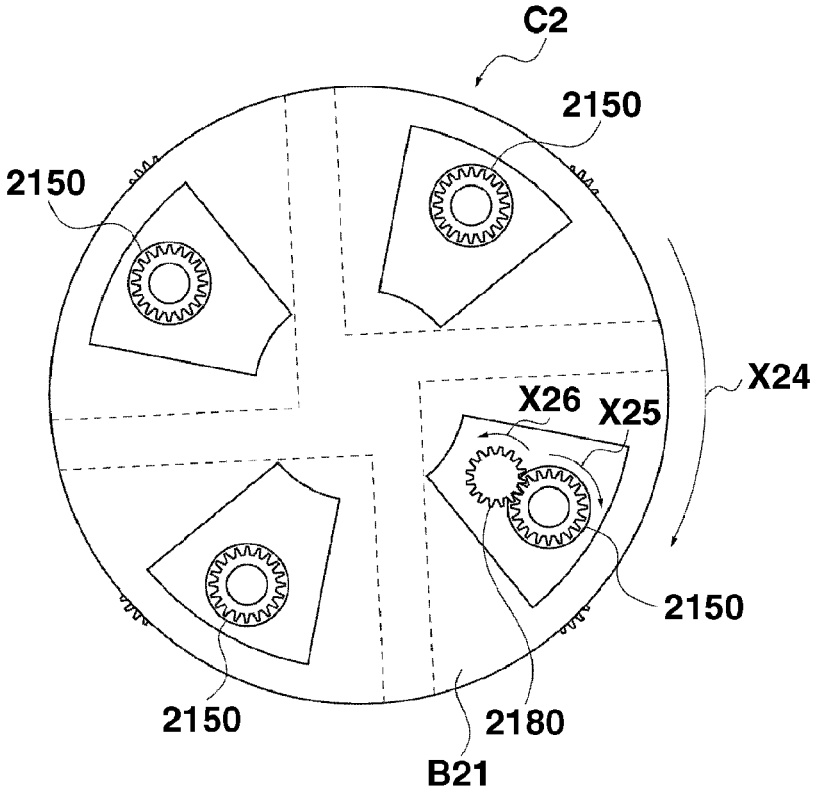
FIGS. 35A and 35B are vertical cross-sectional views illustrating a movable member according to another exemplary embodiment of the present invention.
Figure 35B:
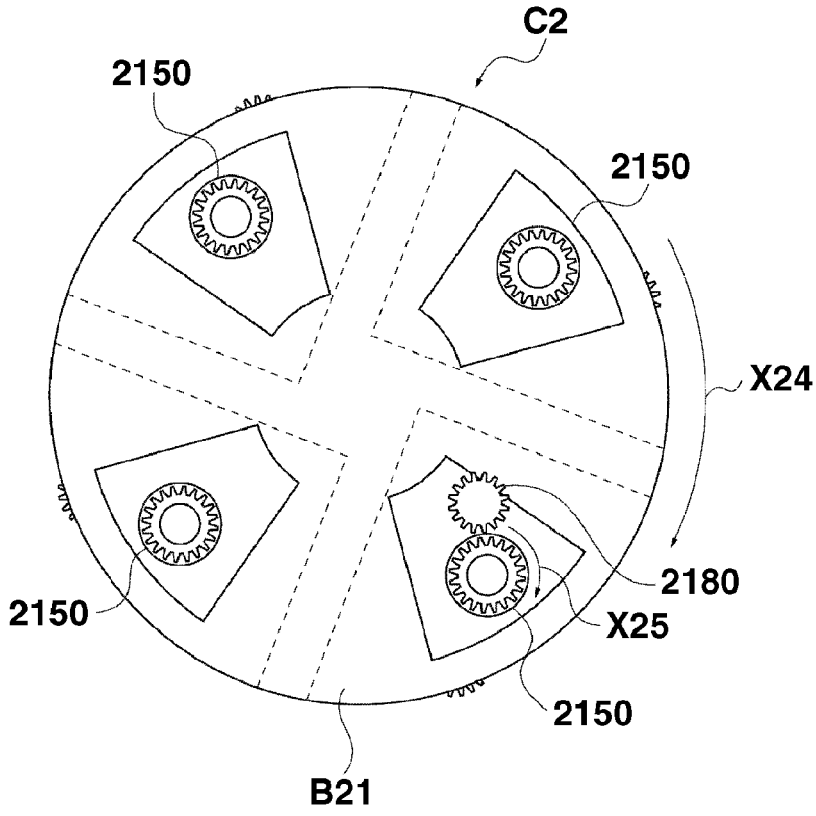

Next, the disengagement of the driving force receiving member 2150 from the driving force transmission member 2180 is described below with reference to FIGS. 35A and 35B. FIGS. 35A and 35B are side views illustrating an example configuration of a driving force transmission mechanism, which is seen from the direction of the axial line L24. FIG. 35A illustrates a state where the cartridge B21 is located at the predetermined position of the apparatus body A2. FIG. 35B illustrates the rotary C2 having rotated in the direction indicated by an arrow X24 from the state illustrated in FIG. 35A.

First, when the rotary C2 (i.e., the movable member) rotates in the direction indicated by the arrow X24, the cartridge B21 moves from the predetermined position of the apparatus body A2. In this case, while the cartridge B21 is moving, the engagement between the driving force receiving member 2150 and the driving force transmission member 2180 is maintained.

Further, at the timing when the separation distance between the driving force receiving member 2150 and the driving force transmission member 2180 becomes sufficient, the driving force receiving member 2150 disengages from the driving force transmission member 2180 (see FIG. 35B). More specifically, the engagement between the driving force receiving member 2150 and the driving force transmission member 2180 is maintained until the driving force receiving member 2150 disengages from the driving force transmission member 2180 after the cartridge B21 starts moving.

In this case, the position relationship between the driving force receiving member 2150 and the driving force transmission member 2180 changes according to the rotation of the rotary C2. The driving force receiving member 2150 is accelerated or rotated in the direction indicated by an arrow X25 according to the above-described change in the position relationship.

In this case, the driving force receiving member 2150 is accelerated if the driving force transmission member 2180 is rotating when the rotary C2 rotates. The driving force receiving member 2150 is rotated if the driving force transmission member 2180 is stopped when the rotary C2 rotates.

As described above, a significant amount of force is required to accelerate or rotate the driving force receiving member 2150, more specifically, to give acceleration to the driving force receiving member 2150. The force in this case can be given by the rotation of the rotary C2. Namely, the drive torque of the rotary C2 can give force to accelerate or rotate the driving force receiving member 2150. More specifically, the force required to give acceleration to the driving force receiving member 2150 increases the drive torque of the rotary.

The driving force receiving member 2150 may decelerate when the driving force receiving member 2150 disengages from the driving force transmission member 2180, depending on the position of the driving force transmission member 2180 or the direction of the development drive shaft 2180 in a rotational direction X26. In this case, the driving force receiving member 2150 is subjected to the acceleration force acting in the direction opposite to the rotational direction. Therefore, the force to obtain the acceleration is given by the drive torque of the rotary. Accordingly, similar to the above-described case, the drive torque of the rotary increases.

Next, an example change of the rotary drive sequence, which is dependent on the internal body temperature of the electrophotographic image forming apparatus, is described below with reference to FIG. 36. In the present exemplary embodiment, the rotary drive sequence indicates a temporal change in the rotational speed of the rotary C2.

Figure 36:
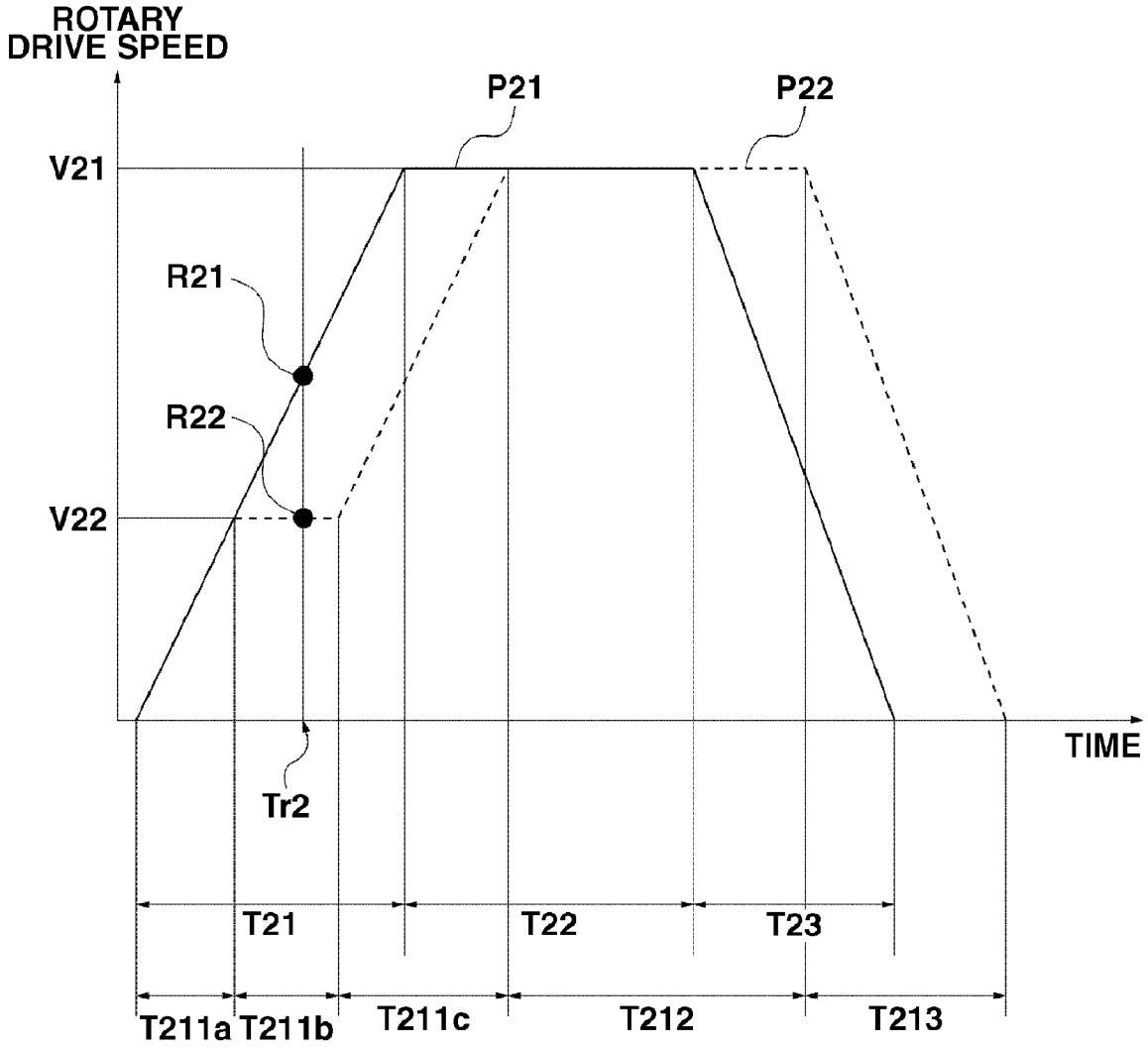
FIG. 36 is a graph illustrating rotary drive sequences according to another exemplary embodiment of the present invention.

FIG. 36 illustrates a rotary drive sequence employable in a low-temperature environment and a rotary drive sequence employable in an environment other than the low-temperature environment. In FIG. 36, the abscissa axis represents the time and the ordinate axis represents the rotary drive speed. The rotary drive sequence other than the low-temperature environment (hereinafter, referred to as an "ordinary sequence") is expressed by a sequence P21.

The rotary drive sequence in the low-temperature environment (hereinafter, referred to as a "low-temperature sequence") is expressed by a sequence P22. Further, time Tr2 indicates the timing when the driving force receiving member 2150 disengages from the driving force transmission member 2180. A vertical line passing through the time Tr2 intersects with the ordinary sequence P21 and the low-temperature sequence P22 at a point R21 and a point R22, respectively.

The rotary drive sequence is switchable between the ordinary sequence P21 and the low-temperature sequence P22 according to the internal body temperature of the electrophotographic image forming apparatus. First, according to an example switching method, the temperature detection unit 203 provided in the apparatus body A2 detects the internal body temperature of the electrophotographic image forming apparatus.

If the detected internal body temperature is higher than an arbitrary setting temperature, the ordinary sequence P21 is selected and employed by the drive control unit 201 that can control the rotary drive motor 202. If the detected internal body temperature is equal to or less than the arbitrary setting temperature, the low-temperature sequence P22 is selected and employed.

Further, when the rotary C2 is driven according to the rotary drive sequence, the rotary C rotates by an angle required to move from a state where a certain cartridge is located at the development position to a state where the next cartridge is positioned at the development position during a time interval between the start and the end of the rotary drive sequence. The angle required in this case is constant regardless of the content of the rotary drive sequence.

According to the ordinary sequence P21, the rotary C2 accelerates from 0 to a predetermined speed V21 during a first time interval of T21 and continuously rotates at the predetermined speed V21 during a second time interval of T22, and then decelerates from the predetermined speed V21 to 0 during a third time interval of T23. The driving force receiving member 2150 disengages from the driving force transmission member 2180 during the time interval T21 i.e., during the acceleration of the rotary (see the point R21 illustrated in FIG. 36).

On the other hand, according to the low-temperature sequence P22, the rotary C2 accelerates from 0 to a predetermined speed V22 during a first time interval T211*a* and continuously rotates at the predetermined speed V22 during a second time interval T211*b*. Then, the rotary C2 again accelerates from the predetermined speed V22 to the predetermined speed V21 during a third time interval T211*c* and continuously rotates at the predetermined speed V21 during a fourth time interval T212. Finally, the rotary C2 decelerates from the predetermined speed V21 to 0 during a fifth time interval T213.

The predetermined speed V21 is higher than the predetermined speed V22. The driving force receiving member 2150 disengages from the driving force transmission member 2180 during the time interval T211*b*, i.e., during the constant speed rotation of the rotary (see the point R22 illustrated in FIG. 36).

In summary, employing the ordinary sequence P21 in an environment other than the low-temperature environment and employing the low-temperature sequence P22 in the low-temperature environment as described above is effective to suppress the increase in rotary drive torque when the driving force receiving member 2150 disengages from the driving force transmission member 2180. This is one of the effects brought by the present exemplary embodiment of the present invention.

As apparent from the foregoing description, the above-described exemplary embodiment can prevent a movable member from being excessively subjected to a moving load when a driven transmission member of the development device disengages from an apparatus body side drive transmission member in the low-temperature environment. As a result, the above-described exemplary embodiment can provide an electrophotographic image forming apparatus using a development device that can use a low-cost compact movable member drive motor.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-250819 filed Oct. 30, 2009, which is hereby incorporated by reference herein in its entirety.

What is claimed is:

1. An image forming apparatus comprising:

a development device including a development roller carrying a developer to develop an electrostatic image and a driving force receiving member configured to receive a driving force to rotate the development roller;

a movable member configured to hold the development device and move the development device between a development position where the development device performs development and a retracting position where the development device separates from the development position;

a first driving force transmission member configured to transmit a driving force to the movable member to move the development device;

a second driving force transmission member configured to engage with the driving force receiving member and transmit the driving force to the driving force receiving member in a state where the development device is located at the development position;

a sensor configured to detect an internal body temperature of the image forming apparatus; and a controller configured to perform drive control for the first driving force transmission member based on the temperature detected by the sensor;

wherein if $\alpha 1$ represents acceleration of the development device in a case where the temperature detected by the sensor is T1 and the driving force receiving member disengages from the second driving force transmission member according to a movement of the development device from the development position to the retracting position, and $\alpha 2$ represents acceleration of the development device in a case where the temperature detected by the sensor is T2 and the driving force receiving member disengages from the second driving force transmission member according to a movement of the development device from the development position to the retracting position, the controller performs the drive control for the first driving force transmission member so as to satisfy a relationship $\alpha 1 \leqq \alpha 2$ when $T1 \leqq T2$.

2. The image forming apparatus according to claim 1, wherein if V1 represents moving speed of the development device in a case where the temperature detected by the sensor is T1 and the driving force receiving member disengages from the second driving force transmission member according to the movement of the development device from the development position to the retracting position, and V2 represents moving speed of the development device in a case where the temperature detected by the sensor is T2 and the driving force receiving member disengages from the second driving force transmission member according to the movement of the development device from the development position to the retracting position, the controller performs the drive control for the first driving force transmission member so as to satisfy a relationship $V1 \leqq V2$ when $T1 \leqq T2$.

3. The image forming apparatus according to claim 1, wherein the controller performs the drive control for the first driving force transmission member so that the acceleration of the development device becomes 0 in a case where the temperature detected by the sensor is equal to or less than a predetermined temperature and the driving force receiving member disengages from the second driving force transmission member according to the movement of the development device from the development position to the retracting position.

* * * * *